US005724638A

United States Patent [19]

Isogai et al.

[11] Patent Number: 5,724,638

[45] Date of Patent: Mar. 3, 1998

[54] FIXING DEVICE FOR IMAGE FORMING APPARATUS

[75] Inventors: Mitsuru Isogai; Takashi Yamada, both of Aichi-Ken; Tetsuro Ito, Anjo; Noboru Yonekawa; Taizou Oonishi, both of Toyokawa, all of Japan

[73] Assignee: Minolta Co., Ltd., Osaka, Japan

[21] Appl. No.: 716,676

[22] Filed: Sep. 13, 1996

[30] Foreign Application Priority Data

Sep. 14, 1995 [JP] Japan ..... 7-260946
Sep. 14, 1995 [JP] Japan ..... 7-260947

[51] Int. Cl.[6] ..... G03G 15/20

[52] U.S. Cl. ..... 399/333; 399/69; 399/323; 399/324; 399/328

[58] Field of Search ..... 399/33, 69, 320, 399/323, 324, 328, 329, 330, 331, 333, 335; 430/97, 99

[56] References Cited

U.S. PATENT DOCUMENTS

| | | | |
|---|---|---|---|
| 4,052,150 | 10/1977 | Behun | 399/323 X |
| 4,257,699 | 3/1981 | Lentz | 399/324 |
| 4,435,069 | 3/1984 | Sato . | |
| 4,796,046 | 1/1989 | Suzuki et al. | 399/331 |
| 4,819,020 | 4/1989 | Matsushiro et al. | 399/324 |
| 4,929,983 | 5/1990 | Barton et al. | 399/323 |
| 5,123,151 | 6/1992 | Uehara et al. | 399/333 X |
| 5,241,354 | 8/1993 | Flynn | 399/323 |
| 5,420,679 | 5/1995 | Goto et al. | 399/335 |
| 5,561,511 | 10/1996 | Mizunuma et al. | 399/333 |

FOREIGN PATENT DOCUMENTS

| | | |
|---|---|---|
| 52-102736 | 8/1977 | Japan . |
| 57-48762 | 3/1982 | Japan . |
| 57-111574 | 7/1982 | Japan . |
| 58-40571 | 3/1983 | Japan . |
| 60-37581 | 2/1985 | Japan . |
| 63-161472 | 7/1988 | Japan . |

*Primary Examiner*—Sandra L. Brase
*Attorney, Agent, or Firm*—McDermott, Will & Emery

[57] ABSTRACT

A fixing device for an image forming apparatus having low heat losses. The fixing device consists of a fixing roller and a compression roller for abutting upon it under pressure. The fixing roller and compression roller have a release layer each formed on the surface of a core metal formed of an aluminum hollow cylinder. The release layer on the surface of the fixing roller is formed of a composite material of metallic powder of good thermal conductive material such as nickel, and fluorine resin such as polytetrafluoroethylene (PTFE) and polyphenylene alkoxyether (PFA), and has spectral emissivity at a wavelength of 5 to 10 μm being within a range of 0.1 to 0.65. The compression roller is provided with a release layer formed of fluorine resin like the conventional one, or the same material as the release layer on the surface of the aforesaid fixing roller, having lower spectral emissivity.

27 Claims, 28 Drawing Sheets

FIXING DEVICE FOR IMAGE FORMING APPARATUS

BACKGROUND OF THE INVENTION

The present invention relates to an electrophotographic type image forming apparatus and, more particularly to a fixing device for an image forming apparatus for heating and fixing a toner image formed on a recording medium.

In an electrophotographic type image forming apparatus, an electrostatic latent image formed on a photosensitive drum is developed with toner, this toner image is transferred onto a recording medium, and this recording medium is allowed to pass through between fixing rollers heated at a predetermined fixed temperature to thereby heat and fuse the toner and to bond it compressively to a recording medium, thus fixing the toner image.

The fixing rollers are temperature-controlled to maintain a predetermined temperature e.g., 200° C. during the operation of the device, but when the device is in a standby state, are to be temperature-controlled at a lower, predetermined temperature e.g., 160° C. than a fixing temperature, e.g., 200° C. during the operation in order to restrain wasteful consumption of power for heating. Further, when a print key is not operated for more than a predetermined time in the standby state, some fixing rollers are to enter an electricity saving mode, and to be temperature-controlled at a further lower temperature, e.g. 120° C. than the temperature in the standby state.

In addition, means for covering around the fixing rollers with heat insulation material and the like are also used in order to reduce losses of heat to be emitted from the fixing rollers, and the fixing device is provided with such various means as to reduce the energy to be consumed by the fixing device as much as possible.

However, when the image forming apparatus enters an operating state from the electricity saving mode, or when it enters the operating state from the standby state, the temperature at the fixing rollers must be increased to a fixable, predetermined temperature. Since a fixed waiting time is required to reach this temperature, there is no serving sufficiently the needs for requiring quick treatment.

Also, when the structure of covering with heat insulation material is adopted in order to reduce losses of heat to be emitted from the fixing rollers, space is required for the structure, causing inconvenience that the device will be large in size.

Also, the fixing device is provided with a separating claw for separating a recording medium from the fixing rollers. Since it is arranged in contact with or in close proximity to the fixing rollers and is exposed to high temperatures, the separating claw has conventionally been made of high heat-resistant fluorine resin or the like. However, the fluorine resin has high heat absorption, and therefore it takes heat away from the fixing rollers. In addition, the temperature of the separating claw itself increases. For this reason, in the case of both-face copying, composite copying or the like, the separating claw at a high temperature comes into contact with the toner image, which has been formed and fixed on the first face by the preceding image forming process, to deform the toner image. In addition, there is also inconvenience that the material is expensive.

Further, in order to maintain the surface temperature of the fixing rollers at a predetermined fixed temperature, a temperature detection sensor for detecting the surface temperature of the fixing rollers is arranged in contact with the fixing rollers in the fixing device. On the surface of the temperature detection sensor, coating of fluorine resin, etc. has been formed in order to prevent toner from adhering and to protect the surface, but since the fluorine resin has high heat absorption and takes heat away from the fixing rollers, it causes inconvenience that the precision of temperature detection deteriorates and the response to temperature is lowered.

SUMMARY OF THE INVENTION

It is a principal object of the present invention to provide a fixing device for an image forming apparatus having low heat losses, capable of saving the power consumption.

It is another object of the present invention to provide a fixing device for an image forming apparatus capable of quickly shifting from an electricity saving mode to an operating mode or from a standby mode to an operating mode in a short time.

It is a further object of the present invention to provide a fixing device for an image forming apparatus having low heat losses, for covering the surfaces of the heating rollers and compression rollers which constitute the fixing device, and other component elements arranged within the fixing device with material having low heat absorption to reduce heat emission from the surfaces.

It is an even further object of the present invention to provide a fixing device for an image forming apparatus capable of forming a high quality image without disturbing an image even in both-face copying, composite copying and the like.

It is another object of the present invention to provide a fixing device for an image forming apparatus having high precision in detecting the temperatures of the heating rollers and compression rollers which constitute the fixing device, and having high response to temperatures.

The above and further objects and novel features of the present invention will appear from the following detailed description and the accompanying drawings.

DETAILED DESCRIPTION OF THE PREFERRED EMBODIMENTS

Hereinafter, with reference to the accompanying drawings, the detailed description will be made of embodiments according to the present invention.

<Structure of Copying Device>

Figure 1:
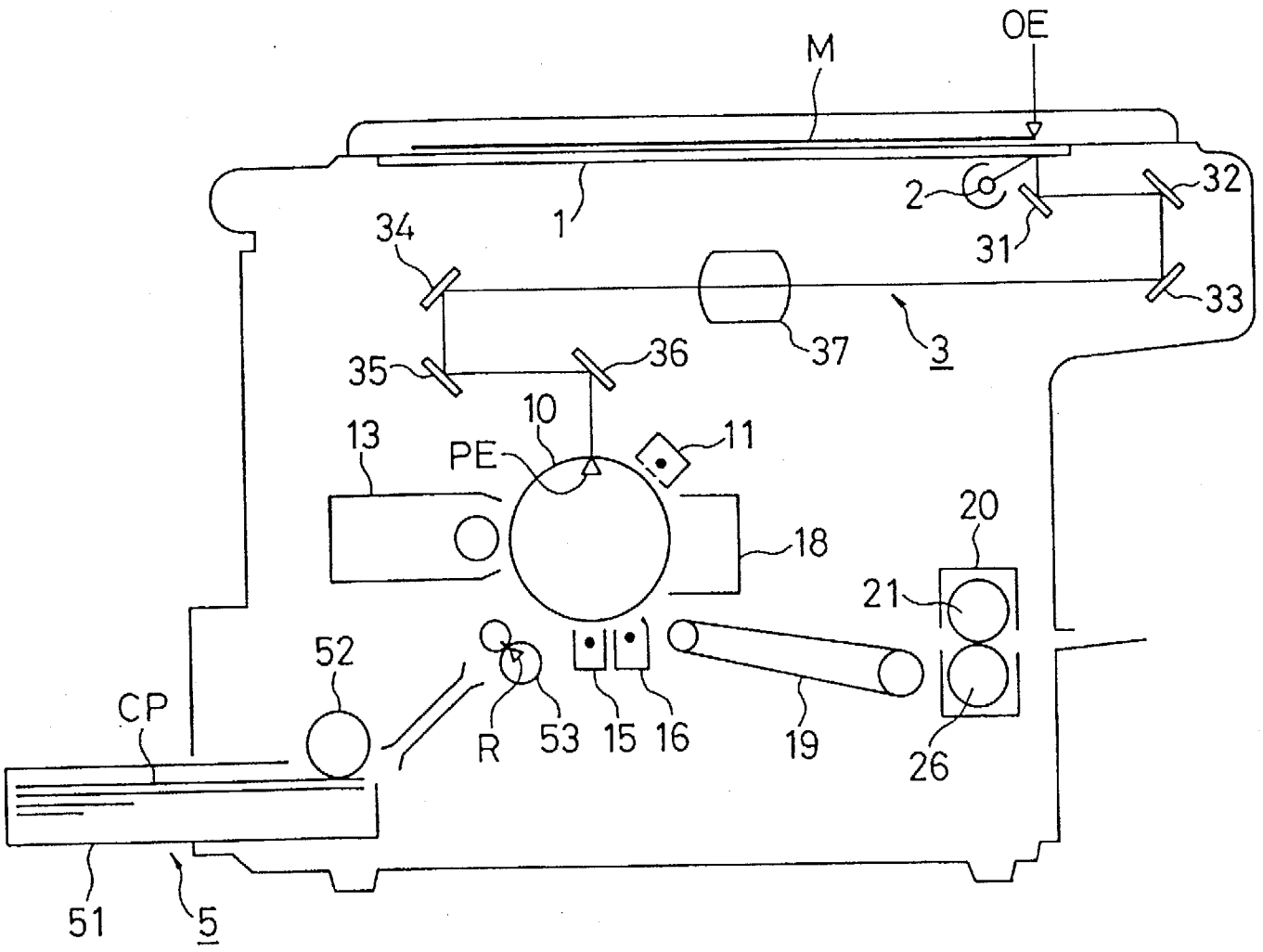
FIG. 1 is a sectional view showing the structure of a copying device to which a fixing device according to the present invention is applied.

FIG. 1 is a sectional view showing an example of the structure of a copying device to which a fixing device according to the present invention is applied. Since this structure is the same as a known electrophotographic system copying device, its outline will be briefly described herein.

In the copying device, there is arranged a photosensitive drum 10 for rotating at a fixed circumferential speed at the center thereof, above which a document glass 1 is arranged. Under the document glass 1, a scanning optical system 3 is arranged, and a sheet feed unit 5 is arranged below on the left side of the photosensitive drum 10.

Around the photosensitive drum 10, there are arranged a main charger 11, a developer 13, a transfer charger 15, a separating charger 16, a cleaner 18, a fixing device 20 and the like.

The scanning optical system 3 is composed of an illumination light source 2, movable mirrors 31 to 33, conjugate distance correction mirrors 34 and 35, a fixed mirror 36 and a projection lens 37 whose magnification can be changed.

The illumination light source 2 and the movable mirror 31 are integrally held, the movable mirrors 32 and 33 are integrally held, and they are respectively provided so as to move and scan to the left just under the document glass 1 in FIG. 1. In the case of making identical copies to originals, the illumination light source 2 and the movable mirror 31 moves at the same speed as the circumferential speed v of the photosensitive drum 10 while the movable mirrors 32 and 33 move at a speed of v/2 m.

The sheet feed unit 5 is equipped with a sheet cassette 51, a feed roller 52, and a timing roller 53. A recording sheet CP housed in the sheet cassette 51 is fed by the feed roller 52 being rotationally driven, is conveyed by a convey roller (not shown), and is stopped once at a standby position R when its leading end comes into contact with the nip portion of the timing roller 53.

An original M placed on the document glass 1 is scanned by the scanning optical system 3 to form an electrostatic latent image for the original image on the photosensitive drum 10. The electrostatic latent image for the original image formed on the photosensitive drum 10 is developed by means of toner in a developer 13, and is moved to a transfer position. In synchronism with this timing, the timing roller 53 starts rotation, and the recording sheet CP, which has waited at the standby position R, is conveyed to the transfer position where there is the transfer charger 15. At the transfer position, a toner image formed on the photosensitive drum 10 by the operation of the transfer charger 15 is transferred onto the recording sheet CP. The recording sheet CP is separated from the photosensitive drum 10 by the operation of the separating charger 16, is conveyed by means of a convey belt 19, and is heated and compressed in a fixing device 20 to fix the toner image onto the recording sheet CP.

(Structure of Fixing Device)

Figure 2:
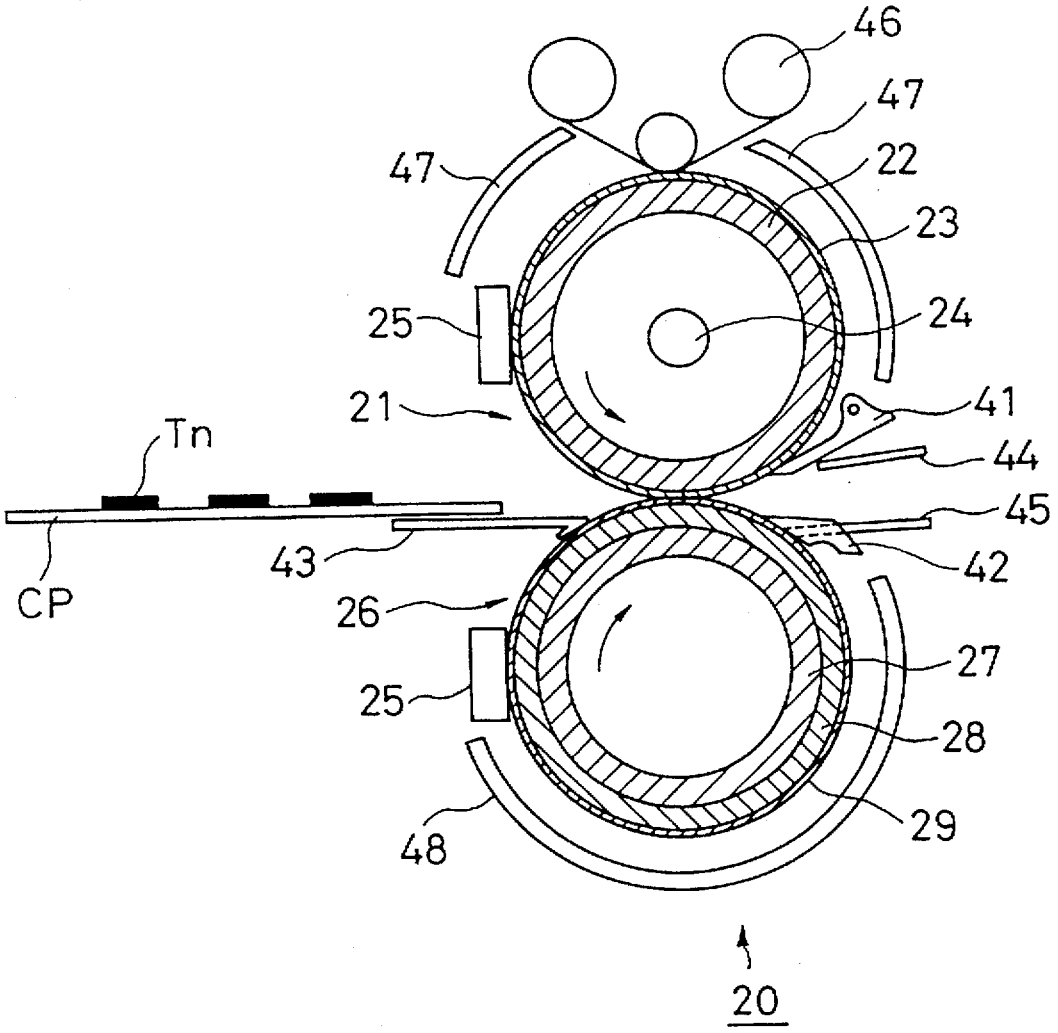
FIG. 2 is a sectional view showing the structure of the fixing device.
Figure 3:
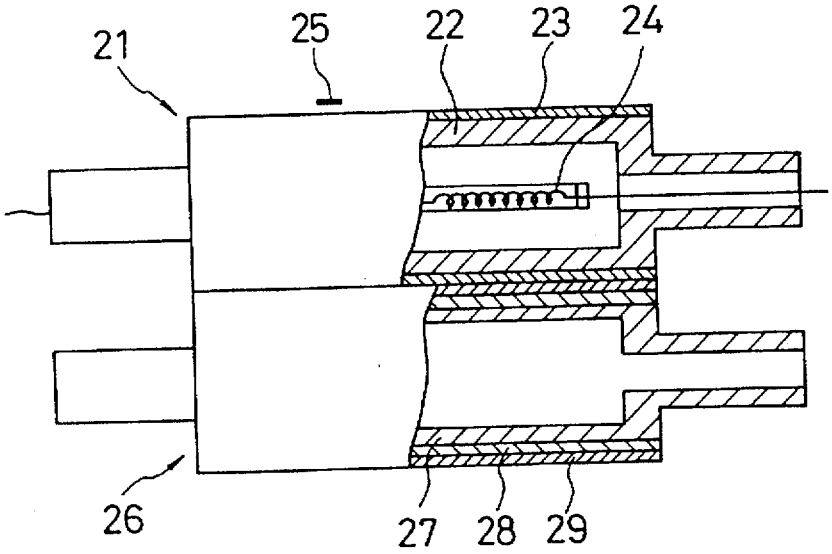
FIG. 3 is a sectional view showing the structure of a fixing roller and a compression elastic roller according to a first embodiment.

FIG. 2 is a sectional view illustrating the structure of the fixing device 20, and FIG. 3 is a sectional view showing a fixing roller 21 and a compression elastic roller 26 which mainly constitute the fixing device 20.

The fixing roller 21 and the compression elastic roller 26 are constructed to be rotated in the arrowed direction by a driving mechanism (not shown) while abutting upon each other under pressure. At a downstream side of the rotation direction of the fixing roller 21, a separating claw 41 is arranged to be in contact with the roller 21, and at a downstream side of the rotation direction of the compression elastic roller 26, a separating claw 42 is arranged to be in contact with the roller 26 so that the recording sheet CP is peeled from the fixing roller 21 and the compression elastic roller 26 for discharging.

Also, on the surfaces of the fixing roller 21 and the compression elastic roller 26, a temperature detection sensor 25 for detecting the surface temperature is arranged to be in contact therewith so that the surface temperatures on the fixing roller 21 and the compression elastic roller 26 are always detected. The electrically-energizing time of a heating halogen heater 24 is controlled by means of a temperature control circuit (not shown) so that the surface temperatures are maintained at a predetermined, fixed temperature.

In this respect, a guide plate 43 feeds a recording sheet CP, on which a non-fixed toner image Tn has been formed, to a nip portion between the fixing roller 21 and the compression elastic roller 26, and guide plates 44 and 45 guide the recording sheet CP fixed in the exhaust direction.

Figure 4:
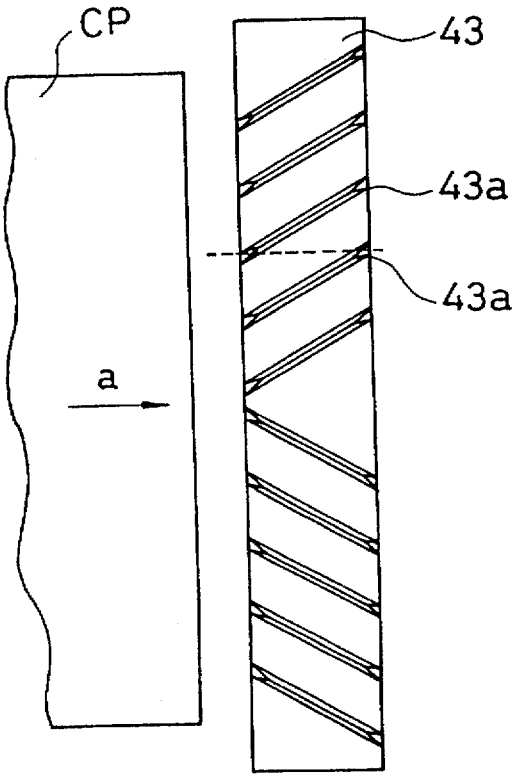
FIG. 4 is a plan view showing a guide plate.

FIG. 4 is a plan view showing the guide plate 43, and a plurality of ribs 43a are formed on the surface thereof as shown in FIG. 4 in order to reduce the frictional resistance at the passage of the recording sheet CP by reducing the contact area with the recording sheet CP, and to remove a mixture of dust such as paper powder. The height of the ribs **43*a*** is preferably 0.3 to about 1.0 mm in order to ensure smooth passage of the recording sheet, and to reduce the influence of temperature given to it.

The guide plate 43 is made of low heat emissive material which is difficult to absorb heat, but since the temperature still increases, the guide plate is arranged (See FIG. 4) so that the leading end of a rib **43*a* overlaps with the trailing end of the adjacent rib 43*a* in the advancing direction (direction indicated by an arrow a) of the recording sheet CP in order to restrain fixing unevenness. The tip-opened arrangement (See FIG. 4) and the root-opened arrangement of the ribs 43*a*** make no remarkable difference in the effect.

A cleaning and anti-offset liquid coating device 46 removes the toner adhering to the surface of the fixing roller 21. The fixing roller 21 and the compression elastic roller 26 are surrounded on all sides with heat insulation material 47 and thermal reflector 48 in order to prevent heat radiation from the fixing roller 21 and the compression elastic roller 26.

The structure of the fixing roller and the compression elastic roller will be described in detail. First, a conventional fixing roller will be described. For the conventional fixing roller, in a fixing roller 21 having the structure shown in FIG. 3, the hollow, cylindrical core metal 22 is formed of metallic material such as aluminum, copper, and iron having good thermal conductive characteristics, and the surface of the core metal 22 is coated with a release layer 23 made of a material such as fluorine resin such as polytetrafluoroethylene (hereinafter, referred to as PTFE) and polyphenylene alkoxyether (hereinafter, referred to as PFA), or silicone rubber, or the like.

The physical properties of the release layer of the conventional fixing roller are such that the spectral emissivity in a wave range of wavelength of 5 to 10 μm (infrared ray region) is 0.9 or more, and that the thermal conductivity of the release layer is approximately $6.0\times10^{-4}$ to $7.0\times10^{-4}$ cal/(deg.cm.s). The surface roughness Rz (10-marks mean roughness, unit: μm, hereinafter described simply as Rz) of the release layer is 40 μm or less, and the film thickness of the release layer is 40 μm or less.

The conventional compression elastic roller is prepared as follows. That is, in the compression elastic roller 26 having the structure shown in FIG. 3, the hollow, cylindrical core metal 27 is formed of metallic material such as aluminum, copper, and iron having good thermal conductive characteristics, and the surface of the core metal 27 is covered with material 28 such as silicone rubber to form an elastic layer, and further the top thereof is coated with fluorine resin film 29.

On the other hand, a fixing roller according to the present invention is, in the fixing roller having the structure shown in FIG. 3, the same as the conventional fixing roller in that the hollow, cylindrical core metal 22 is formed of metallic material such as aluminum, copper, and iron having good thermal conductive characteristics, but the release layer 23 for covering the surface of the core metal 22 differs in material.

In other words, in the fixing roller according to the present invention, the release layer 23 is formed of a composite material prepared by mixing PTFE and PFA by 30% in volume ratio with nickel, which is metal having good thermal conductivity. The physical properties of the release layer are such that the spectral emissivity in a wave range of wavelength of 5 to 10 μm (infrared ray region) is within a range of 0.10 to 0.65, and that the thermal conductivity of the release layer is within ranges lower than 0.2 cal/(deg.cm.s) and not lower than $7.0\times10^{-4}$ cal/(deg.cm.s). The surface roughness and film thickness of the release layer will be described in the experimental result to be described hereinafter. In this respect, the compression elastic roller is the same as the above-described conventional compression elastic roller.

Next, the structure of the separating claws 41 and 41 will be described in detail. The release layer of the conventional separating claw is formed by applying coating material mainly composed of fluorine resin such as PFA onto the surface of the claw body formed of heat-resistant synthetic resin material such as polyimide (PI), polyamide-imide (PAI) and polyetheretherketone (PEEK). The physical properties of the release layer are such that the spectral emissivity in a wave range of wavelength of 5 to 10 μm (infrared ray region) is 0.9 or more, and that the thermal conductivity is approximately $6.0\times10^{-4}$ to $7.0\times10^{-4}$ cal/(deg.cm.s).

On the other hand, the separating claw according to the present invention is the same as the conventional separating claw in that the claw body is formed of fluorine resin heat-resistant synthetic resin material such as PI, PAI and mater but is different in material for the release layer.

More specifically, the release layer of the separating claw according to the present invention is formed of a composite material prepared by mixing, with a coating material mainly composed of PTFE, nickel, which is a good thermal conductor having lower spectral emissivity than that of this coating material in a wave range of wavelength of 5 to 10 μm (infrared ray region), by 70% in volume ratio with respect to PTFE, the aforesaid coating material. The physical properties of the coated layer are such that the spectral emissivity in a wave range of wavelength of 5 to 10 μm (infrared ray region) is 0.15, and the thermal conductivity is approximately 0.13 cal/(deg.cm.s).

Next, the structure of the temperature detection sensor 25 will be described. Since the temperature detection portion of the temperature detection sensor has the same structure as the conventional one using a thermistor, the description thereof will be omitted, and the release layer relating to the present invention will be described.

In the conventional temperature detection sensor, the release layer is formed by applying coating material mainly composed of fluorine resin such as PFA on the surfaces of the substrate formed of metal such as stainless steel (SUS), and the thermistor which is the temperature detection unit. The physical properties of the release layer are such that the spectral emissivity in a wave range of wavelength of 5 to 10 μm (infrared ray region) is 0.9 or more, and that the thermal conductivity is approximately $6.0\times10^{-4}$ to $7.0\times10^{-4}$ cal/(deg.cm.s).

On the other hand, the temperature detection sensor according to the present invention is different in material from the release layer formed on the surfaces of the substrate and the thermistor, which is the temperature detection unit. More specifically, the surface coated layer of the temperature detection sensor according to the present invention is formed of a composite material prepared by mixing, with a coating material mainly composed of PTFE, nickel, which is a good thermal conductor having lower spectral emissivity than that of this coating material in a wave range of wavelength of 5 to 10 μm (infrared ray region), by 70% in volume ratio with respect to PTFE, the aforesaid coating material. The physical properties of the coated layer are such that the spectral emissivity in a wave range of wavelength of 5 to 10 μm (infrared ray region) is 0.15, and the thermal conductivity is approximately 0.13 cal/(deg.cm.s).

<Second Embodiment>

Next, the description will be made of a second embodiment according to the present invention. In the second embodiment, the fixing roller in the aforesaid first embodiment has been changed to a fixing elastic roller, and there are no remarkable differences between the two in other respects. Therefore, the fixing elastic roller will be described.

Figure 5:
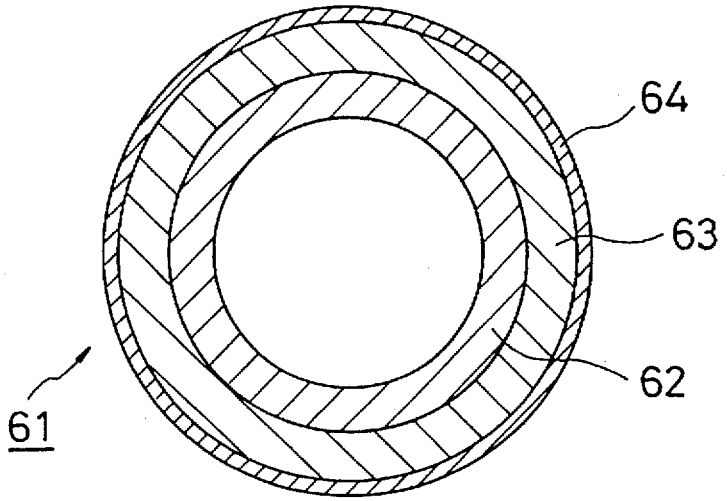
FIG. 5 is a sectional view showing the structure of a fixing elastic roller according to a second embodiment.

In the fixing elastic roller 61 in the second embodiment, as shown in the sectional structure of FIG. 5, an elastic layer 63 formed of heat-resistant elastic rubber such as silicone rubber and fluorine rubber is formed on the hollow, cylindrical core metal 62 formed of material such as aluminum, copper and iron having good thermal conductive characteristics, and a release layer 64 is formed on the elastic layer 63.

The release layer 64 is the same as the release layer 23 of the fixing roller 21 of the first embodiment previously described, and is made of a composite material prepared by mixing PTFE by 30% in volume ratio with nickel, which is metal having good thermal conductivity. The spectral emissivity in a wave range of wavelength of 5 to 10 μm is within a range of 0.10 to 0.65, and that the thermal conductivity is within ranges lower than 0.2. cal/(deg.cm.s) and not lower than $7.0\times10^{-4}$ cal/(deg.cm.s).

The film thickness of the release layer 64 is adjusted within a range of 1 to 100 μm, and the surface roughness Rz of the release layer 64 is adjusted within a range of 0.1 to 100 μm. The hardness of the elastic layer 63 formed of heat-resistant elastic rubber is adjusted within a range of 10° to 80° in Japanese Industrial Standard (JIS-A), and the thickness is adjusted within a range of 0.05 to 15 mm.

Incidentally, the Japanese Industrial Standard (JIS-A) concerning the hardness of the elastic layer is to stack up sheets (2 mm thick) of rubber material to be measured to a height of about 6 mm, apply a load of 1 kg with five indentation points using a hardness meter JIS-A (manufactured by Teklock Inc.), measure its indentation depth, and use a value obtained by effecting arithmetic mean of the measured values as the hardness.

<Third Embodiment>

The description will be made of a third embodiment according to the present invention. In the third embodiment, the fixing roller in the aforesaid first embodiment has been changed to a fixing elastic roller having a plurality of elastic layers, and there are no remarkable differences between the two in other respects. Therefore, the fixing elastic roller having a plurality of elastic layers will be described.

Figure 6:
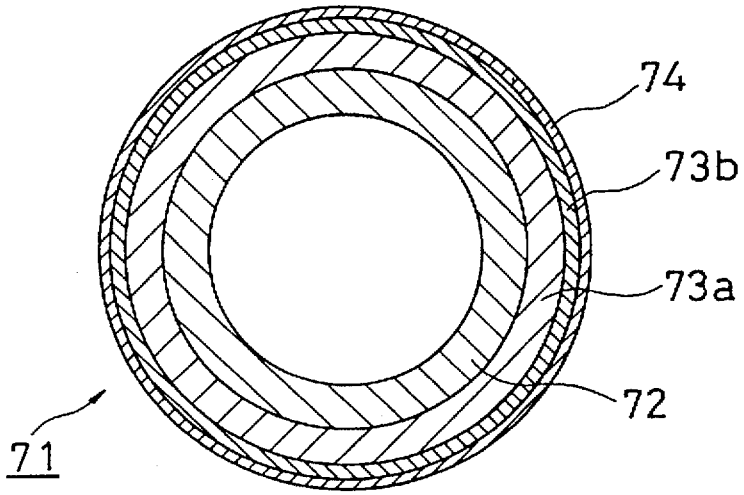
FIG. 6 is a sectional view showing the structure of a fixing elastic roller having a plurality of elastic layers according to a third embodiment.

In the fixing elastic roller 71 having a plurality of elastic layers in the third embodiment, as shown in the sectional structure of FIG. 6, a plurality of elastic layers 73*a* and 73*b* formed of heat-resistant elastic rubber such as silicone rubber and fluorine rubber are formed on the hollow, cylindrical core metal 72 formed of a material such as aluminum, copper and iron having good thermal conductive characteristics, and a release layer 74 is formed on the plurality of elastic layers 73*a* and 73*b*. For the heat-resistant elastic rubber material, which constitutes the plurality of elastic layers 73*a* and 73*b*, different materials are used for these two elastic layers, but the same material may be used.

The release layer 74 is the same as the release layer 23 of the fixing roller 21 of the first embodiment previously described, and is made of a composite material prepared by mixing PTFE by 30% in volume ratio with nickel, which is metal having good thermal conductivity. The spectral emissivity in a wave range of wavelength of 5 to 10 μm is within a range of 0.10 to 0.65, and that the thermal conductivity is within ranges lower than 0.2. cal/(deg.cm.s) and not lower than $7.0\times10^{-4}$ cal/(deg.cm.s).

The film thickness of the release layer 74 is adjusted within a range of 1 to 100 μm, and the surface roughness Rz of the release layer 74 is adjusted within a range of 0.1 to 100 μm. The hardness of the elastic layers 73*a* and 73*b* formed of heat-resistant elastic rubber is adjusted within a range of 10° to 80° (JIS-A), and the total thickness of the elastic layers 73*a* and 73*b* is adjusted within a range of 0.05 to 15 mm.

<Fourth Embodiment>

The description will be made of a fourth embodiment according to the present invention. In the fourth embodiment, the fixing roller in the aforesaid first embodiment has been changed to a fixing elastic belt, and there are no remarkable differences between the two in other respects. Therefore, the fixing elastic belt will be described.

The fixing elastic belt in the fourth embodiment is a fixing belt capable of sandwiching a non-fixed recording sheet between the fixing elastic belt and the compression elastic roller to heat and fix it while conveying the recording sheet.

Figure 7:
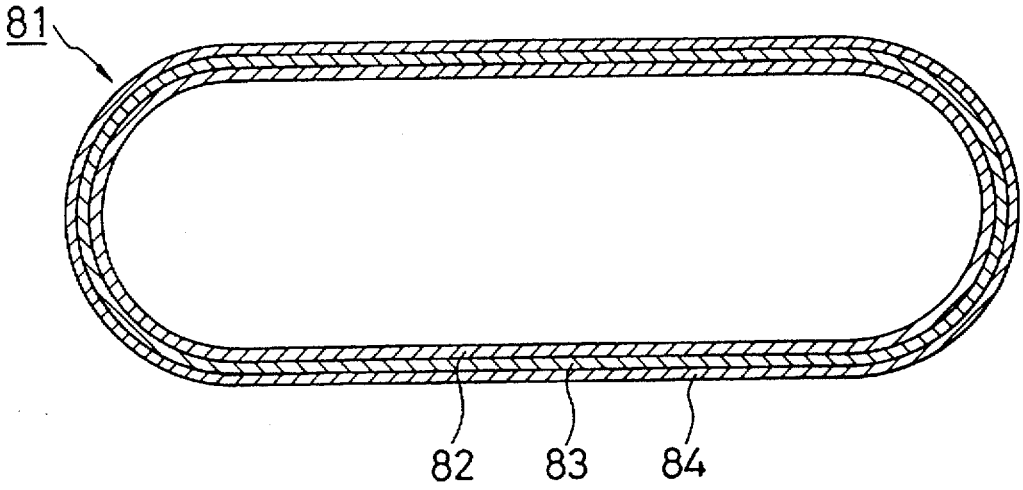
FIG. 7 is a sectional view showing the structure of a fixing elastic belt according to a fourth embodiment.

In the fixing elastic belt 81, as shown in the sectional structure of FIG. 7, an elastic layer 83 formed of heat-resistant elastic rubber such as silicone rubber and fluorine rubber is formed on a thin-walled metal film 82 having a thickness of about 40 μm such as nickel alloy, on top of which a release layer 84 is formed. In this respect, for the belt base, it may be constituted by heat-resistant synthetic resin film such as polyimide and Teflon in place of the aforesaid metal film.

The release layer 84 is the same as the release layer 23 of the fixing roller 21 of the first embodiment previously described, and is made of a composite material prepared by mixing PTFE by 30% in volume ratio with nickel, which is metal having good thermal conductivity. The spectral emissivity in a wave range of wavelength of 5 to 10 μm is 0.14, and the thermal conductivity is approximately 0.13 cal/(deg.cm.s).

The film thickness of the release layer 84 is adjusted within a range of 1 to 100 μm, and the surface roughness Rz of the release layer 84 is 40 μm or less.

<Fifth Embodiment>

The description will be made of a fifth embodiment according to the present invention. In the fifth embodiment, the fixing roller in the aforesaid first embodiment has been changed to a self-heat release type fixing elastic roller, and there are no remarkable differences between the two in other respects. Therefore, the self-heat release type fixing elastic roller will be described herein.

Figure 8:
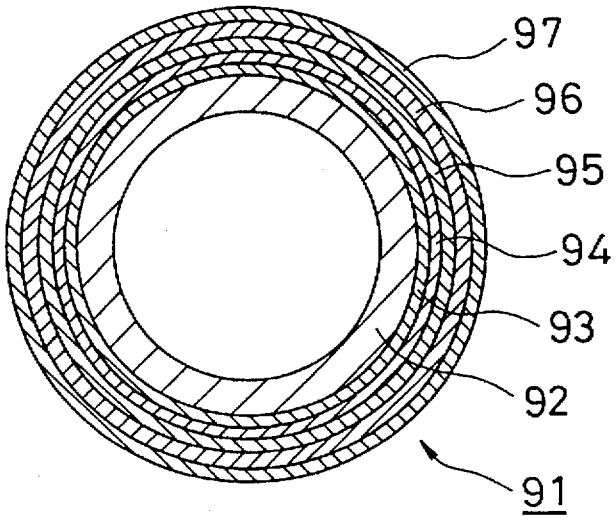
FIG. 8 is a sectional view showing the structure of a self-heat release type fixing elastic roller according to a fifth embodiment.

In the self-heat release type fixing elastic roller 91 in the fifth embodiment, as shown in the sectional structure of FIG. 8, an elastic layer 93 serving dually as an electrical insulating layer, formed of heat-resistant elastic rubber such as silicone rubber and fluorine rubber is formed on the hollow, cylindrical core metal 92 formed of metal such as aluminum, copper and iron having good thermal conductive characteristics, heat-resistant synthetic resin such as phenol, and a material such as ceramic, on top of which an electrical insulating layer 94, a heating resistor layer 95, an electrical insulating layer 96 and a release layer 97 are stacked in order.

The release layer 97 is the same as the release layer 23 of the fixing roller 21 of the first embodiment previously described, and is formed of a composite material prepared by mixing PTFE by 30% in volume ratio with nickel, which is metal having good thermal conductivity. The spectral emissivity in a wave range of wavelength of 5 to 10 μm is 0.4, and the thermal conductivity is about 0.13 cal/(deg.cm.s).

The film thickness of the release layer 96 is adjusted within a range of 1 to 100 μm, and the surface roughness Rz of the release layer 96 is 40 μm or less.

In property experiments for the fixing roller, fixing elastic roller, fixing elastic roller having a plurality of elastic layers, fixing elastic belt, and self-heat release type fixing elastic roller of the first to fifth embodiments to be described later, the conventional fixing roller, fixing elastic roller, fixing elastic roller having a plurality of elastic layers, fixing elastic belt, and self-heat release type fixing elastic roller to be indicated for comparison are different from those of each embodiment described above only in spectral emissivity, and are not remarkably different from those in each embodiment in other structures.

In the conventional release layer, the spectral emissivity in a wave range of wavelength of 5 to 10 μm is 0.6 or more, and the thermal conductivity is within a range of $6.0\times10^{-4}$ to about $7.0\times10^{-4}$ cal/(deg.cm.s).

The fixing roller, fixing elastic roller, fixing elastic roller having a plurality of elastic layers, fixing elastic belt, and self-heat release type fixing elastic roller in the first to fifth embodiments as described above are all rotatable members having heating means and for conveying a recording medium, and therefore, may, including the above-described roller and belt, be called heating convey rotatable member.

<Description of Property Experiment Result for Fixing Roller>

Concerning the property of the fixing roller having the release layer according to the present invention, the experiments were conducted under various conditions, and their results will be described hereinafter.

First, the fixing roller of the first embodiment according to the present invention used for the property experiment for the fixing roller will be described. For the fixing roller and compression elastic roller, those having the structure shown in FIG. 3 are used, and for the core metal, an aluminum hollow, cylinder having 60 mm in diameter, 8 mm in thickness and 320 mm in axial length is used.

Test pieces S11 in the aforesaid first embodiment are a plurality of roller groups in which the film thickness of the release layer varies within a range of 1 to 100 μm, and test pieces S12 are a plurality of roller groups in which the surface roughness Rz of the release layer varies within a range of 0.1 to 100 μm. Other physical properties of the release layer were described in the description of the respective experimental results.

The conventional fixing roller indicated for comparison has also the same core metal dimensions and same structure as the fixing roller used for the property experiment according to the present invention, and the release layer is formed of a composite material of PTFE and PFA. Test pieces R11 for comparison are a plurality of roller groups in which the film thickness of the release layer varies within a range of 1 to 100 μm, and test pieces S12 are a plurality of roller groups in which the surface roughness Rz of the release layer varies within a range of 0.1 to 100 μm.

Incidentally, the spectral emissivity was measured in this experiment by using a thermal radiation measuring device (Fourier conversion infrared spectrophotometer Type FT4200 and thermal radiation measuring system (black body furnace, sample heating furnace and temperature controller) manufactured by Shimadzu Seisakusho Ltd.)), and the measurement was conducted in an infrared rays region of wavelength of 5 to 10 μm at a measuring temperature of 200° C.

The size of the sample for measurement of the spectral emissivity was 10×50 mm. Also, to eliminate the influence of the surroundings of the sample, the measuring range was adjusted to 5×10 mm by means of an aperture for measurement. High-temperature black body paint (emissivity 0.9) was coated on a half of the surface of the sample, which was used as a pseudo black body.

The measuring method was to first measure the radiation spectrum with the pseudo black body as reference, and to adjust the temperature of the sample heating furnace so as to be in equilibrium at emissivity of 90%. When the emissivity of the pseudo black body becomes 90%, the sample was moved to measure the radiation spectrum of the sample to be measured at that temperature.

<Experiment 1. Power Consumption of Fixing Roller>

The experimental result on power consumption of the fixing roller will be described. For the fixing roller, two types of test pieces S11 having spectral emissivity of 0.15 and 0.65 were used, and for comparison, test pieces R11 were used.

For the experimental method, the fixing roller is first held at both ends by means of metallic jigs to maintain in space free from any contact with other objects. A heating halogen heater arranged within the fixing roller is energized and heated through a temperature control circuit. The surface temperature is detected by a temperature detection sensor, and the heater energizing time is controlled to maintain a predetermined temperature. Thus, the electric energy consumed for a specified period of time to keep the surface temperature of the fixing roller constant as described above is measured by the use of a watt-hour meter.

Figure 9:
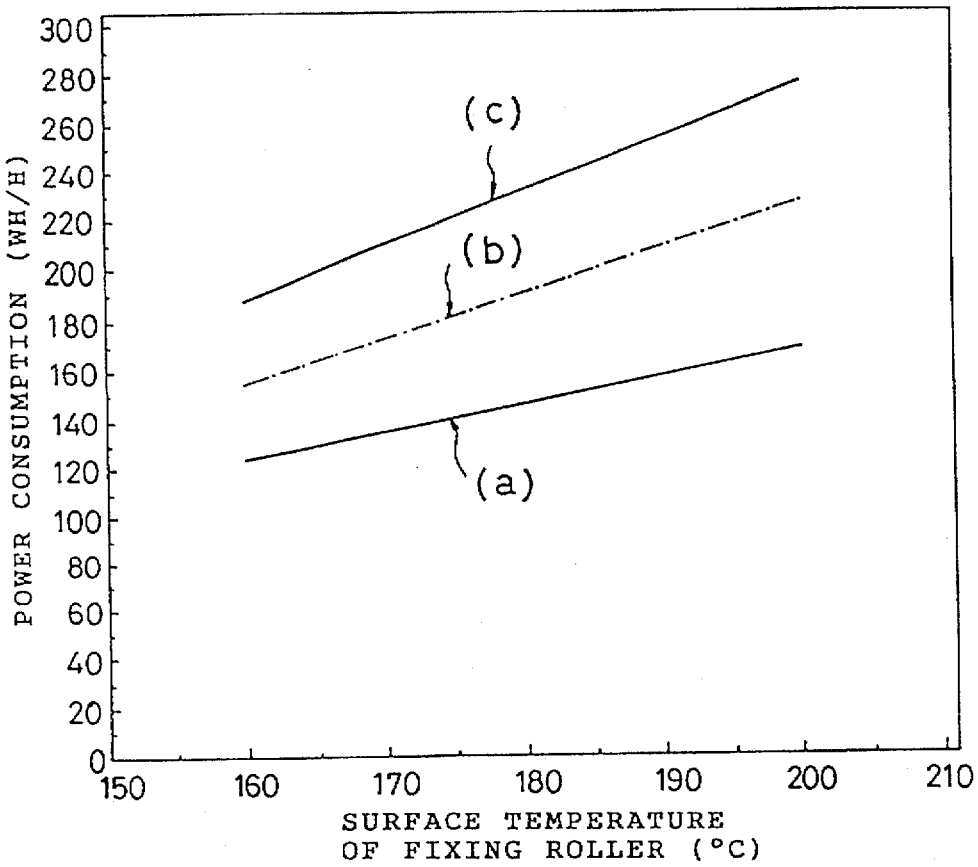
FIG. 9 is a view showing the experimental result on relation between fixing roller temperature and power consumption.

FIG. 9 is a view showing the measured result for the surface temperature of the fixing roller according to the present invention and electric power consumed for a specified period of time. In FIG. 9, line (a) indicates the property of the fixing roller (spectral emissivity: 0.15) according to the present invention; line (b), (spectral emissivity: 0.65); and line (c), the property of the conventional fixing roller. As will be apparent from FIG. 9, the fixing roller according to the present invention has about 30% lower power consumption than the conventional one. This is because the spectral emissivity for the entire surface of the fixing roller becomes lower than the conventional one, and the thermal energy radiated as radiant heat becomes less since there has been used a composite material in the release layer of the fixing roller, in which nickel, which is low spectral emissivity substance, is allowed to exist together with PTFE, which is high spectral emissivity substance.

As the surface temperature of the fixing roller increases, the power consumption increases, but the increase in the power consumption tends to decrease with lower spectral emissivity. It can be seen that the fixing roller with lower spectral emissivity requires less power consumption even at high surface temperatures.

In the conventional copying machine or the like, in order to save the power consumed by the fixing roller while no copying operation is performed, the temperature has been controlled so that the surface temperature of the fixing roller while no copying operation is performed becomes lower (for example, 10° C. lower) than the temperature during copying operation. In this method, however, waiting time of several tens of seconds is required at the start of copying operation in order to increase the surface temperature of the fixing roller to a regular fixing temperature.

According to the fixing roller having a release layer of the present invention, since less power consumption is required as described above, even if the temperature is not controlled so that the surface temperature of the fixing roller while no copying operation is performed becomes lower than the temperature during copying operation, it is possible to save electric energy that corresponds with the saved electric energy obtained by the temperature control, and further to obtain the saving effect more than the consumed energy.

In addition, as an experiment relating to this experiment, in order to find the influence due to difference in the film thickness of the release layer, and difference in surface roughness of the release layer 23, test pieces S11 in which the film thickness of the release layer varies within a range of 1 to 100 μm, and test pieces S12 in which the surface roughness Rz of the release layer varies within a range of 0.1 to 100 μm were used to measure the electric energy consumed. However, it has revealed that neither the difference in the film thickness of the release layer nor the difference in the surface roughness affect the electric energy consumed.

<Experiment 2. Power Consumption to maintain the Surface Temperature of Fixing Roller at a Predetermined Temperature>

The experimental result for power consumption to maintain the surface temperature of the fixing roller at a predetermined temperature will be described. For the fixing roller, test pieces S11 were used, and for comparison, test pieces R11 were used.

Figure 10:
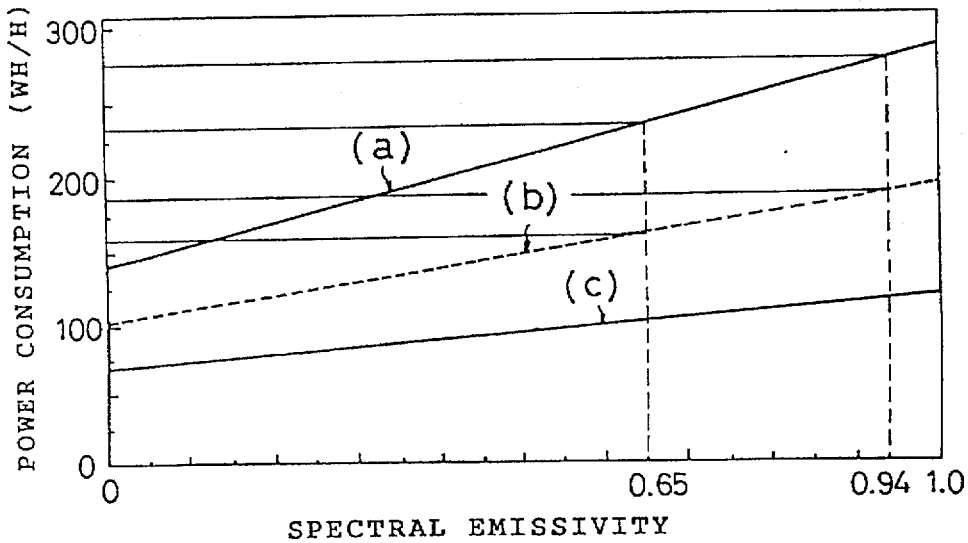
FIG. 10 is a view showing the experimental result on relation between spectral emissivity of release layer and power consumption.

FIG. 10 shows the measured result for power consumption required to maintain the surface temperature of the fixing roller at a predetermined temperature in the fixing roller according to the present invention when the spectral emissivity of the release layer 22 in a wave range of a wavelength of 5 to 10 μm is varied within a range of 0.0 to 1.0. In this figure, line (a) indicates a case where the surface temperature is maintained at 200° C.; line (b), a case where the surface temperature is maintained at 160° C.; and line (c), a case where the surface temperature is maintained at 120° C.

As shown in FIG. 10, as the spectral emissivity becomes higher, the power consumption increases in each of the cases where the surface temperature of the fixing roller is 120° C., 160° C. and 200° C.

In FIG. 10, the spectral emissivity of 0.94 indicates the conventional fixing roller, and in the fixing roller whose release layer is coated with fluorine resin, the spectral emissivity of the release layer in a wave range of a wavelength of 5 to 10 μm is 0.9 or more.

In FIG. 10, the region of the spectral emissivity of 0.65 or less indicates the fixing roller having a release layer according to the present invention. As is apparent from FIG. 10, in each of the cases where the surface temperature of the fixing roller is 120° C., 160° C. and 200° C., if the the surface temperature of the fixing roller is the same, the fixing roller having a release layer according to the present invention has 10% or more less power consumption than the conventional one.

According to the fixing roller having a release layer of the present invention, since less power consumption is required as described above, even if the temperature is not controlled so that the surface temperature of the fixing roller while no copying operation is performed becomes lower than the temperature during copying operation, it is possible to save electric energy that corresponds with the saved electric energy obtained by the temperature control, and further to obtain the saving effect more than the consumed energy.

Figure 11:
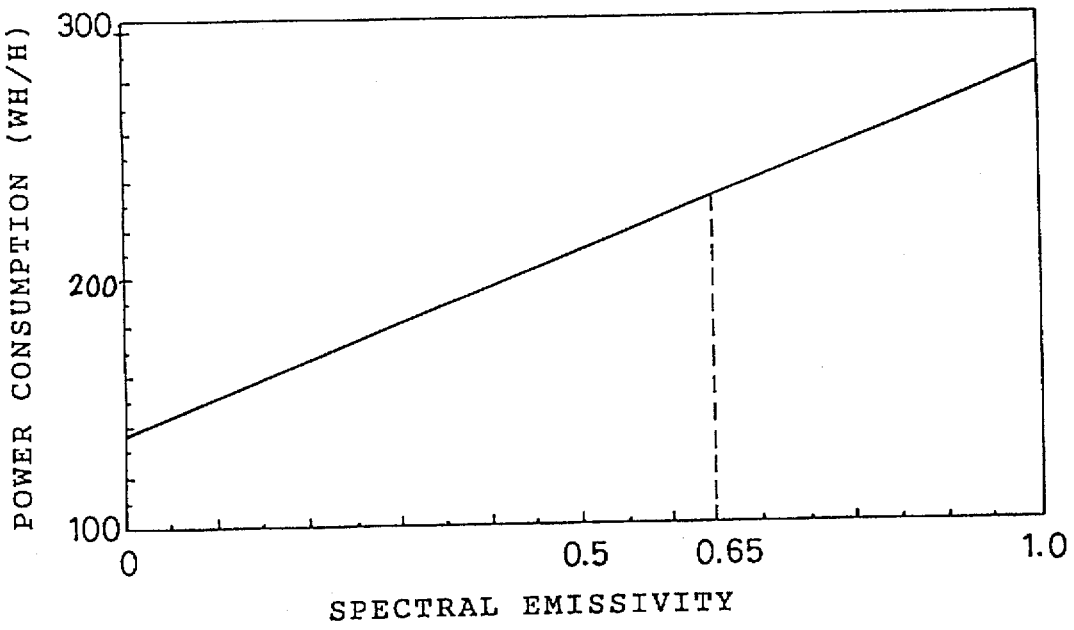
FIG. 11 is a view showing another experimental result on relation between spectral emissivity of release layer and power consumption.

FIG. 11 shows the result obtained by investigating the relation between the spectral emissivity of the release layer and the power consumption relating to the aforesaid experiment. When the spectral emissivity in a wave range of a wavelength of 5 to 10 μm is within a range smaller than 0.65, there was confirmed the electric energy reducing effect that corresponds to the power consumption saved in a general standby mode in which the surface temperature of the conventional fixing roller is reduced by 10°.

<Experiment 3. Fixing Performance of Fixing Roller>

The experimental result of fixing performance of the fixing roller will be described. For the fixing roller, a test piece S11, whose release layer has 40 μm in film thickness, is used, and for comparison, a test piece R11, whose release layer has 40 μm in film thickness, is used.

For the experimental method, a recording sheet on which a non-fixed toner image has been formed using the standard toner for use by the present applicant, is first allowed to pass through between a pair of rollers consisting of the fixing roller and the compression elastic roller for fixing.

Next, the reflection density of the toner image thus fixed is measured by means of a reflection density measuring instrument (Model RD-918, manufactured by Macbeth), two types of toner images: 0.8 and 1.4 in image reflection density are selected, the reflection density of the toner images is measured again after the surfaces of those toner images are rubbed by causing a sand eraser (No.502, manufactured by The Lion Co., Ltd.) added with a load of 1 kg to reciprocate three times, and a ratio thereof to the previous reflection density is determined to define it as a fixing strength ratio. The closer is the fixing strength ratio to 1, it can be judged that the fixing performance is better.

Figure 12:
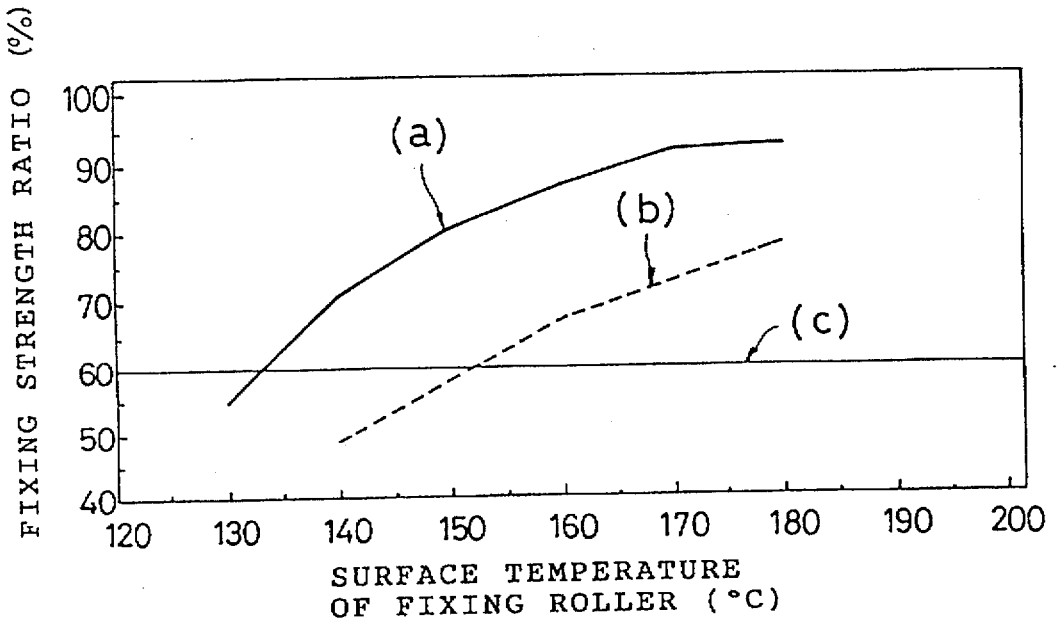
FIG. 12 is a view showing an experimental result on relation between fixing roller temperature and fixing strength.
Figure 13:
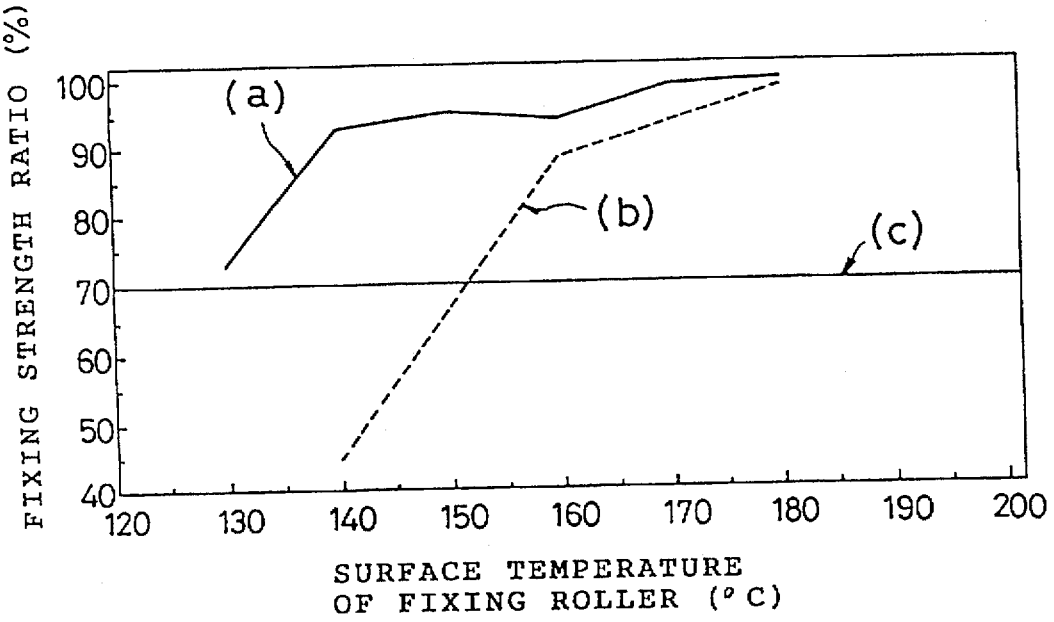
FIG. 13 is a view showing another experimental result on relation between fixing roller temperature and fixing strength.

FIGS. 12 and 13 show the experimental result of fixing performance of the fixing roller: line (a) indicates the property of the fixing roller according to the present invention; and line (b), the property of the conventional fixing roller respectively. FIG. 12 shows for the toner image having image reflection density of 0.8, and FIG. 13 shows for the toner image having image reflection density of 1.4, the results obtained by measuring the fixing strength ratios at each temperature by varying the surface temperature of the fixing roller respectively every 10° C. between 130° C. and 180° C.

The applicant has, from his own knowledge obtained from the conventional experiments, confirmed that if the fixing strength ratio is 0.6 or more when the toner image reflection density before rubbing with a sand eraser is 0.8, and the fixing strength ratio is 0.7 or more when the toner image reflection density before rubbing with a sand eraser is 1.4, the toner image can be sufficiently strongly fixed on the recording sheet, and there is no trouble in the use of the recording sheet. In this respect, in FIGS. 12 and 13, line (c) indicates the threshold value for the fixing strength.

Also, it has been confirmed that in case the circumferential speed (that is, the linear speed at which the recording sheet passes through between the fixing roller and the compression roller) is 350 mm/sec, if the fixing strength ratio is 0.6 or more when the toner image reflection density before rubbing with a sand eraser is 0.8, and the fixing strength ratio is 0.7 or more when the toner image reflection density before rubbing with a sand eraser is 1.4, it is possible to obtain such a fixing strength that there is no trouble in the use of the recording sheet.

As is apparent from FIGS. 12 and 13, the fixing roller according to the present invention has a higher fixing strength ratio than the conventional one when the fixing process is performed at the same surface temperature as the conventional fixing roller. Also, these figures show that in order to obtain the same fixing strength ratio, the fixing roller according to the present invention is capable of fixing at surface temperatures about 20° C. lower than the conventional fixing roller.

<Experiment 4. Relation between Surface Exposure Ratio and Spectral Emissivity of Metal in Mold Release Layer>

The description will be made of the experimental result on relation between surface exposure ratio and spectral emissivity of metal in release layer of the fixing roller. For the fixing roller used for this measurement, a test piece S11 is used, its release layer is formed of composite material consisting of a mixture of PTFE and aluminum, the film thickness of its release layer being 40 μm. Also, for comparison, a test piece R11 is used, its release layer is formed of composite material consisting of a mixture of PTFE and aluminum, the film thickness of its release layer being 40 μm.

Figure 14:
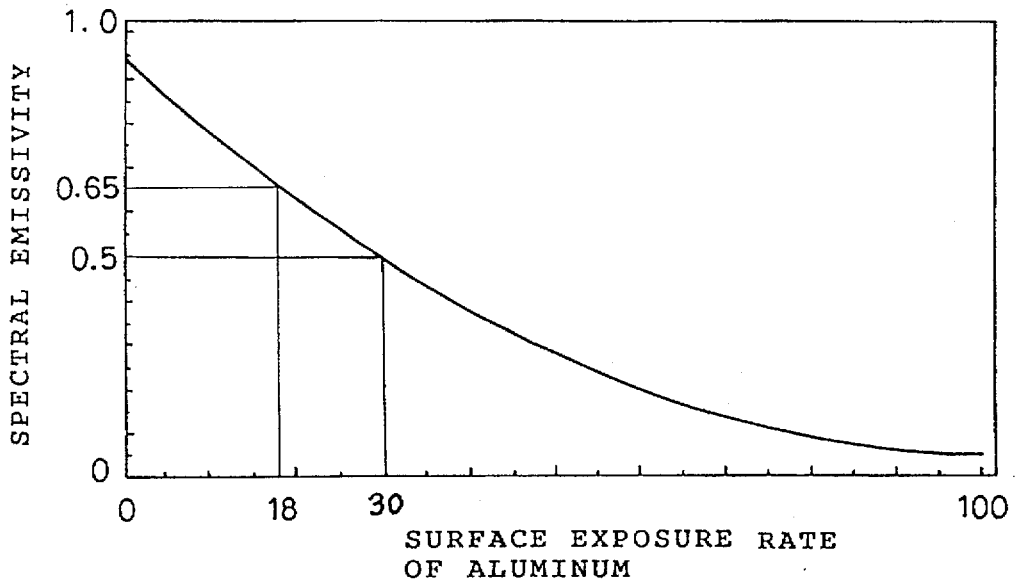
FIG. 14 is a view showing an experimental result on relation between a surface exposure ratio of the metal contained in a release layer and spectral emissivity.

FIG. 14 shows the relation between surface exposure ratio and spectral emissivity of metal in the release layer of the fixing roller, and the surface exposure ratio of aluminum in the surface area of the fixing roller versus the spectral emissivity of the release layer in a wave range of a wavelength of 5 to 10 μm.

Since the spectral emissivity of the fixing roller according to the present invention is 0.65 or less, it can be seen that it will suffice only if the exposure ratio of aluminum in the surface area of the fixing roller is made to be about 18% or more.

Figure 15:
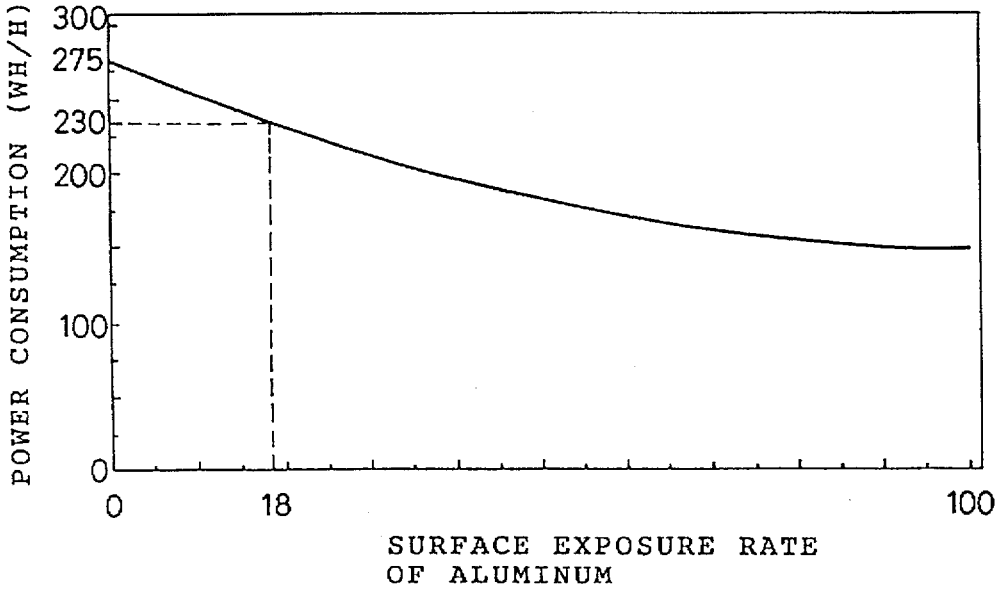
FIG. 15 is a view showing an experimental result on relation between a surface exposure ratio of the metal contained in a release layer and power consumption.

FIG. 15 shows the relation between the surface exposure rate of metal in the release layer of the fixing roller and the power consumption, showing, when the release layer is formed by composite material consisting of a mixture of PTFE and aluminum, the relation between the surface exposure rate of aluminum in the surface area of the fixing roller, and the power consumption required to maintain the surface temperature of the fixing roller to 200° C.

As is apparent from this figure, if the exposure rate of aluminum in the surface area of the fixing roller is made to be about 18% or more, it is possible to reduce the power consumption of a heating heater 10% or more, from 275 watt to 230 watt in comparison with the conventional fixing roller, whose release layer is constituted only by PTFE, with no aluminum exposed on the surface thereof (surface exposure rate of 0%).

In the above-described example, the description has been made of the case in which the release layer is formed by composite material consisting of a mixture of PTFE and aluminum, but it has become apparent that even if a composite material obtained by mixing metal such as nickel, chrome, iron, titanium and zinc in addition to aluminum is used, and even if there may be somewhat differences in the spectral emissivity of the release layer in a wave range of wavelength of 5 to 10 μm, there is provided the effect that the power consumption can be reduced by reducing the spectral emissivity to 0.65 or less. Further, it has also become apparent that even if PFA, silicone rubber or the like is used in place of PTFE, it functions in the same way as PTFE, and has a similar effect.

Figure 16:
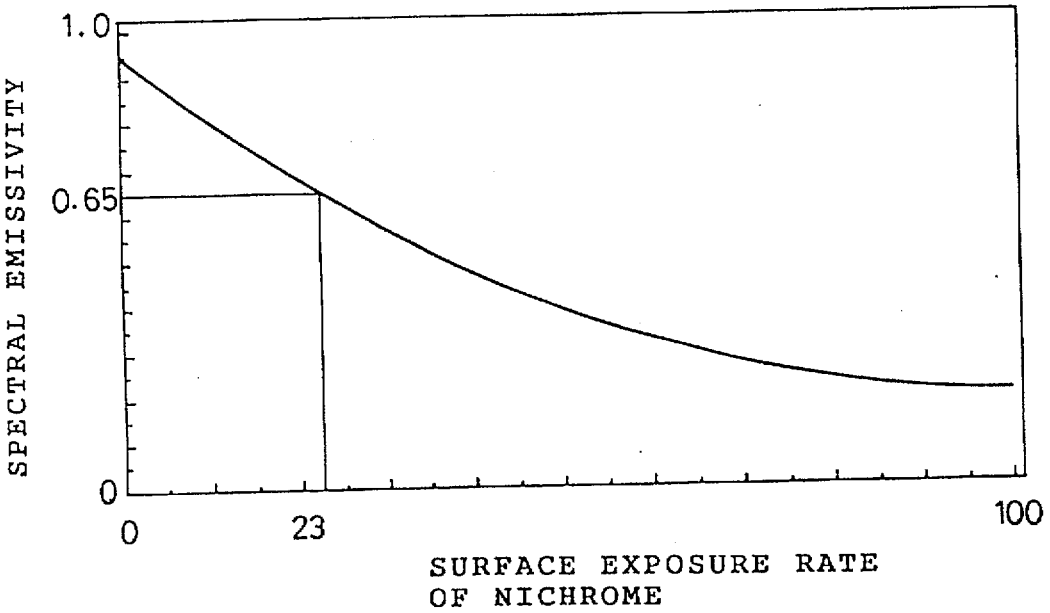
FIG. 16 is a view showing an experimental result on relation between a surface exposure ratio of the metallic alloy contained in a release layer and spectral emissivity.

FIG. 16 shows the relation between the surface exposure rate of metal alloy in the release layer of the fixing roller and the spectral emissivity, showing, when the release layer is formed by a composite material consisting of a mixture of PTFE and nichrome (alloy of nickel and chrome), the surface exposure rate of nichrome in the surface area of the fixing roller versus the spectral emissivity of the release layer in a wave range of wavelength of 5 to 10 μm.

Since the spectral emissivity of the fixing roller according to the present invention is 0.65 or less, it will suffice only if the exposure ratio of nichrome in the surface area of the fixing roller is made to be about 23% or more.

Figure 17:
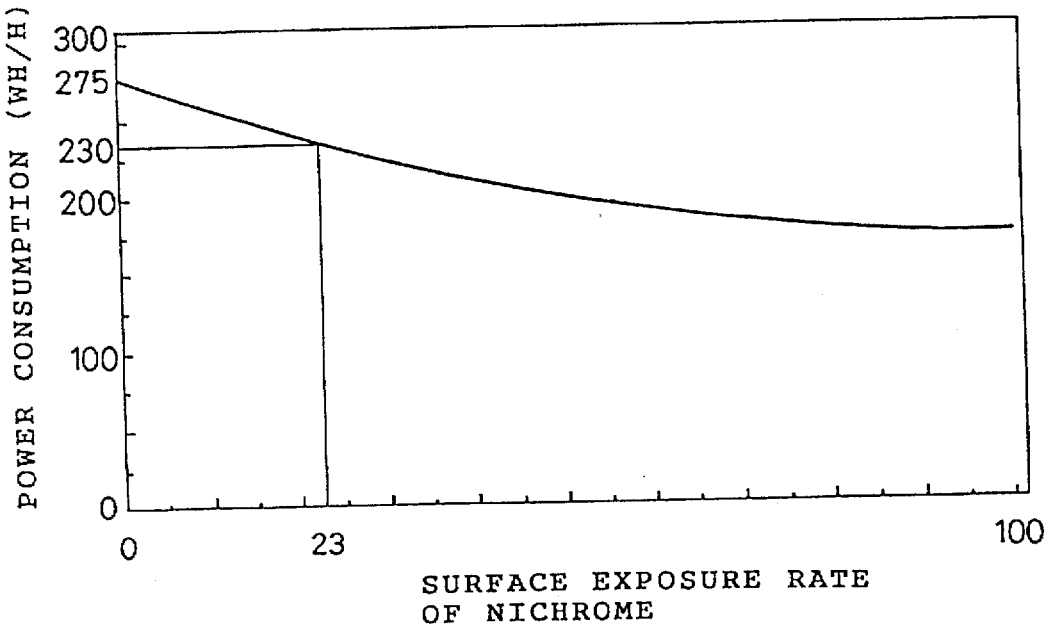
FIG. 17 is a view showing an experimental result on relation between a surface exposure ratio of the metallic alloy contained in a release layer and power consumption.

FIG. 17 also shows the relation between the surface exposure rate of metal alloy in the release layer of the fixing roller and the power consumption, showing, when the release layer is formed by a composite material consisting of a mixture of PTFE and nichrome, the relation between the surface exposure rate of nichrome in the surface area of the fixing roller, and the power consumption required to maintain the surface temperature of the fixing roller to 200° C.

As is apparent from this figure, if the exposure rate of nichrome in the surface area of the fixing roller is made to be about 23% or more, it is possible to reduce the power consumption of a heating heater 10% or more, from 275 watt to 230 watt in comparison with the conventional fixing roller, whose release layer is constituted by PTFE alone, with no nichrome exposed on the surface thereof (surface exposure rate of 0%).

In the above-described example, the description has been made of the case in which the release layer is formed by a composite material consisting of a mixture of PTFE and nichrome, but it has become apparent that since even a composite material obtained by mixing metal alloy such as monel metal, Inconel, chromel-alumel, brass, and constantan-manganin in addition to nichrome has somewhat differences in the spectral emissivity of the release layer in a wave range of wavelength of 5 to 10 μm, even if there may be somewhat differences in the rate of exposing the respective metal alloy on the surface, there is provided the effect that the power consumption can be reduced by reducing the spectral emissivity to 0.65 or less. Further, it has also become apparent that even if PFA, silicone rubber or the like is used in place of PTFE, it functions in the same way as PTFE, and has a similar effect.

<Experiment 5. Relation between Spectral Emissivity and Offset Phenomenon>

An offset phenomenon is a phenomenon that non-fixed toner on a recording sheet adheres to the surface of a fixing roller, and when the fixing roller makes a turn, the toner adhering to the fixing roller further transfers and adheres to the recording sheet. Since such an offset phenomenon noticeably impairs the image quality, it is necessary to determine such surface temperature range for the fixing roller as to prevent the offset phenomenon from occurring, and the component configuration of the release layer.

For the fixing roller used for this experiment, a test piece S11 is used, and the film thickness of its release layer is 40 μm. Also, for comparison, a test piece R11 is used, and the film thickness of its release layer is 40 μm.

The compression elastic roller is also formed as follows. That is, an elastic layer formed of 6 mm thick silicone rubber and a release layer formed of 70 μm thick fluorine resin tube are stacked on a core metal formed of an aluminum hollow cylinder as described previously, and a bonding layer is provided between the core metal and the elastic layer, and between the elastic layer and the release layer respectively.

For the experimental method, the surface temperature of the fixing roller is maintained to a predetermined temperature, the fixing roller and the compression elastic roller are placed in close contact with each other, and the circumferential speed (that is, linear speed at which the recording sheet passes through between a pair of fixing rollers) is set to 350 mm/sec.

A recording sheet (in this experiment, basis weight of 64 g/m$^2$) on which a non-fixed toner image has been formed using the standard toner for use by the present applicant, is allowed to pass through between the pair of rollers consisting of the fixing roller and the compression elastic roller for fixing to examine whether or not any offset phenomenon has occurred.

Figure 18:
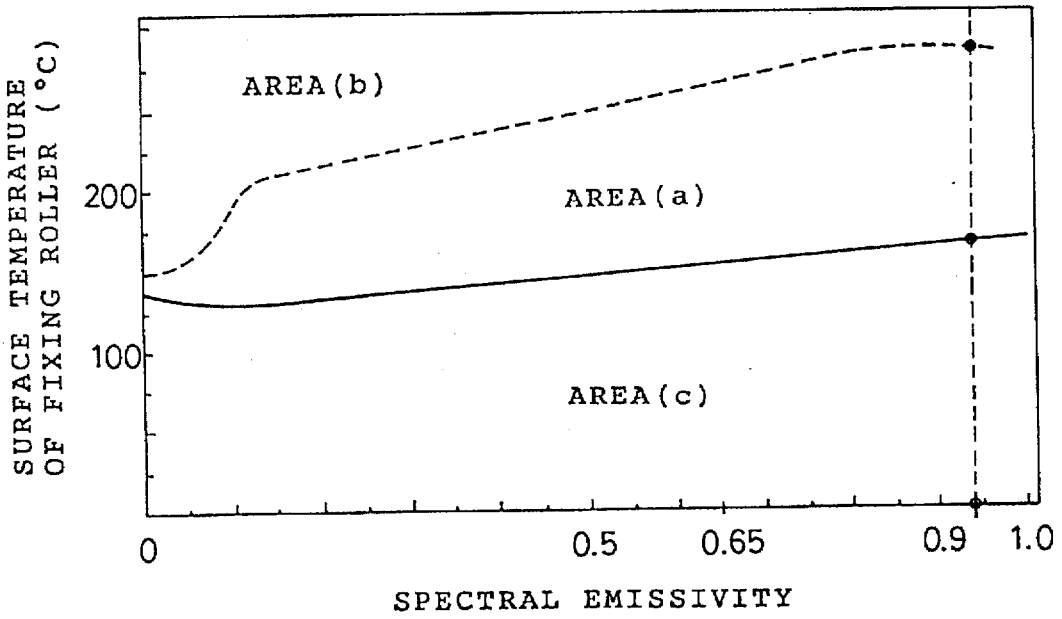
FIG. 18 is a view showing an experimental result on relation between spectral emissivity of a release layer and fixing roller temperature, and non-offset temperature area.

FIG. 18 shows the relation between the spectral emissivity of the release layer, the surface temperature of the fixing roller and a non-offset area in the fixing roller according to the present invention. When the spectral emissivity of the release layer in a wave range of wavelength of 5 to 10 μm is within a range of 0.1 to 0.65, area (a) indicates an area where the surface temperature for the fixing roller has a sufficient temperature range and no offset occurs (non-offset area); area (b), a high-temperature offset area where the surface temperature of the fixing roller is excessively high to cause offset; and area (c), a low-temperature offset area where the surface temperature thereof is excessively low to cause offset. Also, the spectral emissivity of 0.9 indicates the spectral emissivity of the conventional fixing roller.

As is apparent from FIG. 18, in a fixing roller according to the present invention, the surface temperature range of the fixing roller in which no offset occurs, shifts to the low temperature side as compared with the conventional one. This is because nickel, which is a high thermal conductive material, is caused to exist together with PTFE, which is a low thermal conductive material, whereby the thermal conductivity of the fixing roller on the entire surface becomes higher than that of the conventional fixing roller, thus resulting in faster speed of travel of heat from the surface of the fixing roller to the recording sheet, and increased thermal movement.

As described above, the surface temperature range of the fixing roller in which no offset occurs, shifts to the low temperature side as compared with the conventional one. This means that it becomes possible to maintain the operating temperature of the fixing roller lower than that of the conventional device, and to save the power consumption.

In order to enlarge the surface temperature range (non-offset area) of the fixing roller in which no offset occurs, it is apparent from FIG. 18 that it will suffice if only the volume ratio of PTFE to be contained in the release layer of the fixing roller is increased to make the spectral emissivity higher.

<Experiment 6. Relation between Film Thickness of Release Layer and Offset Phenomenon>

The description will be made of the experimental result on the relation between the film thickness of a release layer, the surface temperature of a fixing roller and a non-offset area in the fixing roller according to the present invention. For the fixing roller used for this experiment, test pieces S11 whose release layer varies in film thickness within a range of 5 to 70 μm were used. Also, for comparison, test pieces R11 whose release layer varies in film thickness within a range of 5 to 70 μm were used.

The compression elastic roller is formed as follows. That is, an elastic layer formed of 6 mm thick silicone rubber and a release layer formed of 70 μm thick fluorine resin tube are stacked on a core metal formed of a hollow cylinder as described previously, and a bonding layer is respectively provided between the core metal and the elastic layer, and between the elastic layer and the release layer respectively.

For the experimental method, the surface temperature of the fixing roller is maintained to a predetermined temperature, the fixing roller and the compression elastic roller are placed in close contact with each other, and the circumferential speed (that is, linear speed at which the recording sheet passes through between a pair of fixing rollers) of the fixing roller is set to 350 mm/sec.

A recording sheet (in this experiment, basis weight of 64 g/m$^2$) on which a non-fixed toner image has been formed using the standard toner for use by the present applicant, is allowed to pass through between the pair of rollers consisting of the fixing roller and the compression elastic roller for fixing to examine whether or not any offset phenomenon has occurred.

Figure 19:
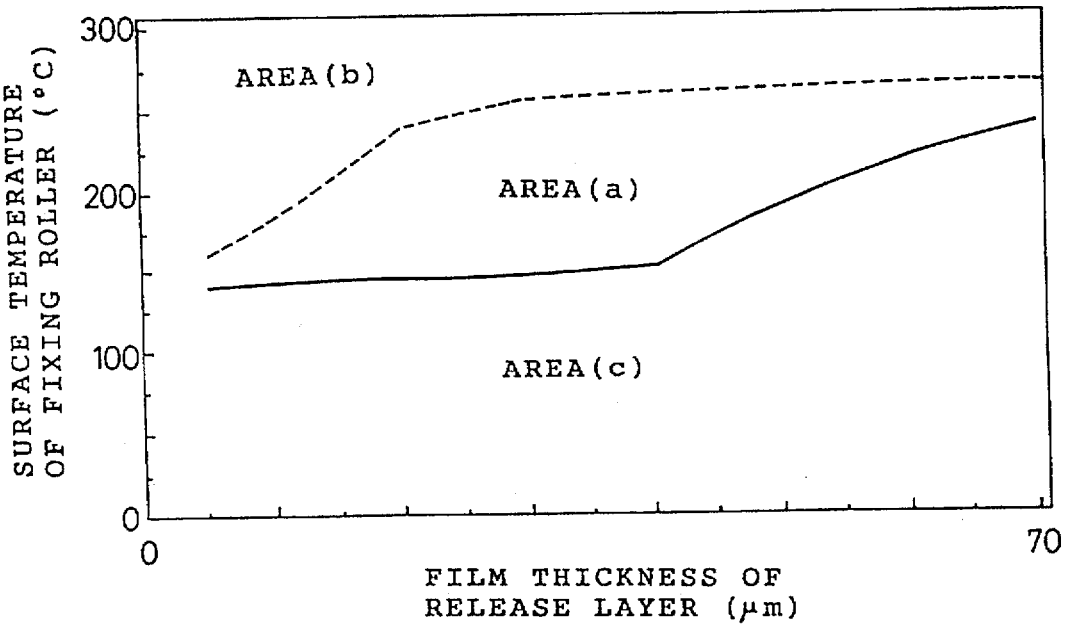
FIG. 19 is a view showing an experimental result on relation between film thickness of a release layer of a conventional fixing roller and fixing roller temperature, and non-offset temperature area.

FIG. 19 shows the relation between the film thickness of the release layer, the surface temperature of the fixing roller and the non-offset area in the conventional fixing roller. In FIG. 19, area (a) indicates a non-offset temperature area; area (b), a high-temperature offset area; and area (c), a low-temperature offset area. As is apparent from this figure, in the conventional fixing roller, the non-offset area fluctuates according to change in the film thickness of the release layer, and the surface temperature range of the fixing roller in the non-offset area becomes narrower in particular on the thin film thickness side which is advantageous in respects of securing the fixing strength, saving the power consumption and the like, thus being no longer of practical use.

Figure 20:
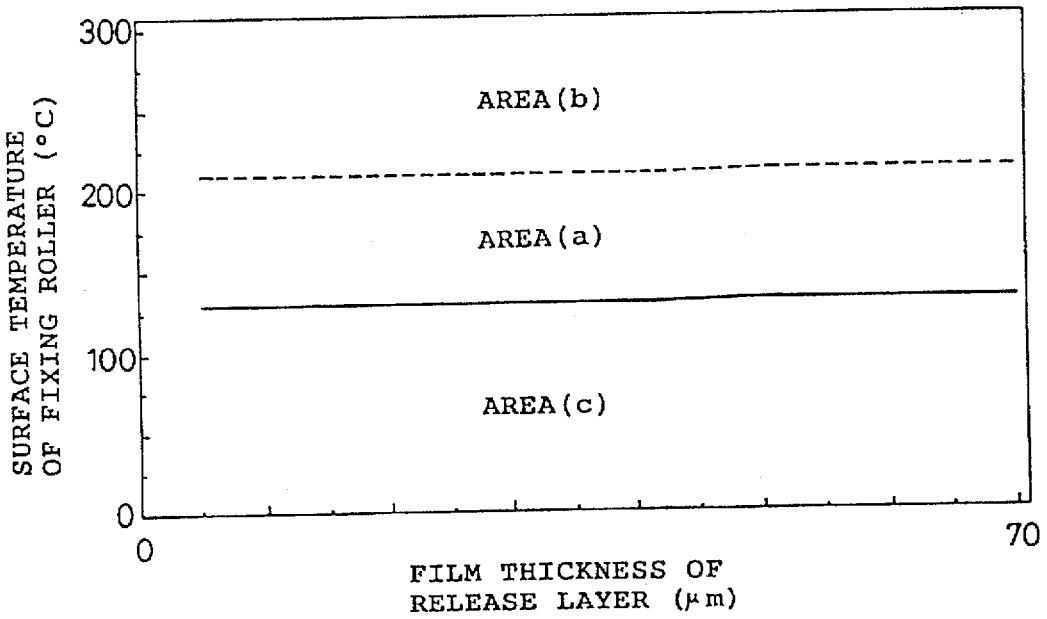
FIG. 20 is a view showing an experimental result on relation between film thickness of a release layer of a fixing roller according to the present invention and fixing roller temperature, and non-offset temperature area.

FIG. 20 shows the relation between the film thickness of the release layer, the surface temperature of the fixing roller and the non-offset area in the fixing roller according to the present invention. In FIG. 20, area (a) indicates a non-offset temperature area; area (b), a high-temperature offset area; and area (c), a low-temperature offset area. As is apparent from this figure, in the fixing roller according to the present invention, the non-offset area hardly fluctuates according to change in the film thickness of the release layer. For this reason, it is possible to set the film thickness arbitrarily, but in consideration of the productivity and the durability of the fixing roller, the practical range for film thickness is a range of 1 to 80 μm, and a range of 5 to 50 μm becomes the optimum range. In this respect, the spectral emissivity of the release layer is 0.65.

<Experiment 7. Relation between Heat Emissivity and Thermal Conductivity>

The description will be made of the experimental result on the relation between the heat emissivity from the surface of the fixing roller and the thermal conductivity of the roller. For the fixing roller used for this experiment, test pieces S11 having the film thickness of release layer of 40 μm were used. Also, for the conventional fixing roller for comparison, the aforesaid test pieces R11 having the film thickness of release layer of 40 μm were used.

Figure 21:
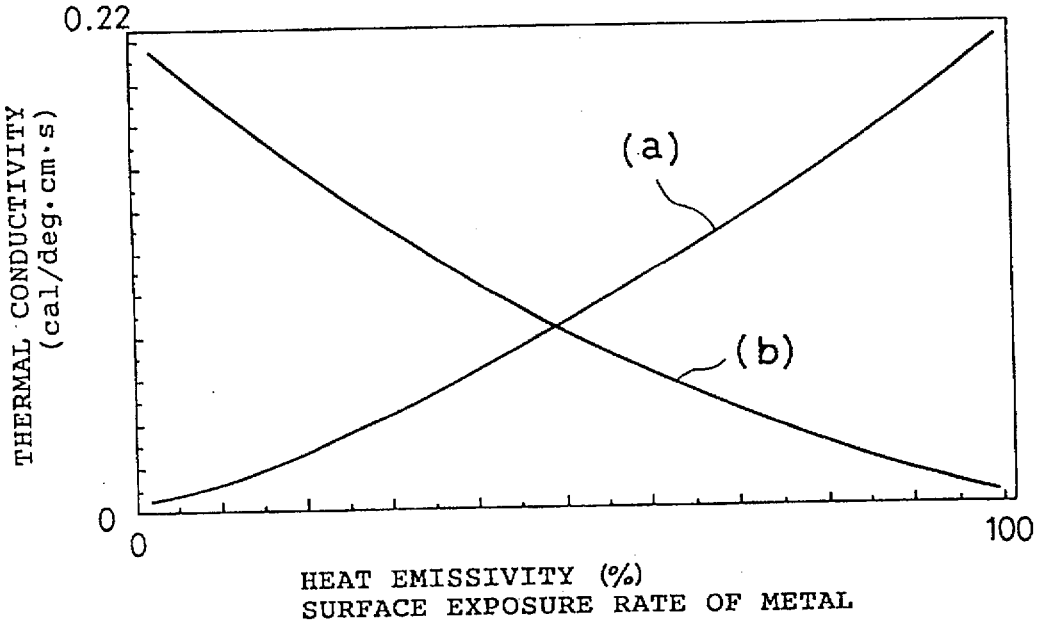
FIG. 21 is a view showing an experimental result on relation between heat emissivity and heat transfer coefficient on the surface of a fixing elastic roller.

FIG. 21 shows the relation between heat emissivity from the surface of the fixing roller and thermal conductivity, and the relation between surface exposure rate of metal and thermal conductivity: line (a) indicate the relation between the surface exposure rate of metal and the thermal conductivity; and line (b) indicates the relation between heat emissivity and the thermal conductivity. As is apparent from FIG. 21, there is correlation between the heat emissivity from the surface of the fixing roller, the surface exposure rate of metal and the thermal conductivity of the fixing roller, and the higher the thermal conductivity is, the lower the heat emissivity is, and the higher the surface exposure rate of metal is, the higher the heat conductivity is.

Also, it has become apparent in the relation between heat emissivity and thermal conductivity that even if the type of metallic elements or metallic alloy constituting a release layer differs, there will not be caused any marked difference though there may be some variations in value.

Next, the description will be made of the property experiment results for the fixing elastic roller, the fixing elastic belt and the self-heat release type fixing elastic roller (hereinafter, collectively referred to as fixing elastic roller) in the second to fifth embodiments. The following experimental result is for the fixing elastic roller in the second embodiment, but the experimental results for the third to fifth embodiments will also be partly described.

The fixing elastic roller used for the experiment will be described. The fixing elastic roller has the structure of the second embodiment shown in FIG. 5, and for the core metal, an aluminum hollow cylinder 60 mm in diameter, 8 mm in thickness and 320 mm in axial length is used.

Test pieces S21 are a plurality of roller groups in which the film thickness of the release layer 64 varies within a range of 1 to 100 μm, test pieces S22 are a plurality of roller groups in which the surface roughness Rz of the release layer 64 varies within a range of 0.1 to 100 μm, and test pieces S23 are a plurality of roller groups in which the spectral emissivity of the release layer differs within a range of 0.1 to 0.65 in a radiation wavelength of 5 μm to 10 μm. Other physical properties of the release layer were described in the description of the respective experimental results. Also, the compression elastic roller, which is made a pair with the fixing elastic roller according to the present invention for use, is the same as the one used for the experiment of the first embodiment.

In the conventional fixing elastic roller indicated for comparison, the core metal dimensions are identical to the aforesaid test piece in the one of the second embodiment shown in FIG. 5, and the release layer is formed by a composite material consisting of PTFE and PFA. Test pieces R21 for comparison are a plurality of roller groups in which the film thickness of the release layer 64 varies within a range of 1 to 100 μm, and test pieces R22 are a plurality of roller groups in which the surface roughness Rz of the release layer 64 varies within a range of 0.1 to 100 μm.

The experimental method is the same as the one for the first embodiment.

<Experiment 8. Power Consumption for Fixing Elastic Roller>

The power consumption for the fixing elastic roller was measured using test pieces S21 having spectral emissivity of release layer of 0.15 and 0.65. For comparison, test pieces R21 were used.

For the experimental result, the same result as in the first embodiment was obtained. For the detail thereof, refer to the experimental result for the first embodiment described previously with reference to FIG. 9.

To describe the experimental result briefly, in order to maintain the same surface temperature, about 30% less heater power consumption is required as compared with the conventional fixing elastic roller.

<Experiment 9. Power Consumption to Maintain Surface Temperature of Fixing Elastic Roller to Predetermined Temperature>

When the spectral emissivity of the release layer is varied within a range of 0.0 to 1.0, power consumption required to maintain the surface temperature of the fixing elastic roller to 120° C., 160° C. and 200° C. was measured. For the test pieces, S21 was used, and for comparison, test pieces R21 were used.

For the experimental result, the same result as in the first embodiment was obtained. For the detail thereof, refer to the experimental result for the first embodiment described previously with reference to FIG. 10.

To describe the experimental result briefly, when the surface temperature of the fixing elastic roller is the same, since it is possible to save the power consumption by about 10% or more as compared with the conventional one, even if the temperature is not controlled so that the surface temperature of the fixing roller while no copying operation is performed becomes lower than the temperature during copying operation, the electric power that corresponds with the electric power saved by the temperature control, or more could be saved.

<Experiment 10. Influence of Surface Emissivity on Power Consumption>

As an experiment relating to the Experiment 9, the influence of the surface emissivity of a fixing elastic roller on the power consumption was investigated.

For the experimental result, the same result as in the first embodiment was obtained. For the detail thereof, refer to the experimental result for the first embodiment described previously with reference to FIG. 11.

To describe the experimental result briefly, the effect of reducing the power consumption due to a difference in surface emissivity was seen, and when the spectral emissivity of the release layer in a wave range of wavelength of 5 to 10 μm is within a range lower than 0.65, there was confirmed the effect of reducing the power consumption which corresponds to the saved power consumption in a general standby mode in which the surface temperature of the conventional fixing roller can be lowered by 10° C.

In this experiment, in not only the fixing elastic roller, but also the fixing elastic roller (third embodiment) having a plurality of elastic layers, and the fixing elastic belt (fourth embodiment), the similar effect of reduced power consumption was confirmed though there might be some differences in the effect. Also, in the self-heat release type fixing elastic roller (fifth embodiment), when the roller surface is heated to a predetermined temperature and held, the reduction effect, due to low emissivity of the release layer, of electric power to be consumed by the heating resistor was confirmed.

As regards the Experiments 1 to 3 concerning power consumption described above, no difference in power consumption due to different film thickness of the release layer of the fixing elastic roller, nor difference in power consumption due to different surface roughness thereof was seen. In addition to the fixing elastic roller, in the fixing elastic roller (third embodiment) having a plurality of elastic layers, the fixing elastic belt (fourth embodiment), and the self-heat release type fixing elastic roller (fifth embodiment), no marked differences were seen.

<Experiment 11. Fixing Performance of Fixing Elastic Roller>

An experiment for the fixing performance of the fixing elastic roller was performed. In the experiment, a recording sheet on which a non-fixed toner image has been formed using the standard toner for use by the present applicant, was allowed to pass through between a pair of rollers consisting of a fixing elastic roller and a compression elastic roller according to the present invention for fixing processing. For the test pieces, S21 having thickness of the release layer of 40 μm were used. For comparison, test pieces R21 having thickness of the release layer of 40 μm were used.

Next, the reflection density of the toner image thus fixed is measured by means of a reflection density measuring instrument (Model RD-918, manufactured by Macbeth Inc.), two types of toner images: 0.8 and 1.4 in image reflection density are selected, the image reflection density is measured again after the surfaces of those toner images are rubbed by causing a sand eraser (No.502, manufactured by The Lion Co., Ltd.) added with a load of 1 kg to reciprocate three times, and a ratio thereof to the previous reflection density is determined to obtain a fixing strength ratio.

For the experimental result, the same result as in the first embodiment was obtained. For the detail thereof, refer to the experimental result for the first embodiment described previously with reference to FIGS. 12 and 13.

To describe the experimental result briefly, it is known that if the fixing strength ratio is 0.6 or more when the image reflection density before rubbing with a sand eraser is 0.8, and the fixing strength ratio is 0.7 or more when the image reflection density before rubbing with a sand eraser is 1.4, it is possible to obtain such a fixing strength that there is no trouble in the use of a recording sheet. As is apparent from FIGS. 12 and 13, a fixing elastic roller according to the present invention can provide more excellent fixing performance than the conventional fixing roller if the fixing elastic roller is at the same temperature. Also, it can be seen that in order to obtain the same fixing strength, this fixing roller is capable of fixing at surface temperatures 20° C. lower than the conventional fixing roller.

<Experiment 12. Relation between Spectral Emissivity and Non-Offset Temperature Area>

There was performed an experiment on the relation between the spectral emissivity of release layer of a fixing elastic roller and a surface temperature area (non-offset temperature area) of the fixing elastic roller in which no offset phenomenon occurs.

The offset phenomenon is a phenomenon that non-fixed toner on a recording sheet adheres to the surface of the fixing elastic roller, and the toner adhering to the surface of the fixing elastic roller further transfers and adheres to the recording sheet.

For the fixing elastic roller used for this experiment, a test piece S23 is used, and for the conventional fixing elastic roller for comparison, a test piece R23 is used.

The compression elastic roller is also formed as follows. That is, an elastic layer formed of 6 mm thick silicone rubber and a release layer formed of 70 μm thick fluorine resin tube are stacked on an aluminum core metal as described previously, and a bonding layer is provided between core metal and elastic layer, and between elastic layer and release layer respectively.

For the experimental method, the fixing elastic roller and the compression elastic roller are placed in close contact with each other, and the circumferential speed is set to 350 mm/sec. A recording sheet (in this experiment, basis weight of 64 g/m$^2$) on which a non-fixed toner image has been formed using the standard toner for use by the present applicant, is allowed to pass through between the pair of rollers consisting of the fixing elastic roller and the compression elastic roller for fixing to examine whether or not any offset phenomenon has occurred.

For the experimental result, the same result as in the first embodiment was obtained. For the detail thereof, refer to the experimental result for the first embodiment described previously with reference to FIG. 18.

To describe the experimental result briefly, when the spectral emissivity of the release layer of the fixing elastic roller is within a range of 0.1 to 0.65 in a wave range of a wavelength of 5 to 10 μm, it can be seen that the fixing elastic roller has a non-offset temperature area (a) having a sufficient temperature range.

The non-offset temperature range (a) shifts to the low temperature side as compared with the conventional fixing elastic roller. This means that it is possible to maintain the operating temperature lower than that of the conventional device, and to save the power consumption. In order to enlarge the non-offset temperature area, it can be seen that it will suffice if only the volume ratio of PTFE contained in the release layer is increased to make the spectral emissivity higher.

<Experiment 13. Relation between Film Thickness of Release Layer and Offset Phenomenon>

There was performed an experiment on the relation between the film thickness of the release layer of the fixing elastic roller and the offset phenomenon. The structure of the fixing elastic roller, the conventional fixing elastic roller for compression and the compression elastic roller which were used for this experiment is the same as that in the aforesaid Experiment 12, and the experimental method is also the same as that in the Experiment 12.

For the experimental result, the same result as in the first embodiment was obtained. For the detail thereof, refer to the experimental result for the first embodiment described previously with reference to FIGS. 19 and 20.

To describe the experimental result briefly, The relation between the film thickness of the release layer, the surface temperature of the fixing elastic roller and the non-offset area in the conventional fixing elastic roller is as shown in FIG. 19. In the conventional fixing elastic roller, the non-offset area fluctuates according to change in the film thickness of the release layer, and the surface temperature range of the fixing roller in the non-offset area becomes narrower in particular on the thin film thickness side which is advantageous in respects of securing the fixing strength, saving the power consumption and the like, thus being no longer of practical use.

In contrast to this, the relation between the film thickness of the release layer, the surface temperature of the fixing elastic roller and the non-offset area in the fixing elastic roller according to the present invention is as shown in FIG. 20. In the fixing elastic roller according to the present invention, the non-offset area hardly fluctuates according to change in the film thickness of the release layer. For this reason, it is possible to set the film thickness arbitrarily, but in consideration of the productivity and the durability of the fixing roller, the practical range for the film thickness is a range of 1 to 80 μm, and a range of 5 to 50 μm becomes the optimum range.

In this experiment, in not only the fixing elastic roller, but also the fixing elastic roller (third embodiment) having a plurality of elastic layers, the fixing elastic belt (fourth embodiment), and the self-heat release type fixing elastic roller (fifth embodiment), the substantially same results were obtained, and no marked differences were seen.

<Experiment 14. Relation between Heat Emissivity and Thermal Conductivity>

There was performed an experiment on the relation between heat emissivity and thermal conductivity. The structure of the fixing elastic roller used for this experiment is the same as that in the aforesaid Experiment 12.

For the experimental result, the same result as in the first embodiment was obtained. For the detail thereof, refer to the experimental result for the first embodiment described previously with reference to FIG. 21.

To describe the experimental result briefly, the relation between heat emissivity from the surface of the roller and thermal conductivity of the roller is as shown in FIG. 21, and there is correlation between the heat emissivity from the surface of the fixing elastic roller, and the thermal conductivity of the fixing roller, and the higher the thermal conductivity is, the lower the heat emissivity is. In other words, it became apparent that the more advantageous the thermal conductivity is, the less the heat losses are.

As is apparent from the result of the Experiment 6, since a sufficient non-offset temperature area can be secured even if the film thickness of the release layer in the fixing elastic roller may be thin, thin film thickness having high thermal conductivity can provide great energy saving effect.

Also, it has become apparent in the relation between heat emissivity and thermal conductivity that even if the type of metallic elements or metallic alloy constituting a release layer differs, there will not be caused any marked difference though there may be some variations in value.

In this experiment, in not only the fixing elastic roller, but also the fixing elastic roller (third embodiment) having a plurality of elastic layers, the fixing elastic belt (fourth embodiment), and the self-heat release type fixing elastic roller (fifth embodiment), the substantially same results were obtained, and no marked differences were seen.

<Experiment 15. Relation between Amount of Exposure of Low Heat Emissive Substance in Release Layer and Spectral Emissivity>

The description will be made of the experimental result on the relation between an amount of exposure of low heat emissive substance in release layer and spectral emissivity of the fixing elastic roller.

Figure 22:
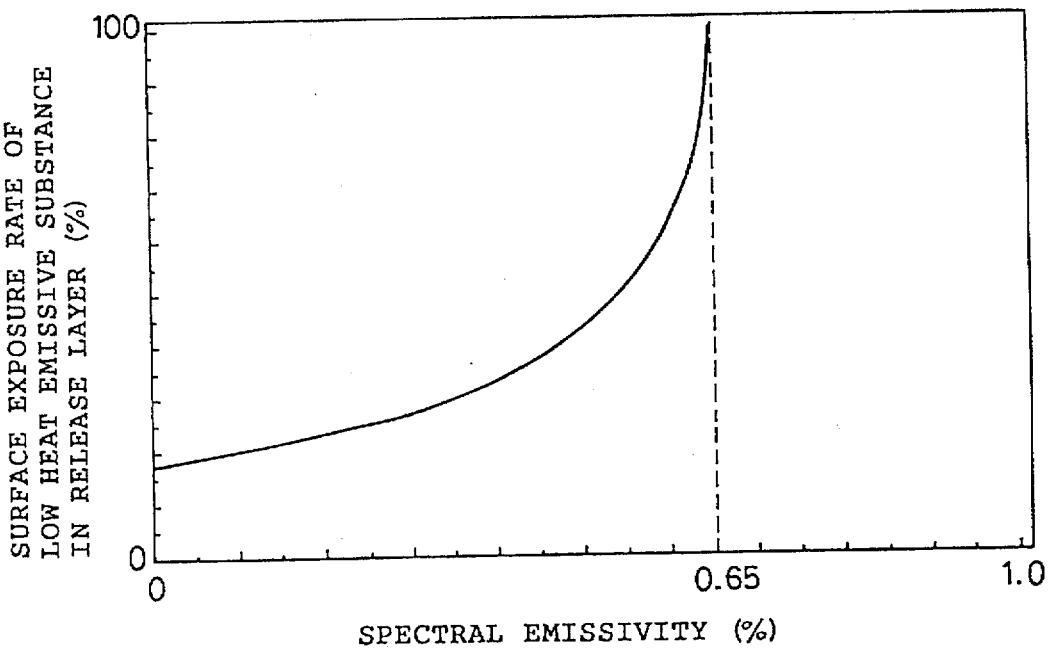
FIG. 22 is a view showing an experimental result on relation between the exposure rate of low heat emissive substance and spectral emissivity of simple low radioactive substance contained in the release layer of a fixing elastic roller.

In case where the release layer in the fixing elastic roller is formed of a composite material consisting of a mixture of PTFE, which is mold release substance, and metal or metallic alloy, which is low heat emissive substance having the spectral emissivity in a wave range of wavelength of 5 to 10 μm of under 0.65, FIG. 22 shows the spectral emissivity (spectral emissivity in a wave range of 5 to 10 μm in wavelength) of simple low heat emissive substance (a metal or metallic alloy) contained in the release layer, and the exposure rate of the low heat emissive substance (metal or metallic alloy) in the surface area of the fixing elastic roller when the spectral emissivity of the release layer in the fixing elastic roller is 0.65.

In consideration of the mold release characteristics (property of toner for easily leaving a roller) on the surface of a fixing elastic roller, more mold release substance (such as PTFE) preferably remains on the surface of the release layer, and for low heat emissive substance (such as metal or metallic alloy), substance which is capable of reducing the heat emissivity with less quantity, that is, a substance having low spectral emissivity in a wave range of wavelength of 5 to 10 μm is preferable. In, for example, metal and metallic oxide, metal is capable of reducing the heat emissivity even if the exposure rate in the surface area of the fixing elastic roller is lower.

Concerning a fixing elastic roller whose release layer is formed by a composite material consisting of a mixture of PTFE and aluminum, in the measuring experiment for spectral emissivity in a wave range of wavelength of 5 to 10 μm, the same result as in the first embodiment was obtained.

For the detail thereof, refer to the experimental result for the first embodiment described previously with reference to FIG. 14. To describe the experimental result briefly, since the spectral emissivity of a fixing elastic roller according to the present invention is 0.65 or less, it can be seen that it will suffice if only the exposure rate of aluminum in the surface area of the fixing elastic roller is set to about 18% or more.

Concerning a fixing elastic roller whose release layer is formed by a composite material consisting of a mixture of PTFE and aluminum, in the relation between the exposure rate of aluminum in the surface area of the fixing elastic roller and the power consumption required to maintain the roller surface temperature to 200° C., the same result as in the first embodiment was obtained.

For the detail thereof, refer to the experimental result for the first embodiment described previously with reference to FIG. 15. To describe the experimental result briefly, if the exposure rate of the aluminum occupying the surface area of a fixing elastic roller according to the present invention is set to about 18% or more, the power consumption will be able to be reduced 10% or more (in FIG. 15, reduced from 275 WH/H to 230 WH/H) as compared with a conventional fixing elastic roller whose release layer is formed by PTFE alone, with no aluminum exposed on the surface thereof (surface exposure rate of 0%).

As metallic substance, which is low heat emissive substance, nickel, chrome, iron, zinc or the like in addition to aluminum, has the effect that the power consumption can be reduced by reducing the spectral emissivity to 0.65 or less, though there may be somewhat differences in the spectral emissivity of the release layer. Further, it has also become apparent that as mold release substance, PFA, silicone rubber or the like in addition to PTFE functions in the same way and has a similar effect.

Concerning a fixing elastic roller whose release layer is formed by a composite material consisting of a mixture of PTFE and nichrome (metallic alloy), in the measuring experiment for spectral emissivity in a wave range of wavelength of 5 to 10 μm, the same result as in the first embodiment was obtained.

For the detail thereof, refer to the experimental result for the first embodiment described previously with reference to FIG. 16. To describe the experimental result briefly, since the spectral emissivity of a fixing elastic roller according to the present invention is 0.65 or less, it can be seen that it will suffice if only the exposure rate of nichrome occupying the surface area of the fixing elastic roller is set to about 23% or more.

Concerning a fixing elastic roller whose release layer is formed by a composite material consisting of a mixture of PTFE and nichrome, in the relation between the exposure rate of aluminum occupying the surface area of the fixing elastic roller and the power consumption required to maintain the roller surface temperature to 200° C., the same result as in the first embodiment was obtained.

For the detail thereof, refer to the experimental result for the first embodiment described previously with reference to FIG. 17. To describe the experimental result briefly, if the exposure rate of the aluminum in the surface area of a fixing elastic roller according to the present invention is set to about 23% or more, the power consumption will be able to be reduced 10% or more as compared with a conventional fixing elastic roller whose release layer is formed by PTFE alone, with no nichrome exposed on the surface thereof (surface exposure rate of 0%).

As metallic alloy material, which is low heat emissive substance, Monel metal, Inconel, chromel-alumel, brass, constantan-manganin or the like in addition to nichrome, has the effect that the power consumption can be reduced by reducing the spectral emissivity to 0.65 or less though there may be somewhat differences in the spectral emissivity of the release layer. Further, it has also become apparent that as mold release substance, PFA, silicone rubber or the like in addition to PTFE functions in the same way and has a similar effect.

<Experiment 16. Influence of Fixing Elastic Roller on Linear Image Quality>

An experiment was conducted in order to study the influence of the hardness of silicone rubber, fluorine rubber or the like used for the elastic layer of a fixing elastic roller on the linear width of the fixed toner image.

The fixing elastic roller used for the experiment is a roller obtained by stacking an elastic layer formed of silicone rubber and a release layer successively on the core metal described previously through a bonding layer to have an outer diameter of 60 mm, and a plurality of different rollers were adjusted at the hardness (JIS-A) of rubber constituting the elastic layer within a range of 10° to 80°. For comparison, a fixing roller (outer diameter of 60 mm) consisting of release layers alone without any elastic layers was prepared.

The compression elastic roller is formed as follows. That is, an elastic layer formed of 6 mm thick silicone rubber and a release layer formed of 70 μm thick fluorine resin tube are stacked on core metal formed by an aluminum hollow cylinder 48 mm in diameter, 6 mm in thickness and 320 mm in axial length as described previously, and a bonding layer each is provided between the core metal and the elastic layer, and between the elastic layer and the release layer respectively.

For the experimental method, the surface temperature of the fixing elastic roller is first maintained to a predetermined temperature, the fixing roller and the compression elastic roller are placed in close contact with each other, and the circumferential speed (that is, linear speed at which the recording sheet passes through between the pair of fixing rollers) of the fixing roller is set to 350 mm/sec.

A recording sheet (in this experiment, basis weight of 64 $g/m^2$) on which a non-fixed toner image having a linear width of 250 μm has been formed using the standard toner for use by the present applicant, is allowed to pass through between the pair of rollers consisting of the fixing elastic roller and the compression elastic roller, and is fixed to measure the linear width.

Also, for comparison, a recording sheet, on which a non-fixed toner image has been formed by means of a fixing roller consisting of release layers alone without any elastic layers under the same conditions as before, is allowed to pass through and is fixed to measure the linear width.

Figure 23:
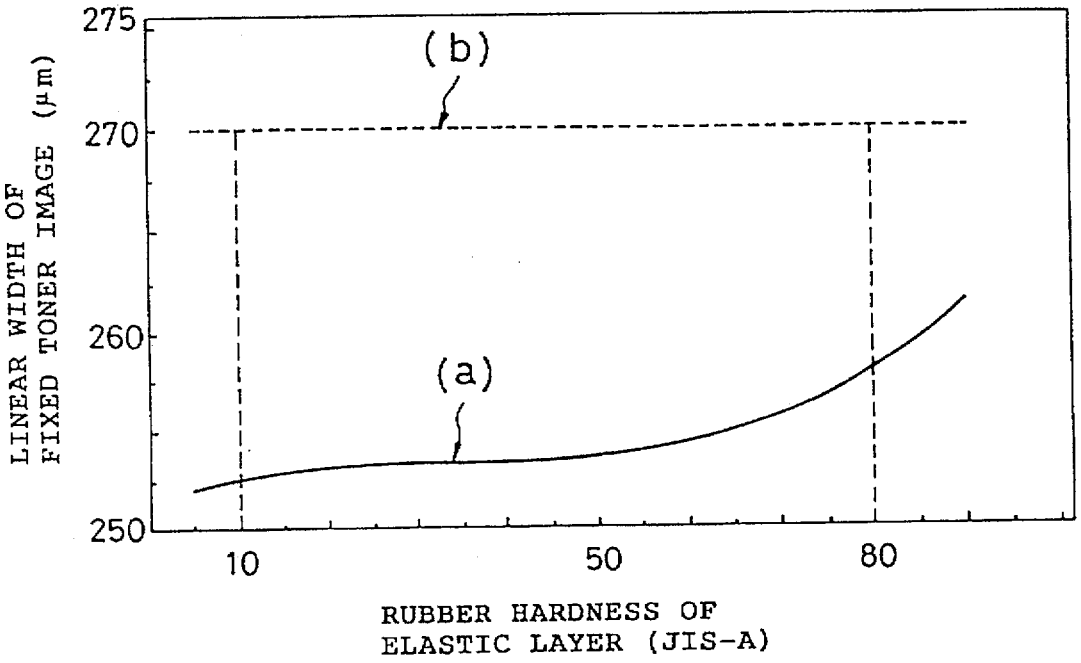
FIG. 23 is a view showing an experimental result on relation between rubber hardness of a fixing elastic roller and linear width of linear image after fixing.

FIG. 23 shows the experimental result; line (a) indicates the property of a fixing elastic roller having an elastic layer; and line (b) indicates the property of a fixing roller having no elastic layers. In the case of a fixing roller consisting of a release layer alone without any elastic layers, a non-fixed toner image having a linear width of 250 μm is flattened to spread the linear width up to about 270 μm when fixed. On the other hand, in the case of a fixing elastic roller having an elastic layer, the linear width spreads narrowly within a range of rubber hardness (JIS-A) of 10° to 80°, and an image with more fidelity can be obtained, whereby the effect of the elastic layer was confirmed.

Also, even in a fixing elastic roller having a plurality of elastic layers, it was confirmed that a similar effect can be obtained by setting the rubber hardness of each elastic layer to within a range of 10 to 80° (JIS-A). Further, in not only the fixing elastic roller, but also the fixing elastic roller (third embodiment) having a plurality of elastic layers, the fixing elastic belt (fourth embodiment) and self-heat release type fixing elastic roller (fifth embodiment), the substantially same effect was obtained.

<Experiment 17. Influence of Fixing Elastic Roller on Dot Image Quality>

An experiment was conducted in order to study the influence of hardness of silicone rubber, fluorine rubber or the like for use with the elastic layer of a fixing elastic roller on the size of dot (point) of a toner image fixed.

For the fixing elastic roller used for the experiment and the fixing roller for comparison, the same rollers as used in the Experiment 16 were used. Also, for the compression elastic roller, the same rollers as used in the Experiment 16 were used.

For the experimental method, the surface temperature of the fixing elastic roller is first maintained to a predetermined temperature, the fixing roller and the compression elastic roller are placed in close contact with each other, and the circumferential speed (that is, linear speed at which the recording sheet passes through between the pair of fixing rollers) of the fixing roller is set to 350 mm/sec.

A recording sheet (in this experiment, basis weight of 64 $g/m^2$) on which a non-fixed toner image having a dot diameter of 230 μm has been formed using the standard toner for use by the present applicant, is allowed to pass through between the pair of rollers consisting of the fixing elastic roller and the compression elastic roller, and is fixed to measure the dot diameter.

Also, for comparison, a recording sheet, on which a non-fixed toner image has been formed by means of a fixing roller consisting of release layers alone without any elastic layers under the same conditions as before, is allowed to pass through and is fixed to measure the dot diameter.

Figure 24:
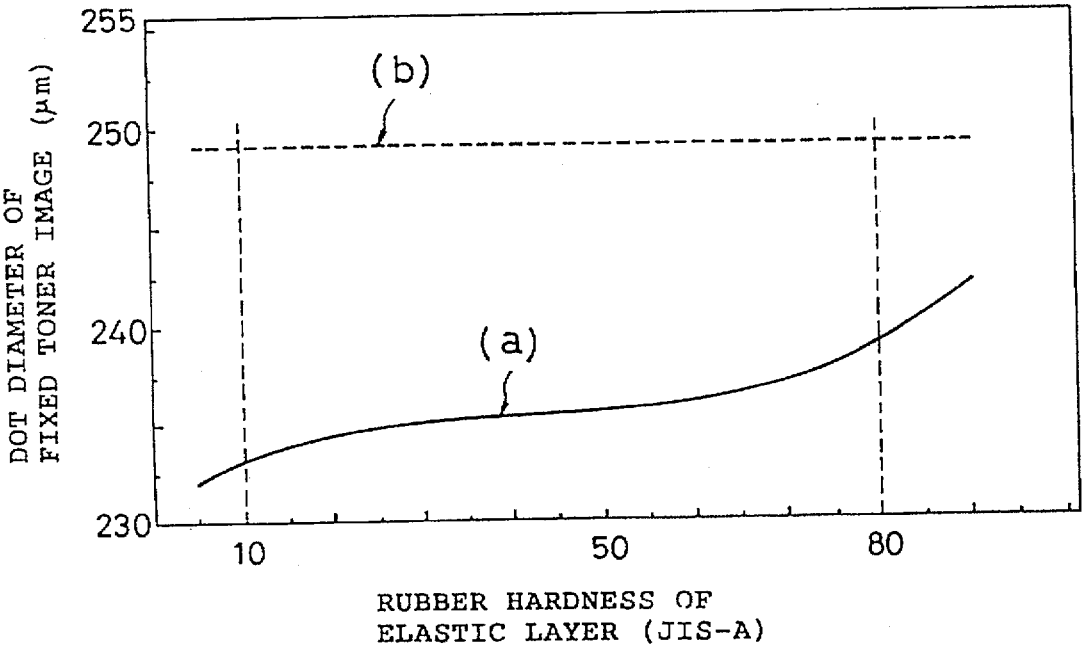
FIG. 24 is a view showing an experimental result on relation between rubber hardness of a fixing elastic roller and diameter of dot image after fixing.

FIG. 24 shows the experimental result; line (a) indicates the property of a fixing elastic roller having an elastic layer; and line (b) indicates the property of a fixing roller having no elastic layers. In the case of a fixing roller consisting of a release layer alone without any elastic layers, a non-fixed toner image having a dot diameter of 230 μm is flattened to enlarge the diameter up to about 240 μm when fixed. On the other hand, in the case of a fixing elastic roller having an elastic layer, the dot diameter is less enlarged within a range of rubber hardness (JIS-A) of 10 to 80°, and an image with more fidelity can be obtained, whereby the effect of the elastic layer was confirmed.

Also, even in a fixing elastic roller having a plurality of elastic layers, it was confirmed that a similar effect can be obtained by setting the rubber hardness of each elastic layer to within a range of 10° to 80° (JIS-A). Further, in not only the fixing elastic roller, but also the fixing elastic roller (third embodiment) having a plurality of elastic layers, the fixing elastic belt (fourth embodiment) and self-heat release type fixing elastic roller (fifth embodiment), the substantially same effect was obtained.

<Experiment 18. Influence of Thickness of Elastic Layer on Linear Image Quality>

An experiment was conducted in order to study the influence of the thickness of the elastic layer of silicone rubber, fluorine rubber or the like used for a fixing elastic roller on the linear width of the fixed toner image.

The fixing elastic roller used for the experiment is a roller obtained by stacking an elastic layer formed of silicone rubber and a release layer successively on the core metal described previously through a bonding layer to have an outer diameter of 60 mm, and a plurality of rollers having different thicknesses were adjusted at the hardness (JIS-A) of rubber constituting the elastic layer of 30° (JIS-A) within a range of thickness of the elastic layer of 0.05 mm to 15.0 mm. For comparison, a fixing roller (outer diameter of 60 mm) consisting of release layers alone without any elastic layers was prepared.

The compression elastic roller is also formed as follows. That is, an elastic layer having rubber hardness of 40° (JIS-A), formed of 6 mm thick silicone rubber and a release layer formed of 70 μm thick fluorine resin tube are stacked on a core metal as described previously, and a bonding layer is provided between core metal and elastic layer, and between elastic layer and release layer respectively.

For the experimental method, the surface temperature of the fixing elastic roller is first maintained to a predetermined, fixed temperature, the fixing roller and the compression elastic roller are placed in close contact with each other, and the circumferential speed (that is, linear speed at which the recording sheet passes through between the pair of fixing rollers) of the fixing roller is set to 350 mm/sec.

A recording sheet (in this experiment, basis weight of 64 $g/m^2$) on which a non-fixed toner image having a linear width of 250 μm has been formed using the standard toner for use by the present applicant, is allowed to pass through between the pair of rollers consisting of the fixing elastic roller and the compression elastic roller, and is fixed to measure the linear width.

Also, for comparison, a recording sheet, on which a non-fixed toner image has been formed by means of a fixing roller consisting of release layers alone without any elastic layers under the same conditions as before, is allowed to pass through and is fixed to measure the linear width.

Figure 25:
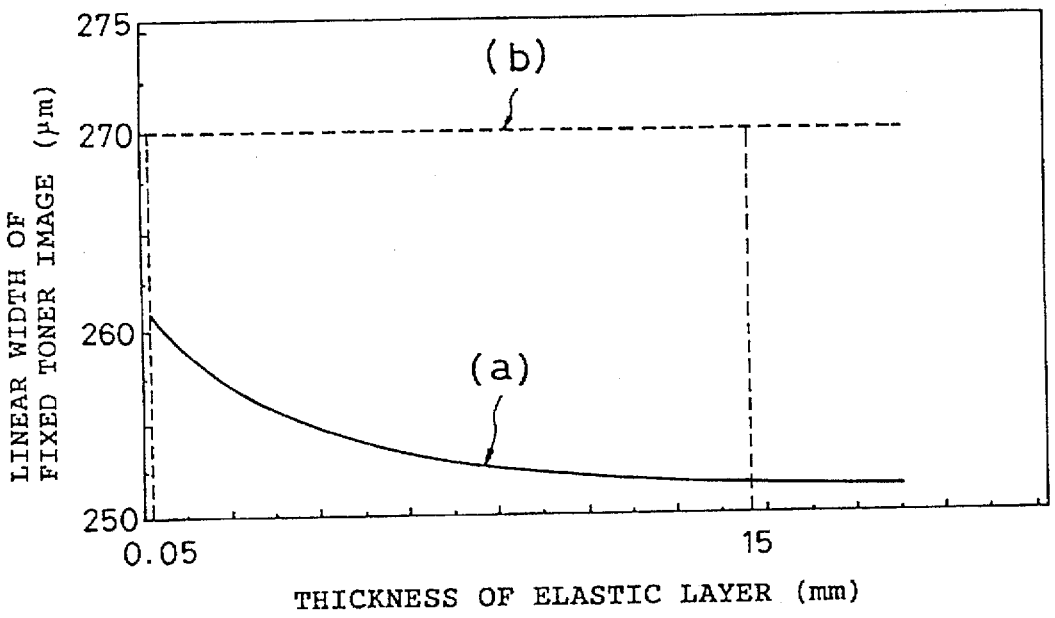
FIG. 25 is a view showing an experimental result on relation between thickness of an elastic layer of a fixing elastic roller and linear width of linear image after fixing.

FIG. 25 shows the experimental result; line (a) indicates the property of a fixing elastic roller having an elastic layer; and line (b) indicates the property of a fixing roller having no elastic layers. In the case of a fixing roller consisting of a release layer alone without any elastic layers, a non-fixed toner image having a linear width of 250 μm is flattened to spread the linear width up to about 260 μm when fixed. On the other hand, in the case of a fixing elastic roller having an elastic layer, the linear width spreads less as the thickness of the elastic layer increases, and it turned out that an image with more fidelity can be obtained.

Also, even in a fixing elastic roller (third embodiment) having a plurality of elastic layers, a similar effect could be obtained at total thickness of these elastic layers within a range of 0.05 mm to 15.0 mm. Further, even in the fixing elastic belt (fourth embodiment) and self-heat release type fixing elastic roller (fifth embodiment), the substantially same results were obtained.

From these results, it is considered that the appropriate thickness of the elastic layer in a fixing elastic roller is within a range of 0.05 mm to 15.0 mm.

<Experiment 19. Influence of Thickness of Elastic Layer on Dot Image Quality>

An experiment was conducted in order to study the influence of the thickness of the elastic layer of silicone rubber, fluorine rubber or the like used for a fixing elastic roller on the diameter of dot of the fixed toner image.

For the fixing elastic roller used for the experiment and the fixing roller for comparison, the same rollers as used in the Experiment 17 were used. Also, for the compression elastic roller, the same rollers as used in the Experiment 17 were used.

For the experimental method, the surface temperature of the fixing elastic roller is first maintained to a predetermined temperature, the fixing roller and the compression elastic roller are placed in close contact with each other, and the circumferential speed (that is, linear speed at which the recording sheet passes through between the pair of fixing rollers) of the fixing roller is set to 350 mm/sec.

A recording sheet (in this experiment, basis weight of 64 $g/m^2$) on which a non-fixed toner image having a dot diameter of 230 μm has been formed using the standard toner for use by the present applicant, is allowed to pass through between the pair of rollers consisting of the fixing elastic roller and the compression elastic roller, and is fixed to measure the dot diameter.

Also, for comparison, a recording sheet, on which a non-fixed toner image has been formed by means of a fixing roller consisting of release layers alone without any elastic layers under the same conditions as before, is allowed to pass through and is fixed to measure the dot diameter.

Figure 26:
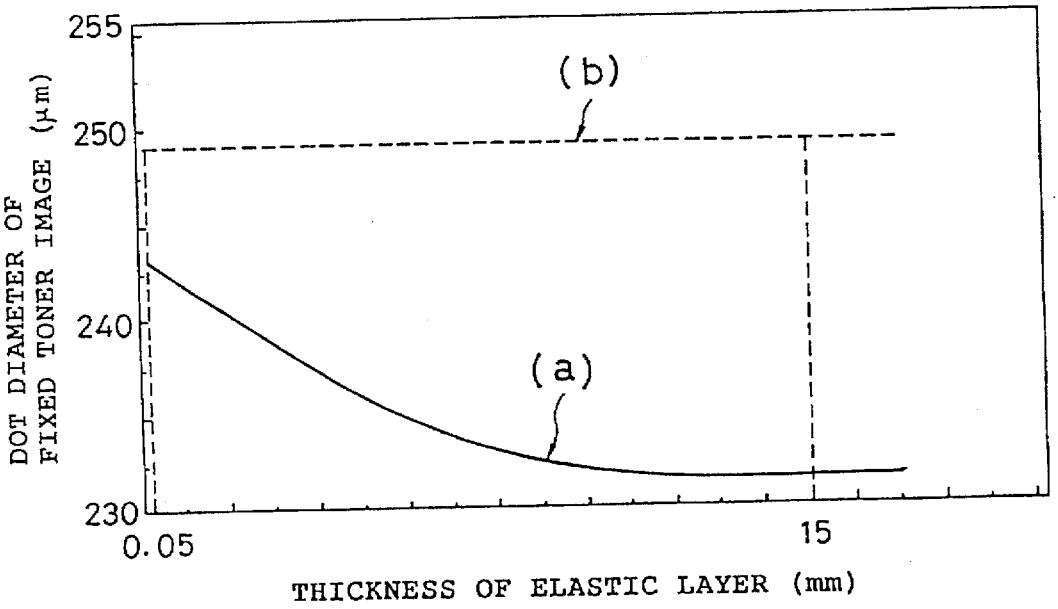
FIG. 26 is a view showing an experimental result on relation between the thickness of an elastic layer of a fixing elastic roller and the diameter of a dot image after fixing.

FIG. 26 shows the experimental result; line (a) indicates the property of a fixing elastic roller having an elastic layer; and line (b) indicates the property of a fixing roller having no elastic layers. In the case of a fixing roller consisting of a release layer alone without any elastic layers, a non-fixed toner image having a dot diameter of 230 μm is flattened to enlarge the dot diameter up to about 240 μm when fixed. On the other hand, in the case of a fixing elastic roller having an elastic layer, the dot diameter is less enlarged as the thickness of the elastic layer increases, and it turned out that an image with more fidelity can be obtained.

Also, even in a fixing elastic roller (third embodiment) having a plurality of elastic layers, a similar effect could be obtained at total thickness of these elastic layers within a range of 0.05 mm to 15.0 mm. Further, even in the fixing elastic belt (fourth embodiment) and self-heat release type fixing elastic roller (fifth embodiment), the substantially same results were obtained.

From these results, it is considered that the appropriate thickness of the elastic layer in a fixing elastic roller is within a range of 0.05 mm to 15.0 mm.

<Experiment 20. Warming-up Time for Fixing Elastic Roller>

The conventional fixing elastic roller has had a disadvantage that warming-up time required to heat it to a fixable temperature is too long. This is because the heat capacity of the elastic layer constituting the fixing elastic roller is great. Since the release layer of a fixing elastic roller according to the present invention is formed by a composite material obtained by mixing PTFE with metal (for example, nickel), which is a low heat emissive material, a small quantity of heat is radiated from the surface of the roller. Therefore, the warming-up time is considered to be shortened, and an experiment was conducted to confirm this point.

The fixing elastic roller used for the experiment is a roller obtained by stacking an elastic layer and a release layer successively on the core metal described previously through a bonding layer to have an outer diameter of 60 mm, and the spectral emissivity of the release layer was adjusted to 0.65.

The conventional fixing elastic roller for comparison has the same structure as the fixing elastic roller used for the experiment, but the spectral emissivity of the release layer was adjusted to 0.9.

For the experimental method, the fixing elastic roller is held in space to prevent it from contacting other rollers and other members, and a heater provided inside the roller is energized to measure heating time required for the roller surface temperature to reach 160° C.

Figure 27:
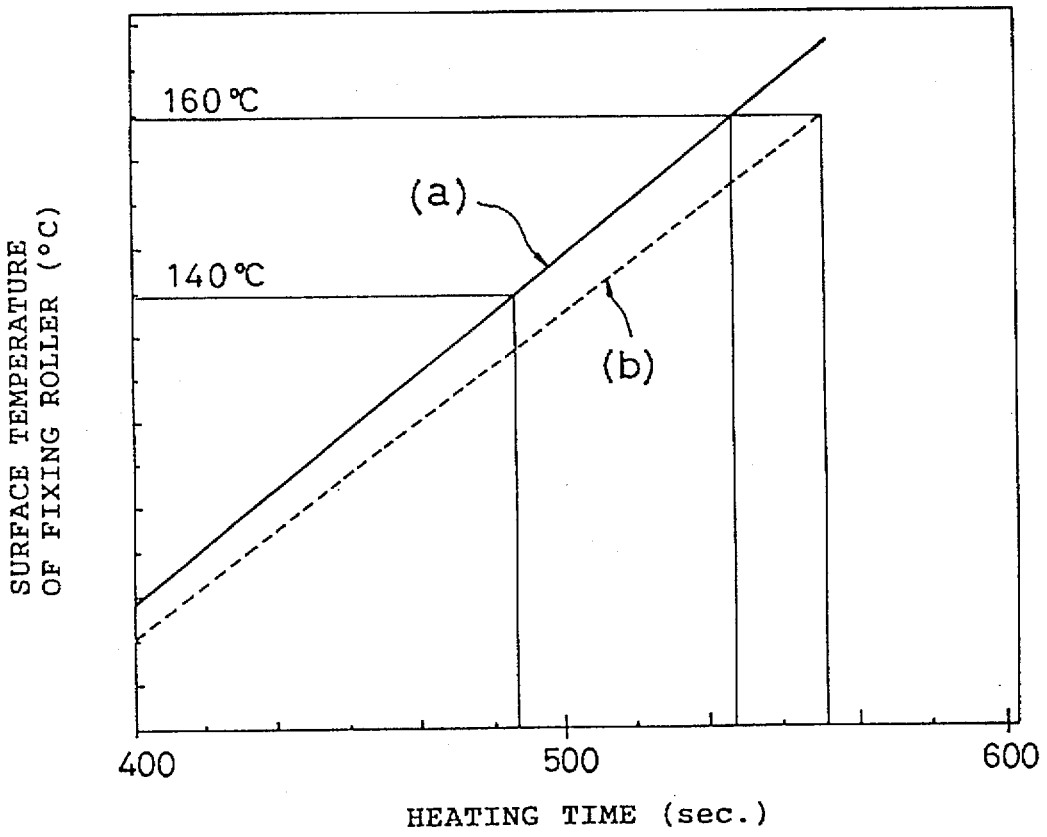
FIG. 27 is a view showing an experimental result on relation between the heating time and the surface temperature in a fixing elastic roller.

FIG. 27 shows the experimental result; line (a) indicates a fixing elastic roller (spectral emissivity of release layer: 0.65) according to the present invention; line (b) indicates, a conventional fixing elastic roller (spectral emissivity of release layer: 0.9). It was found that the fixing elastic roller according to the present invention reaches a predetermined temperature earlier than the conventional fixing elastic roller. It can be attributed to small losses due to heat radiation from the surface of the roller because the release layer is formed by a composite material obtained by mixing PTFE with metal (for example, nickel), which is a low heat emissive material as described previously, a small quantity of heat is radiated from the surface of the roller.

<Experiment 21. Durability of Fixing Elastic Roller>

An experiment was conducted in order to study the durability of a fixing elastic roller according to the present invention.

The fixing elastic roller, used for the experiment, according to the present invention is a roller having an outer diameter of 60 mm obtained by stacking an elastic layer and a release layer successively on the core metal described previously through a bonding layer, and the spectral emissivity of the release layer was adjusted to 0.65.

The conventional fixing elastic roller for comparison has the same structure as the fixing elastic roller used for the experiment, but the spectral emissivity of the release layer was adjusted to 0.9.

For the experimental method, the surface temperature of the fixing elastic roller is first maintained to a predetermined, fixable temperature (160° C. and 140° C. herein), the fixing roller and the compression elastic roller are placed in close contact with each other, and the circumferential speed (that is, linear speed at which the recording sheet passes through between the pair of rollers) of the fixing elastic roller is set to 350 mm/sec.

A recording sheet (in this experiment, basis weight of 64 $g/m^2$) on which a non-fixed toner image has been formed using the standard toner for use by the present applicant, is allowed to pass through at a rate of six sheets per minute between the pair of rollers consisting of the fixing elastic roller and the compression elastic roller, and is fixed to count the number of sheets processed until the fixing elastic roller is broken.

Figure 28:
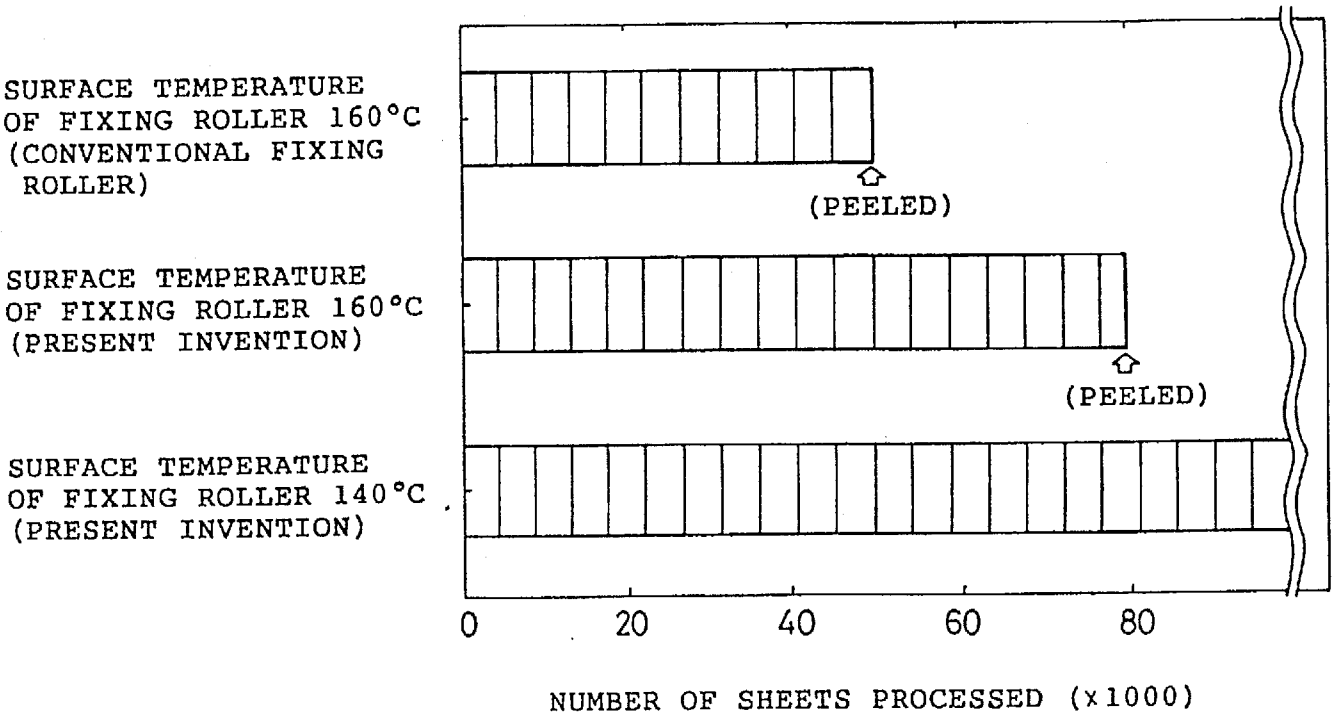
FIG. 28 is a view showing an experimental result on the durability of a fixing elastic roller.

FIG. 28 shows the experimental result. In case where the surface temperature of the fixing elastic roller was maintained to 160° C., in the conventional fixing elastic roller, when about 50,000 sheets were processed, the elastic layer made of rubber was peeled from the roller core metal, and the recording sheets fixed were crumpled. On the other hand, in the fixing elastic roller according to the present invention, no trouble occurred until about 80,000 sheets were processed. Also, in case where the surface temperature of the fixing elastic roller was maintained to 140° C., no trouble occurred even if the fixing elastic roller according to the present invention processes about 100,000 sheets.

As described previously, the release layer is formed of a composite material obtained by mixing PTFE with metal (for example, nickel), which is a low heat emissive material, and therefore, the loss due to heat radiation from the surface of the roller is small. Accordingly, the temperature drop in the fixing elastic roller during fixing is low, and the heating time of the roller by a heater is greatly reduced. Therefore, in the primer layer in which an elastic layer made of rubber is bonded to the roller core metal, heat deterioration is difficult to take place.

<Experiment 22. Change in Fixing Performance due to Surface Temperature Drop during Fixing Operation>

In the conventional fixing elastic roller, in case where a large-size recording sheet such as A3 size is fixed, the fixing strength drops at the leading end portion of the recording sheet to be fixed first, and at the trailing end portion of the recording sheet to be finally fixed because the roller surface temperature drops during fixing operation. Thus, an experiment was conducted in order to study the change in the fixing performance during fixing operation by a fixing elastic roller according to the present invention.

The fixing elastic roller used for the experiment is a roller having an outer diameter of 60 mm obtained by stacking an elastic layer and a release layer successively on the core metal described previously through a bonding layer, and the spectral emissivity of the release layer was adjusted to 0.65.

The conventional fixing elastic roller for comparison has the same structure as the fixing elastic roller used for the experiment, but the spectral emissivity of the release layer was adjusted to 0.9.

For the experimental method, the surface temperature of the fixing elastic roller is first maintained to a fixable temperature of 160° C., the fixing roller and the compression elastic roller are placed in close contact with each other, and the circumferential speed (that is, linear speed at which the recording sheet passes through between the pair of rollers) of the fixing elastic roller is set to 350 mm/sec. A recording sheet of A3 size on which a non-fixed toner image has been formed using the standard toner for use by the present applicant, is allowed to pass through between the pair of rollers consisting of the fixing elastic roller and the compression elastic roller, and is fixed.

Next, the image density (I.D.) of the toner image thus fixed at the leading portion (a distance of 10 mm from the leading end portion of the sheet) and at the trailing end portion (a distance of 10 mm from the leading end portion of the sheet) thereof is measured by means of a reflection density measuring instrument (Model RD-918, manufactured by Macbeth Inc.), two types of toner images: 0.8 and 1.4 in image density are selected, the image density of the toner images at the leading end portion and at the trailing end portion thereof is measured again after the surfaces of those toner images are rubbed by causing a sand eraser (No.502, manufactured by The Lion Co., Ltd.) added with a load of 1 kg to reciprocate three times, and a ratio thereof to the image density before the rubbing is determined. This ratio is defined as fixing strength ratio. It is judged that the closer to 1 the fixing strength ratio is, the better the fixing performance is.

Figure 29:
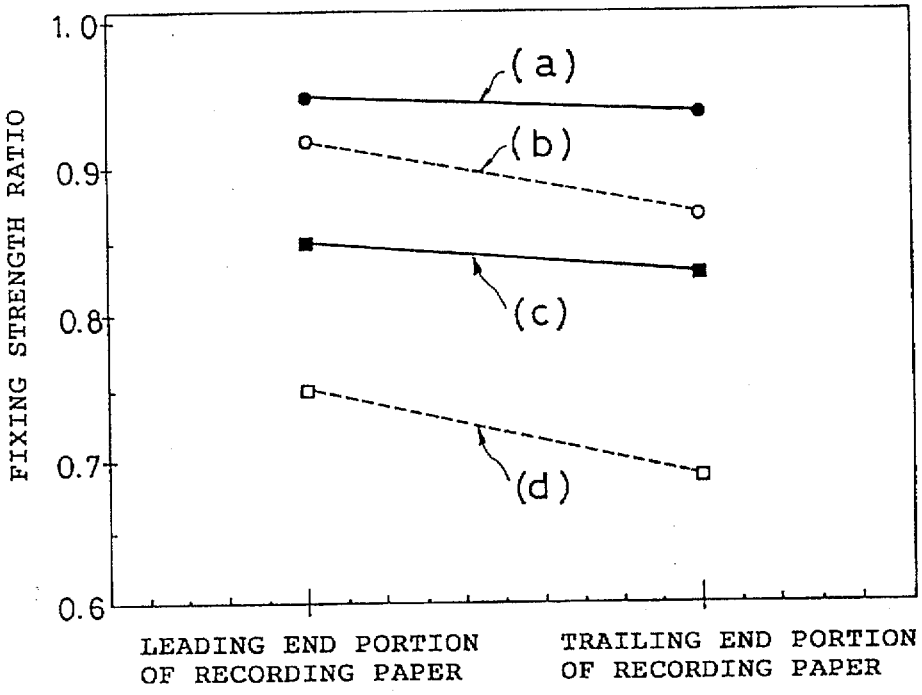
FIG. 29 is a view showing an experimental result on difference in fixing strength between at the leading end and at the trailing end of a recording sheet.
Figure 30:
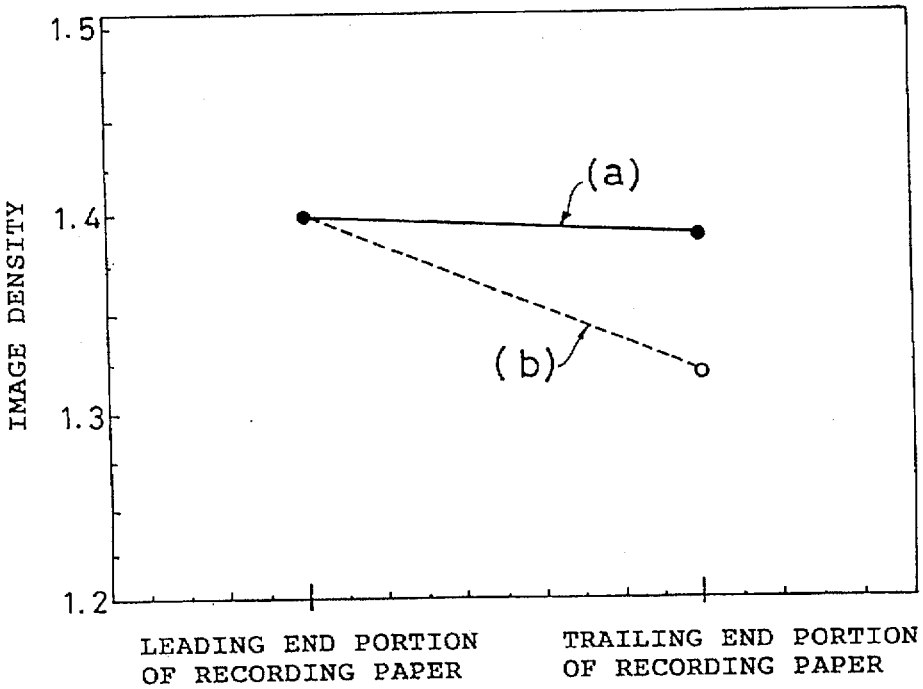
FIG. 30 is a view showing an experimental result on difference in image reflection density between at the leading end and at the trailing end of a recording sheet.

FIGS. 29 and 30 shows the experimental result; line (a) indicates the property of a fixing elastic roller at I.D.=1.4 according to the present invention; line (b), the property of a conventional fixing elastic roller; line (c), the property at I.D.=0.8 according to the present invention; and line (d), the property of the conventional fixing elastic roller. As is apparent from FIG. 29, at either of 0.8 and 1.4 in image density of the image, a fixing elastic roller according to the present invention has not only higher fixing strength ratio than a conventional fixing elastic roller as a whole, but also a lower ratio of fixing strength ratio at the trailing end portion of the image to that at the leading end portion thereof.

FIG. 30 shows variations in density when the image density of the image is 1.4; line (a) indicates the property of a fixing elastic roller at I.D.=1.4 according to the present invention; and line (b) indicates, the property of a conventional fixing elastic roller. From FIG. 30, it can be seen that in the fixing elastic roller according to the present invention, the density at the trailing end portion of the image to that at the leading end portion thereof drops less, but in the conventional fixing elastic roller, the density at the trailing end portion of the image to that at the leading end portion thereof drops more.

This is because in the conventional fixing elastic roller, heat conduction from the elastic layer to the release layer is not conducted quickly as the release layer formed of low thermal conductive substance such as fluorine resin is formed on the elastic layer formed of low thermal conductive substance such as silicone rubber, and when heat is taken away from the roller surface at the time of passage of the leading end portion of the recording sheet, the trailing end portion thereof passes while a plenty of heat is not supplied from the internal elastic layer, thus resulting in the lower roller surface temperature toward the trailing end portion of the recording sheet.

In contrast to this, in the fixing elastic roller according to the present invention, heat conduction from the elastic layer to the release layer is conducted quickly as the release layer containing metal (for example, nickel), high thermal conductive substance, is formed on the elastic layer formed of low thermal conductive substance such as silicone rubber. Since, therefore, heat is sufficiently supplied from the internal elastic layer even if heat is taken away at the time of passage of the leading end portion of the recording sheet, the roller surface temperature hardly lowers even at the trailing end portion thereof, thus making it possible to fix well in the same manner as the leading end portion of the recording sheet.

<Description of Experimental Result on Separating Claw for Fixing Device >

Hereinafter, the description will be made of the result of an experiment conducted under various conditions concerning separating claws for fixing device provided with a release layer.

<Experiment 23. Surface Temperature and Power Consumption of Fixing Roller>

In a conventional fixing device, the surroundings of the fixing roller have been covered with heat insulation material in order to save electrical power consumed to maintain the temperature of the fixing roller while no copying operation is performed, but it is difficult to sufficiently cover with heat insulation material because there are arranged a separating claw for peeling a recording sheet, a cleaning member and the like in contact with the fixing roller around the fixing roller, thus resulting in insufficient effect of reducing heat dissipation.

Thus, according to the present invention, the structure is arranged to provide the separating claw with a release layer to be described hereinafter to reduce the heat dissipation. In order to confirm the effect thereof, the power consumption of the fixing device was measured.

The separating claw used for the experiment is one obtained by providing a release layer on the surface of the claw body made of heat-resistant synthetic resin described previously, and the release layer is formed of a composite material prepared by mixing, with a coating material mainly composed of PTFE, nickel, which is a good thermal conductor having lower spectral emissivity than that of this coating material in a wave range of radiation wavelength of 5 to 10 μm, by 70% in volume ratio with respect to PTFE.

For the experimental method, the fixing roller of the first embodiment is first arranged within the fixing device, and a heating halogen heater arranged within is energized and heated through a temperature control circuit. The surface temperature is detected by a temperature detection sensor, and the heater energizing time is controlled to maintain a predetermined temperature. Thus, the electric energy consumed for a specified period of time is measured by the use of a watt-hour meter.

Figure 31:
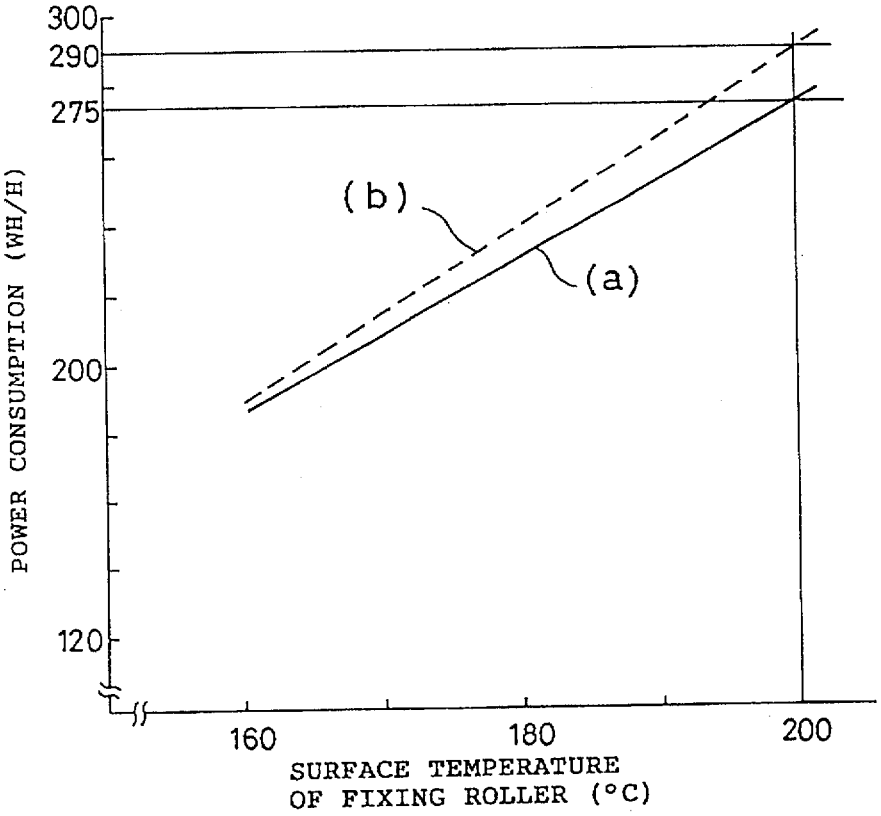
FIG. 31 is a view showing an experimental result on relation between the surface temperature and power consumption of a fixing roller.

FIG. 31 shows the measured results for the surface temperature and power consumption of the fixing roller; line (a) indicates the property of a separating claw according to the present invention; and line (b), the property of a conventional separating claw. The electric energy consumed to maintain the surface temperature of the fixing roller to 200° C. was 290 WH/H in the fixing device having a conventional separating claw, but becomes 275 WH/H in the fixing device having a separating claw according to the present invention, thus proving the electric energy saving effect of more than 5%.

This is because radiant heat radiated from the fixing roller can be reflected by the separating claw to return to the fixing roller because the release layer of the separating claw according to the present invention is made of low heat emissive material and heat emission from the surface is small.

This separating claw is applicable not only to the above-described fixing roller (first embodiment), but also to the fixing elastic roller (second embodiment), the fixing elastic roller (third embodiment) having a plurality of elastic layers, and the fixing elastic belt (fourth embodiment), and also when the separating claw is applied to the second to fourth embodiments, the similar electric energy saving effect was recognized.

Further, the separating claw is applicable to the self-heat release type fixing elastic roller (fifth embodiment), and also when the separating claw is applied to the fifth embodiment, the similar electric energy saving effect was recognized.

<Experiment 24. Surface Exposure Rate of High Thermal Conductive Material and Image Noise>

In case where an image is copied on both faces of a recording sheet, or another image is copied on a recording sheet on which an image has been copied once (composite image), when a first toner image fixed on a recording sheet is in a state in which it has been reheated during the next image fixing processing, the separating claw at a high temperature may come into contact, thus deforming or disturbing the toner image. Such image deformation or disturbance is called image noise, and the higher the image density is, more noise is prone to occur.

According to the present invention, when the separating claw in a fixing device is provided with a release layer, it is expected that the temperature of the separating claw lowers, and the heat of the toner image is dissipated depending on the surface exposure rate of nickel, which is a high thermal conductive material contained in the release layer. Therefore, in order to confirm the effect, an experiment was conducted to study the relation between the surface exposure rate of nickel, a high thermal conductive material contained in the release layer, and the image density at which image noise takes place.

The separating claw in a fixing device used for the experiment is one obtained by providing a release layer on the claw body made of heat-resistant synthetic resin described previously, and the release layer is formed of composite materials prepared by mixing, with a coating material mainly composed of PTFE, nickel, which is a good thermal conductor having lower spectral emissivity than that of this coating material in a wave range of radiation wavelength of 5 to 10 μm, by 15% and 39% respectively.

For the experimental method, a non-fixed toner image is formed on the second surface (back face) of a recording sheet, on the first surface of which a toner image has been fixed, and is fixed to examine whether or not image noise occurs.

Figure 32:
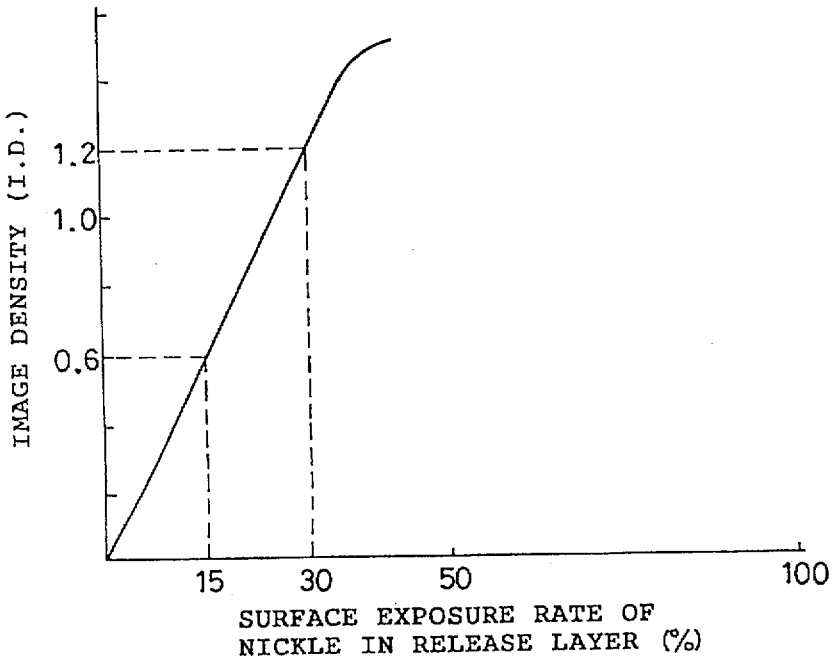
FIG. 32 is a view showing an experimental result on relation between the rate of exposure of nickel in the release layer of a separating claw and the image density at which image noise occurs.

FIG. 32 shows the relation between surface exposure rate of nickel contained in the release layer in a separating claw, and image density at which image noise occurs. It was confirmed that at a surface exposure rate of nickel contained in the release layer of 15%, image noise appears at image density (I.D.) of 0.6 (half image) or more; that at a surface exposure rate of nickel contained in the release layer of 30% (spectral emissivity in a wave range of wavelength 5 to 10 μm is 0.5, refer to FIG. 14 of Experiment 4), image noise appears at image density (I.D.) of 1.2 or more; and that no image noise occurs at image density less than those values.

In this respect, it is considered that since the nickel contained in the release layer is exposed on the surface of the separating claw to make the thermal conductivity on the surface of the separating claw higher, and when the separating claw comes into contact with the toner image, the heat is spread fast to lower the temperature of the toner image, and the temperature of the separating claw also lowers, and therefore no image noise occurs.

incidentally, the relation between surface exposure rate of metal or metallic alloy contained in the release layer, and spectral emissivity is as described in the previous Experiment 4 with reference to FIGS. 14 and 17, and the greater the surface exposure rate of metal or metallic alloy is, the lower the spectral emissivity becomes. Also, the relation between surface exposure rate of metal contained in the release layer, and thermal conductivity is as described in the previous Experiment 7 with reference to FIG. 21, and the greater the surface exposure rate becomes, the higher the thermal conductivity becomes (the lower the heat emissivity becomes). This relation makes no great difference even if the type of the metal is aluminum, nickel, iron, chrome or the like, or metallic alloy.

Even when this separating claw is applied to the fixing elastic roller (second embodiment), the fixing elastic roller (third embodiment) having a plurality of elastic layers, the fixing elastic belt (fourth embodiment) and the self-heat release type fixing elastic roller (fifth embodiment), the effect of restraining the occurrence of image noise was similarly confirmed.

<Experiment 25. Temperature of Separating Claw Base and Spectral Emissivity of Mold Release Layer>

In the fixing device, the separating claw is in contact with the surface of the fixing roller, and is thermally affected by the fixing roller. When the fixing roller is kept at 190° C., which is a temperature during general fixing operation, the relation between the temperature of the base constituting the separating claw, and the spectral emissivity of the release layer was investigated.

The separating claw in a fixing device used for the experiment is one obtained by providing a release layer on the claw body made of heat-resistant synthetic resin described previously, and the release layer is formed of a composite material prepared by mixing nickel with a coating material mainly composed of PTFE. For the coating material, one having spectral emissivity in a wave range of wavelength is 5 to 10 μm being within a range of 0.1 to 0.9 was prepared.

For the experimental method, with the surface temperature of the fixing roller maintained at 190° C., the temperature of the separating claw base was measured for separating claws having spectral emissivity of the release layer which differs within a range of 0.1 to 0.9.

Figure 33:
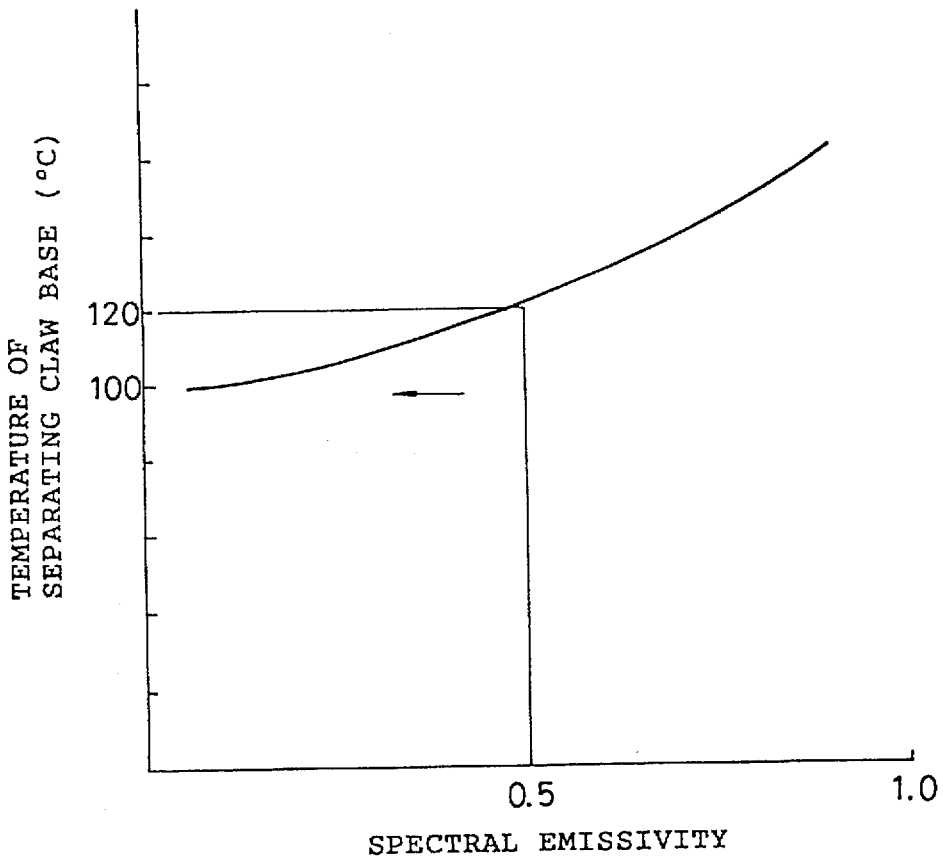
FIG. 33 is a view showing an experimental result on relation between the spectral emissivity of the release layer on the surface of a separating claw and the temperature of the separating claw base.

FIG. 33 shows the relation between spectral emissivity of the release layer in the separating claw and temperature of the separating claw base, and if the spectral emissivity of the coating material of the release layer in a wave range of wavelength of 5 to 10 μm is made smaller than 0.5, it was confirmed that it is possible to reduce the internal temperature of the separating claw base to 120° C. or less.

In addition, if even a guide plate, heat insulation material or the like other than the separating claw inside the fixing device is provided with a release layer having the aforesaid spectral emissivity characteristics, it was confirmed that it is possible to keep the temperature low.

<Description of Experimental Result on Temperature Detection Sensor in the Fixing Device>

Hereinafter, the description will be made of the experimental results on a temperature detection sensor in the fixing device provided with a release layer under various conditions.

<Experiment 26. Power Consumption of Fixing Device>

In the fixing device, the surface temperature of the fixing roller has been detected by the use of a temperature detection sensor to control the temperature so far. Since the temperature detection sensor is in contact with the surface of the fixing roller, a release layer made of fluorine resin, or the like has been provided in order to protect the surface of the fixing roller, and to prevent toner from adhering, but it has not aimed at reducing heat dissipation from the fixing device.

In the present invention, in order to reduce the heat dissipation from the fixing device in addition to protection of the surface of the fixing roller and prevention of toner from adhering, a release layer to be described below has been provided for the surface of the temperature detection sensor. In order to confirm the effect, the power consumption of the fixing device was measured.

The release layer of a temperature detection sensor used for the experiment is formed of a composite material prepared by mixing, with a coating material mainly composed of PTFE, nickel, which is a good thermal conductor having lower spectral emissivity than that of the coating material in a wave range of radiation wavelength of 5 to 10 μm, by 70% in volume ratio with respect to PTFE.

For the experimental method, the fixing roller of the first embodiment is first arranged within the fixing device, and a heating halogen heater arranged within is energized and heated through a temperature control circuit. The surface temperature is detected by a temperature detection sensor, and the heater energizing time is controlled to maintain a predetermined temperature. Thus, the electric energy consumed for a specified period of time is measured by the use of a watt-hour meter.

Figure 34:
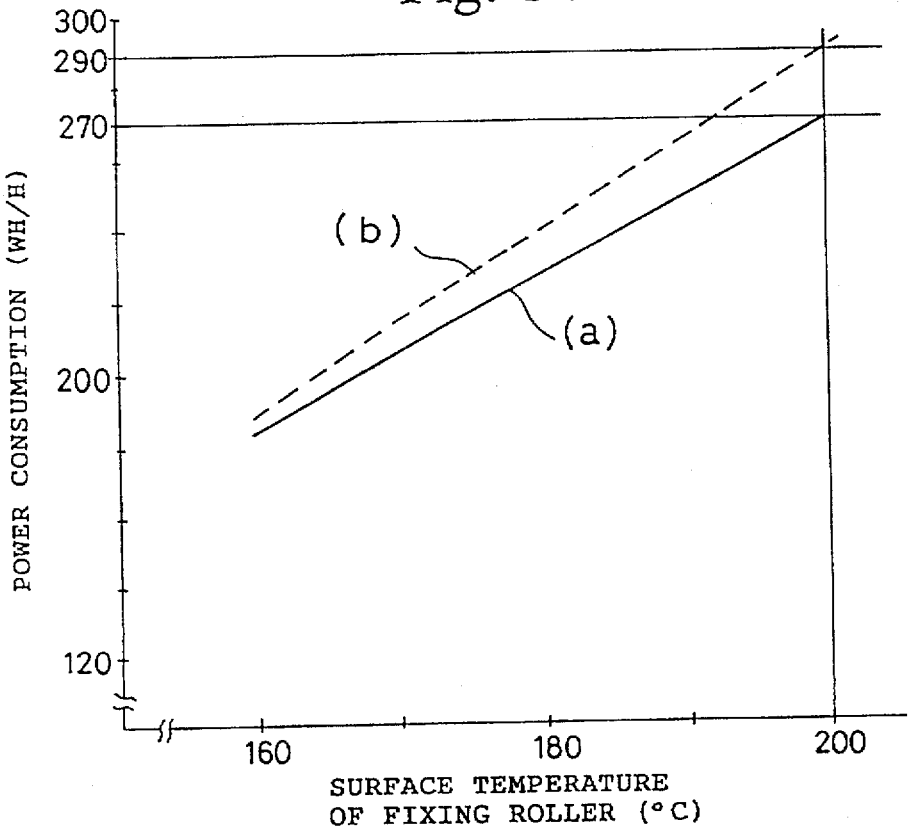
FIG. 34 is a view showing an experimental result on relation between the surface temperature of the fixing roller and the power consumption.

FIG. 34 shows the measured results for the surface temperature and power consumption of the fixing roller; line (a) indicates a case where a temperature detection sensor according to the present invention is used; and line (b) indicates a case where a conventional temperature detection sensor is used. The electric energy consumed to maintain the surface temperature of the fixing roller to 200° C. was 290 WH/H in the fixing device having a conventional temperature detection sensor, but becomes 270 WH/H in the fixing device provided with a temperature detection sensor having a release layer according to the present invention, thus confirming the electric energy saving effect of more than 5%.

This is probably partly because radiant heat radiated from the fixing roller can be reflected by the release layer on the surface of the temperature detection sensor to return to the fixing roller because the release layer of the temperature detection sensor according to the present invention is made of low heat emissive material and heat emission from the entire surface of the temperature detection sensor is at a low level as compared with the conventional one (the relation between surface exposure rate of metal contained in the release layer and spectral emissivity is as described in the previous Experiment 4 with reference to FIG. 14, and the spectral emissivity becomes low when the surface exposure rate of metal becomes high), and partly because heat absorption by the temperature detection sensor itself is reduced by the release layer of the temperature detection sensor.

This temperature detection sensor is applicable not only to the above-described fixing roller (first embodiment), but also to the fixing elastic roller (second embodiment), the fixing elastic roller (third embodiment) having a plurality of elastic layers, the fixing elastic belt (fourth embodiment), and the self-heat release type fixing elastic roller (fifth embodiment), and also when the temperature detection sensor is applied to the second to fifth embodiments, the similar electric energy saving effect was recognized.

<Experiment 27. Surface Exposure Rate of High Thermal Conductive Material and Temperature Response>

For the release layer for the temperature detection sensor, a composite material obtained by mixing a coating material mainly composed of PTFE with a high thermal conductive material is used, and an experiment was conducted in order to study the response for temperature control of the fixing roller by the use of the temperature detection sensor in which such material has been used as the release layer.

The release layer for the temperature detection sensor used for the experiment is formed by any one of the following four types of composite materials: a composite material (1) prepared by mixing, with a coating material mainly composed of PTFE, nickel, which is a high thermal conductive material, by 10% in volume ratio with respect to PTFE; a composite material (2) prepared by mixing by 30%; a composite material (3) prepared by mixing by 50%; and a composite material (4) prepared by mixing by 70%. The release layer for the conventional temperature detection sensor for comparison is formed of fluorine resin material (5).

For the experimental method, first a temperature detection sensor having a release layer made of the above-described materials is prepared, a fixing roller of the first embodiment is arranged in a fixing device, and the temperature detection sensor is provided at a predetermined detection position. Next, a target control temperature for a temperature control circuit is set to 190° C., a heating halogen heater inside the fixing roller is energized and heated through the temperature control circuit, the surface temperature of the fixing roller is detected by the use of the temperature detection sensor, and the temperature is controlled to maintain the target control temperature.

Figure 35:
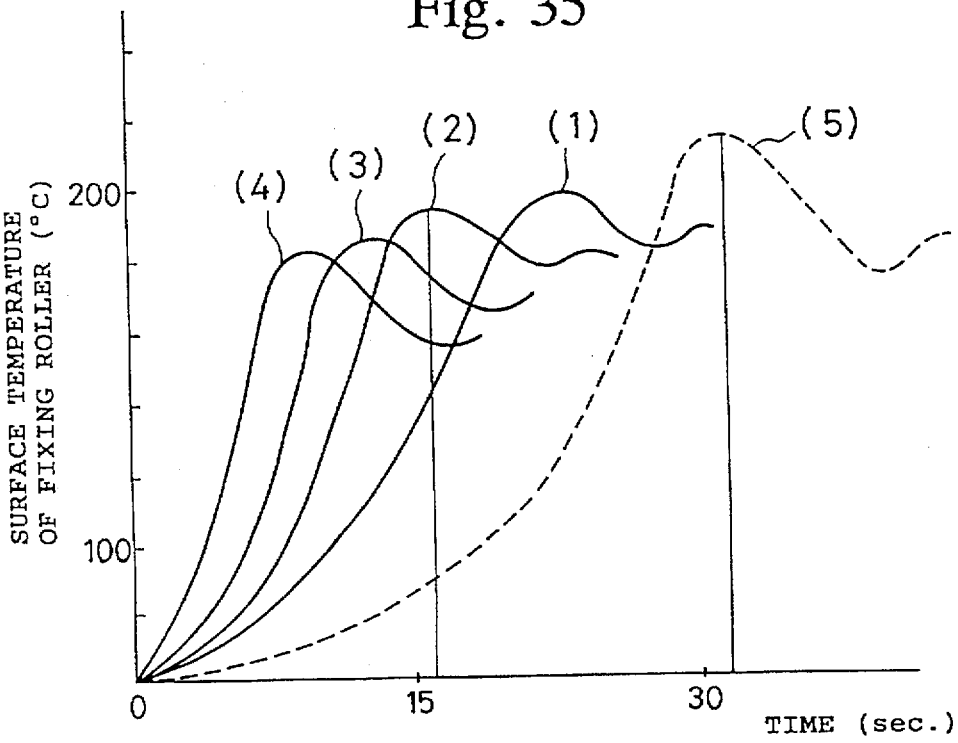
FIG. 35 is a view showing an experimental result on the surface exposure rate and the temperature response of high thermal conductive material.

FIG. 35 shows the experimental result; line (5) indicates a conventional example in which the release layer of the temperature detection sensor is formed of a fluorine resin material. Overshoot, in which the temperature starts to lower after the target control temperature of 190° C. is considerably exceeded, is recognized. Yet, the peak value for the detection temperature was detected after the lapse of more than 30 seconds after the start of temperature control.

On the other hand, when a composite material prepared by mixing nickel with PTFE is used as the release layer for the temperature detection sensor by the present invention, a 10% mixture indicates line (1); a 30% mixture indicates line (2); a 50% mixture indicates line (3); and a 70% mixture indicates line (4). The higher the mixture ratio is, the smaller the overshoot exceeding the target control temperature of 190° C. becomes, and the time until the peak value of detection temperature is detected since the start of temperature control becomes shorter. In the case of the 30% mixture (2), the peak value of detection temperature is detected in about one-half as long as time needed for the conventional one, and detection sensitivity with respect to time has become about twice.

This is because, in a temperature detection sensor according to the present invention, the nickel, a high thermal conductive material, contained in the release layer of the temperature detection sensor is exposed on the contact surface of the fixing roller, and quickly transmits the heat of the fixing roller to a thermistor, which is a heat sensitive element.

The relation between surface exposure rate of metal or metallic alloy contained in the release layer, and spectral emissivity is as described in the previous Experiment 4with reference to FIGS. 14 and 17, and the greater the surface exposure rate of metal or metallic alloy is, the lower the spectral emissivity becomes. Also, the relation between surface exposure rate of the metal contained in the release layer and thermal conductivity is as described in the previous Experiment 7 with reference to FIG. 21, and the greater the surface exposure rate becomes, the higher the thermal conductivity becomes (the lower the heat emissivity becomes). This relation makes no great difference even if the type of the metal is aluminum, nickel, iron, chrome, or the like, or metallic alloy, and if the spectral emissivity of the metal itself is 0.2 or less, functions as the aforesaid high thermal conductive material.

<Experiment 28. Durability of Release Layer>

An experiment was conducted in order to study the durability of the release layer in a temperature detection sensor.

The temperature detection sensor used for the experiment has a release layer formed by a composite material prepared by mixing, with a coating material mainly composed of PTFE, nickel, which is a high thermal conductive material, by 30% in volume ratio with respect to PTFE. Also, the conventional temperature detection sensor for comparison has a release layer formed of fluorine resin material.

For the experimental method, first a temperature detection sensor having a release layer made of the above-described materials is prepared, a fixing roller of the first embodiment is arranged in a fixing device, and the temperature detection sensor is provided at a predetermined detection position. Next, a target control temperature for a temperature control circuit is set to 190° C., and recording sheets are fixed at a rate of 50 sheets per minute to measure the abrasion loss of the release layer whenever processing of a predetermined number of sheets is completed.

Figure 36:
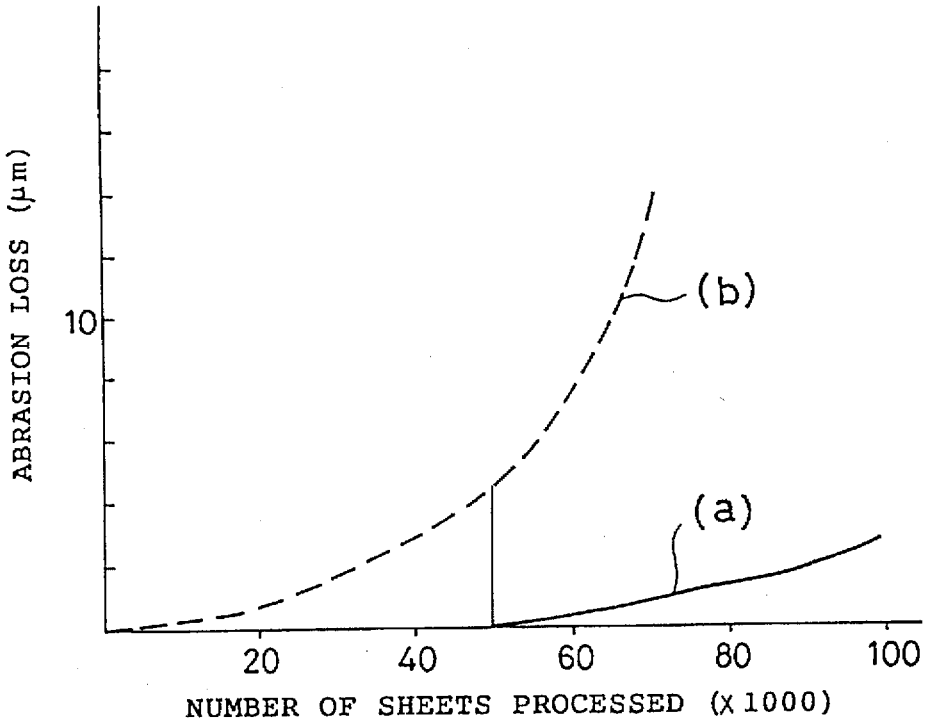
FIG. 36 is a view showing an experimental result on the durability of a release layer on the surface of a temperature detection sensor.

FIG. 36 shows the experimental result; line (a) indicates a case where a temperature detection sensor according to the present invention is used; and line (b) indicates a case where a conventional temperature detection sensor is used. When about 50,000 sheets were processed, the abrasion loss exceeded 4 μm in a release layer formed by a conventional fluorine resin material, but there was hardly any abrasion in a release layer, according to the present invention, formed by a composite material prepared by mixing by 30% in volume ratio with respect to PTFE. Also, when about 80,000 sheets were processed, the abrasion loss was noticeably great, and exceeded 10 μm in the release layer formed by a conventional fluorine resin material, but the release layer formed by a composite material according to the present invention had an abrasion loss of under 1 μm.

In this respect, in the release layer formed by a composite material according to the present invention, since the nickel contained is exposed on the surface, the abrasive resistance is considered to have noticeably been improved.

The above-described experiment measured the abrasion due to the movement of the fixing roller and the temperature detection sensor in contact therebetween. Also, as regards abrasion of the release layer on the surface of the guide plate due to a contact between a guide plate for guiding a recording sheet arranged around the fixing roller and the recording sheet, the excellent abrasive resistance was likewise shown.

Next, the description will be made of sixth to tenth embodiments according to the present invention. The sixth to tenth embodiments are structured in such a manner that, in a fixing device previously described with reference to FIG. 2, a release layer according to the present invention each is provided on the roller surfaces of both the fixing roller and the compression roller.

In the following experiments, in order to confirm, in particular, the effect of the release layer provided on the surface of the compression roller, for the release layer on the surface of the fixing roller, a material whose spectral emissivity in a wave range of wavelength of 5 to 10 μm is 0.9 or more, was used, and for the release layer on the surface of the compression roller, a material having a lower spectral emissivity than the aforesaid one was used for the experiment.

<Sixth Embodiment>

The sixth embodiment is a combination of the fixing roller and the compression roller to be described below.

Figure 37:
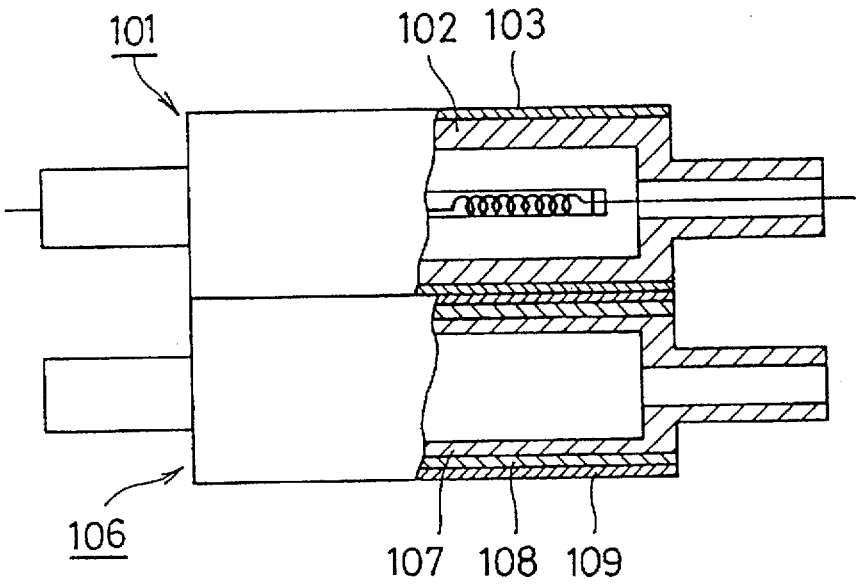
FIG. 37 is a sectional view showing a combination of the fixing roller and the compression roller in a sixth embodiment.

The fixing roller 101 has the structure shown in FIG. 37, and is prepared as follows. That is, a hollow, cylindrical core metal 102 is formed of metallic material such as aluminum, copper, and iron having good thermal conductive characteristics, and on the surface of the core metal 102, there is formed a release layer 103 made of fluorine resin such as polytetrafluoroethylene (hereinafter, referred to as PTFE) and polyphenylene alkoxyether (hereinafter, referred to as PFA).

The physical properties of the release layer of the fixing roller are such that the spectral emissivity in a wave range (infrared rays region) of wavelength of 5 to 10 μm is 0.9 or more, and that the thermal conductivity is approximately $6.0\times10^{-4}$ to $7.0\times10^{-4}$ cal/(deg.cm.s). The surface roughness Rz (10-marks mean roughness, unit: μm, hereinafter described simply as Rz) of the release layer is 40 μm or less.

The compression roller is prepared as follows. That is, in the compression roller 106 having the structure shown in FIG. 37, the hollow, cylindrical core metal 107 is formed of metallic material such as aluminum, copper, and iron having good thermal conductive characteristics, on the top of which an elastic layer 108 formed of heat-resistant material such as silicone rubber is formed to form a release layer 109 formed of fluorine resin such as PTFE and PFA on the elastic layer 108.

The release layer 109 of the compression roller is formed of a composite material prepared by mixing nickel (powder), which is metal having good thermal conductivity, by 70% in volume ratio with fluorine resin such as PTFE and PFA, and is constructed so that the spectral emissivity in a wave range of wavelength of 5 to 10 μm is lower than the spectral emissivity of the release layer of the fixing roller in a wave range of wavelength of 5 to 10 μm.

The physical properties of the release layer of the compression roller are such that the spectral emissivity in a wave range of wavelength of 5 to 10 μm is 0.15.

The description will be made of the conventional fixing roller and compression roller which are shown in order to compare with the combination of the fixing roller and the compression roller of the sixth embodiment in terms of performance.

The conventional fixing roller is the same as the fixing roller of the aforesaid sixth embodiment, and the physical properties of the release layer are such that the spectral emissivity in a wave range of wavelength of 5 to 10 μm is 0.9 or more. The conventional compression roller is substantially the same as the compression roller of the aforesaid sixth embodiment, but is different in the physical properties of the release layer, and the spectral emissivity in a wave range of wavelength of 5 to 10 μm is 0.9 or more.

<Seventh Embodiment>

The seventh embodiment is a combination of the fixing roller to be described hereinafter and the compression roller of the aforesaid sixth embodiment.

Figure 38:
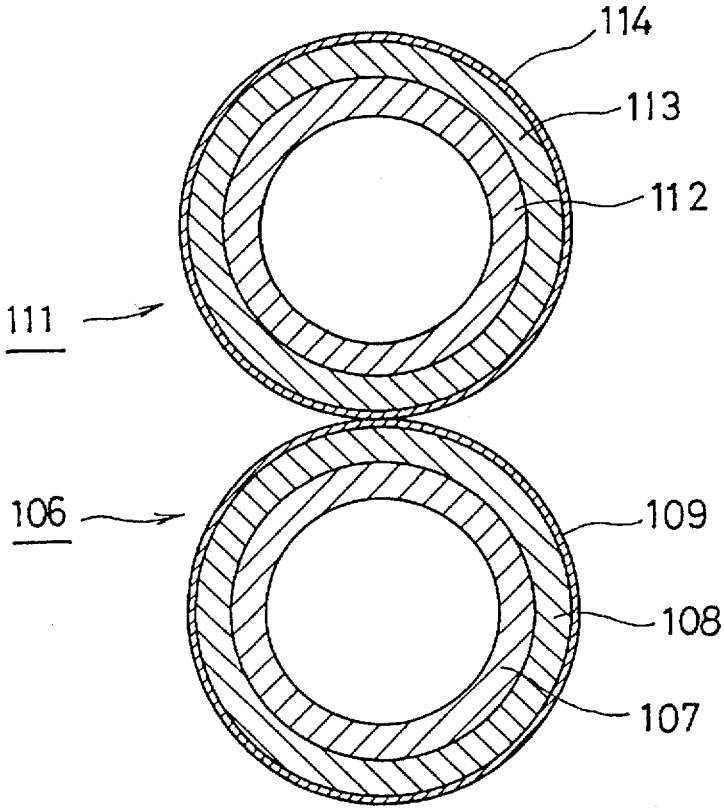
FIG. 38 is a sectional view showing a combination of the fixing roller and the compression roller in a seventh embodiment.

In the fixing roller 111 of the seventh embodiment, as shown in the sectional structure of FIG. 38, an elastic layer 113 formed of heat-resistant material such as silicone rubber is formed on the hollow, cylindrical core metal 112 formed of material such as aluminum, copper and iron having good thermal conductive characteristics, and on top of the elastic layer 113 there is formed a release layer 114 made of fluorine resin such as PTFE and PFA.

The physical properties of the release layer 114 are such that the spectral emissivity in a wave range of wavelength of 5 to 10 μm is 0.9 or more, and that the thermal conductivity is approximately $6.0\times10^{-4}$ to $7.0\times10^{-4}$ cal/(deg.cm.s). The surface roughness Rz of the release layer is 40 μm or less.

The compression roller 106 has, as shown in the sectional structure of FIG. 38, the same structure as the compression roller 106 of the aforesaid sixth embodiment. That is, the hollow, cylindrical core metal 107 is formed of metallic material such as aluminum, copper, and iron having good thermal conductive characteristics, on the top of which an elastic layer 108 formed of heat-resistant material such as silicone rubber is formed to form a release layer 109 formed of fluorine resin such as PTFE and PFA on the elastic layer.

The release layer 109 of the compression roller 106 is formed of a composite material prepared by mixing nickel (powder), which is metal having good thermal conductivity, by 70% in volume ratio with fluorine resin such as PTFE and PFA, and the spectral emissivity in a wave range of wavelength of 5 to 10 μm is 0.15.

The description will be made of the conventional fixing roller and compression roller which are shown in order to compare with the combination of the fixing roller and the compression roller of the seventh embodiment in terms of performance.

The conventional fixing roller is the same as the conventional fixing roller shown in the aforesaid seventh embodiment, and the physical properties of the release layer are such that the spectral emissivity in a wave range of wavelength of 5 to 10 μm is 0.9 or more. The conventional compression roller is the same as the conventional compression roller shown in the aforesaid sixth embodiment, and the physical properties are such that the spectral emissivity in a wave range of radiation wavelength of 5 to 10 μm is 0.9 or more.

<Eighth Embodiment>

The eighth embodiment is a combination of the fixing roller of the aforesaid seventh embodiment and a compression roller to be described hereinafter.

Figure 39:
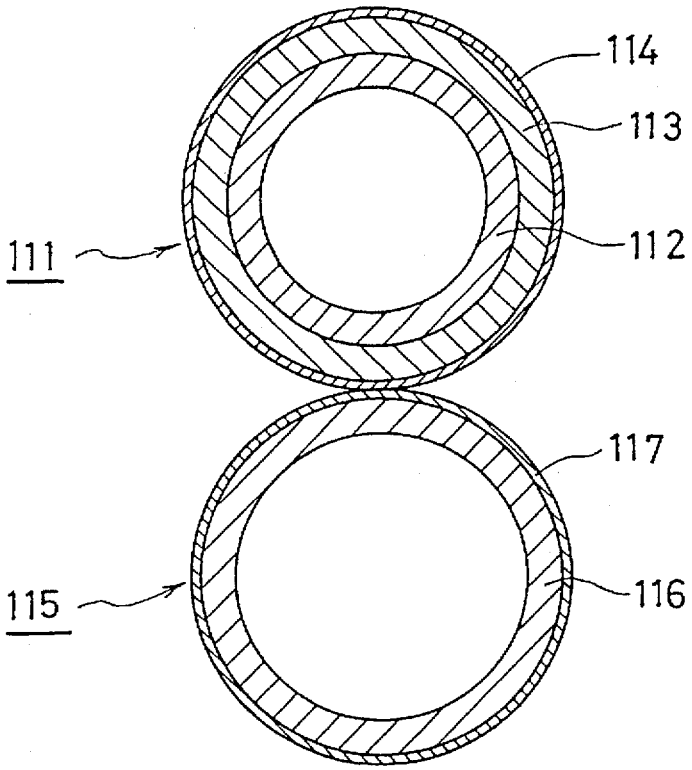
FIG. 39 is a sectional view showing a combination of the fixing roller and the compression roller in an eighth embodiment.

The fixing roller 111 of the eighth embodiment has the same structure as the fixing roller of the aforesaid seventh embodiment, and as shown in the sectional structure of FIG. 39, an elastic layer 113 formed of heat-resistant material such as silicone rubber is formed on the hollow, cylindrical core metal 112 formed of material such as aluminum, copper and iron having good thermal conductive characteristics, on top of which, there is formed a release layer 114 made of fluorine resin such as PTFE and PFA.

The physical properties of the release layer 114 are such that the spectral emissivity in a wave range of wavelength of 5 to 10 μm is 0.9 or more, and that the thermal conductivity is approximately $6.0\times10^{-4}$ to $7.0\times10^{-4}$ cal/(deg.cm.s). The surface roughness Rz of the release layer is 40 μm or less.

The compression roller 115 has been obtained by eliminating the elastic layer 108 in the compression roller 106 (refer to FIG. 37) of the aforesaid sixth embodiment, and as shown in the sectional structure of FIG. 39, on the hollow, cylindrical core metal 116 formed of material such as aluminum, copper, and iron having good thermal conductive characteristics, the release layer 117 is formed.

The release layer 117 of the compression roller 115 is formed of a composite material prepared by mixing nickel (powder), which is metal having good thermal conductivity, by 70% in volume ratio with fluorine resin such as PTFE and PFA, and the spectral emissivity in a wave range of wavelength of 5 to 10 μm is 0.15.

The description will be made of the conventional fixing roller and compression roller which are shown in order to compare with the combination of the fixing roller and the compression roller of the eighth embodiment in terms of performance.

The conventional fixing roller is the same as the conventional fixing roller shown in the aforesaid seventh embodiment, and the physical properties of the release layer are such that the spectral emissivity in a wave range of radiation wavelength of 5 to 10 μm is 0.9 or more.

The conventional compression roller is the same as the conventional compression roller shown in the aforesaid sixth embodiment, and the physical properties of the release layer are such that the spectral emissivity in a wave range of wavelength of 5 to 10 μm is 0.9 or more.

<Ninth Embodiment>

The ninth embodiment has been obtained by using a heating conveying belt in place of the fixing roller of the aforesaid sixth embodiment and by combining it with the compression roller of the sixth embodiment.

The description will be made of the heating conveying belt. The heating conveying belt of the ninth embodiment is capable of heating and fixing while conveying a non-fixed recording sheet by sandwiching it between the heating conveying belt and the compression roller.

Figure 40:
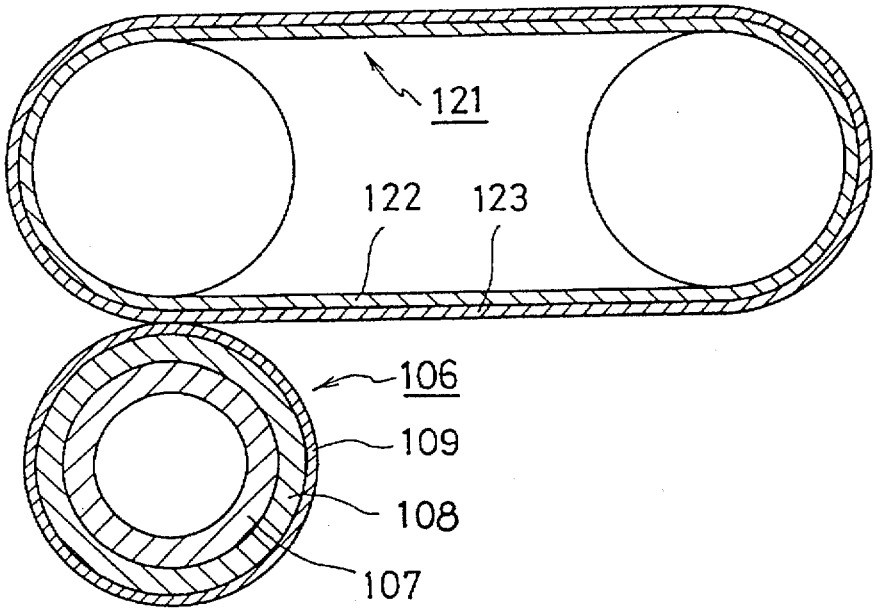
FIG. 40 is a sectional view showing a combination of the fixing belt and the compression roller in a ninth embodiment.

The heating conveying belt 121 is one obtained by forming, as shown in the sectional structure of FIG. 40, a release layer 123 formed of fluorine resin such as PTFE and PFA on thin-walled metal film 122 having a thickness of about 40 μm such as nickel alloy. In this respect, the base for the belt may be formed of heat-resistant synthetic resin film such as polyimide and polyester in place of the above-described metal film.

The physical properties of the release layer 23 are such that the spectral emissivity in a wave range of wavelength of 5 to 10 μm is 0.9 or more, and that the thermal conductivity is approximately $6.0\times10^{-4}$ to $7.0\times10^{-4}$ cal/(deg.cm.s). The surface roughness Rz of the release layer is 40 μm or less.

The compression roller 106 is the same as the compression roller (refer to FIG. 37) of the aforesaid sixth embodiment, and as shown in the sectional structure of FIG. 40, a hollow, cylindrical core metal 107 is formed of metallic material such as aluminum, copper, and iron having good thermal conductive characteristics, on top of which an elastic layer 108 formed of heat-resistant material such as silicone rubber is formed to thereby form a release layer 109 formed of fluorine resin such as PTFE and PFA on the elastic layer 108.

The release layer 109 of the compression roller is formed of a composite material prepared by mixing nickel (powder), which is metal having good thermal conductivity, by 70% in volume ratio with fluorine resin such as PTFE and PFA, and the spectral emissivity in a wave range of radiation wavelength of 5 to 10 μm is 0.15.

The description will be made of the conventional heating conveying belt and compression roller which are shown in order to compare with the combination of the heating conveying belt and the compression roller of the ninth embodiment in terms of performance.

The conventional heating conveying belt is the same as the heating conveying belt shown in the aforesaid ninth embodiment, and the physical properties of the release layer are such that the spectral emissivity in a wave range of wavelength of 5 to 10 μm is 0.9 or more. The conventional compression roller is the same as the conventional compression roller shown in the aforesaid sixth embodiment, and the physical properties of the release layer are such that the spectral emissivity in a wave range of radiation wavelength of 5 to 10 μm is 0.9 or more.

<Tenth Embodiment>

The tenth embodiment is a combination of the self-heat release type heating resistance roller and the compression roller (refer to FIG. 37) of the sixth embodiment previously described.

The self-heat release type heating resistance roller will be described. The self-heat release type heating resistance roller 131 is constructed as follows. That is, as shown in the sectional structure of FIG. 41, on a hollow, cylindrical core metal 132 formed of metal such as aluminum, copper and iron having good thermal conductive characteristics, heat-resistant synthetic resin such as phenol, and material such as ceramic, an elastic layer 133 serving dually as an electrical insulating layer, formed of heat-resistant elastic rubber such as silicone rubber and fluorine resin is formed, on top of which an electric insulating layer 134, a heating resistor layer 135, an electric insulating layer 136 and a release layer 137 are successively stacked.

The release layer 137 is formed of fluorine resin such as PTFE and PFA. The physical properties of the release layer are such that the spectral emissivity in a wave range of wavelength of 5 to 10 μm is 0.9 or more, and that the thermal conductivity is approximately within a range of $6.0\times10^{-4}$ to $7.0\times10^{-4}$ cal/(deg.cm.s).

Figure 41:
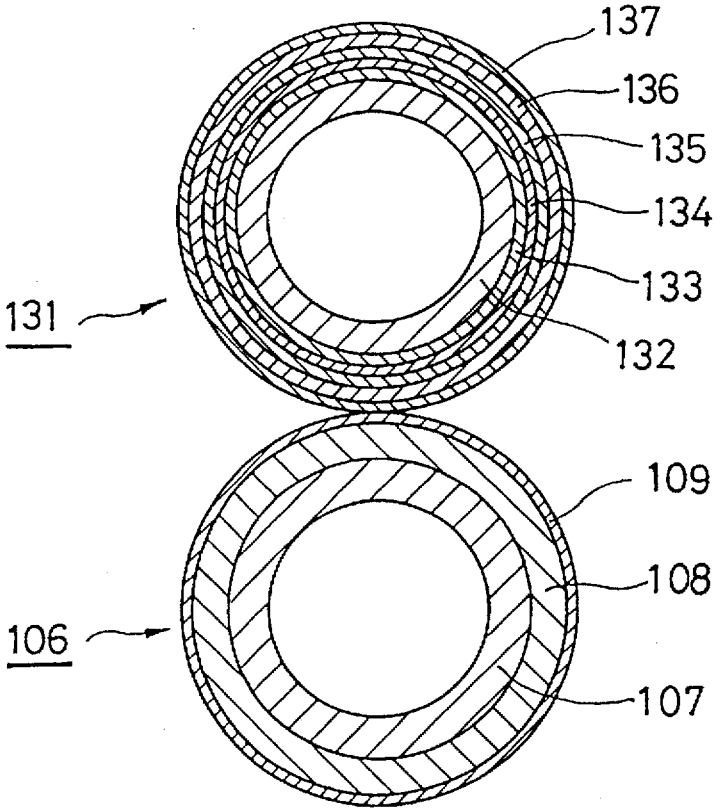
FIG. 41 is a sectional view showing a combination of the self-heat release type heating resistance roller and the compression roller in a tenth embodiment.

The compression roller 106 is the same as the compression roller (refer to FIG. 37) of the aforesaid sixth embodiment, and as shown in the sectional structure of FIG. 41, a hollow, cylindrical core metal 107 is formed of metallic material such as aluminum, copper, and iron having good thermal conductive characteristics, on top of which an elastic layer 108 formed of heat-resistant material such as silicone rubber is formed to thereby form a release layer 109 formed of fluorine resin such as PTFE and PFA on the elastic layer 108.

The release layer 109 of the compression roller is formed of a composite material prepared by mixing nickel (powder), which is metal having good thermal conductivity by 70% in volume ratio with fluorine resin such as PTFE and PFA, and the spectral emissivity in a wave range of radiation wavelength of 5 to 10 μm is 0.15.

The description will be made of the conventional self-heat release type heating resistance roller and compression roller which are shown in order to compare with the combination of the self-heat release type heating resistance roller and the compression roller of the tenth embodiment in terms of performance.

The conventional self-heat release type heating resistance roller is the same as the self-heat release type heating resistance roller shown in the aforesaid tenth embodiment, and the physical properties of the release layer are such that the spectral emissivity in a wave range of wavelength of 5 to 10 μm is 0.9 or more. The conventional compression roller is the same as the conventional compression roller shown in the aforesaid sixth embodiment, and the physical properties of the release layer are such that the spectral emissivity in a wave range of radiation wavelength of 5 to 10 μm is 0.9 or more.

<Description of Experimental Result>

Concerning the sixth to tenth embodiments, experiments were conducted under various conditions, and the results will be described hereinafter.

Incidentally, the spectral emissivity was measured in this experiment by using a thermal radiation measuring device (Fourier conversion infrared spectrophotometer Type FT4200 and thermal radiation measuring system (black body furnace, sample heating furnace and temperature controller) manufactured by Shimadzu Seisakusho Ltd.)), and the measurement was performed in an infrared rays region of wavelength of 5 to 10 μm at a measuring temperature of 200° C.

The size of the sample for measurement of the spectral emissivity was 10×50 mm. Also, to eliminate the influence of the surroundings of the sample, the measuring range was adjusted to 5×10 mm by means of an aperture for measurement. High-temperature black body paint (emissivity 0.9) was coated on a half of the surface of the sample, which was used as a pseudo black body.

The measuring method was to first measure the spectral emissivity with the pseudo black body as reference, and to adjust the temperature of the sample heating furnace so as to be in equilibrium at emissivity of 90%. When the emissivity of the pseudo black body becomes 90%, the sample was moved to measure the spectral emissivity of the sample to be measured at that temperature.

<Experiment 29. Power Consumption of Fixing Roller, Part 1>

The power consumption of the fixing roller was measured. The experiment was conducted for the combination of the fixing roller and compression roller of the sixth embodiment.

For the experimental method, a heating halogen heater arranged within the fixing roller is first energized and heated through a temperature control circuit. The surface temperature is detected by a temperature detection sensor, and the heater energizing time is controlled to maintain a predetermined temperature suitable for fixing. Thus, the electric energy consumed for a specified period of time is measured by the use of a watt-hour meter.

Figure 42:
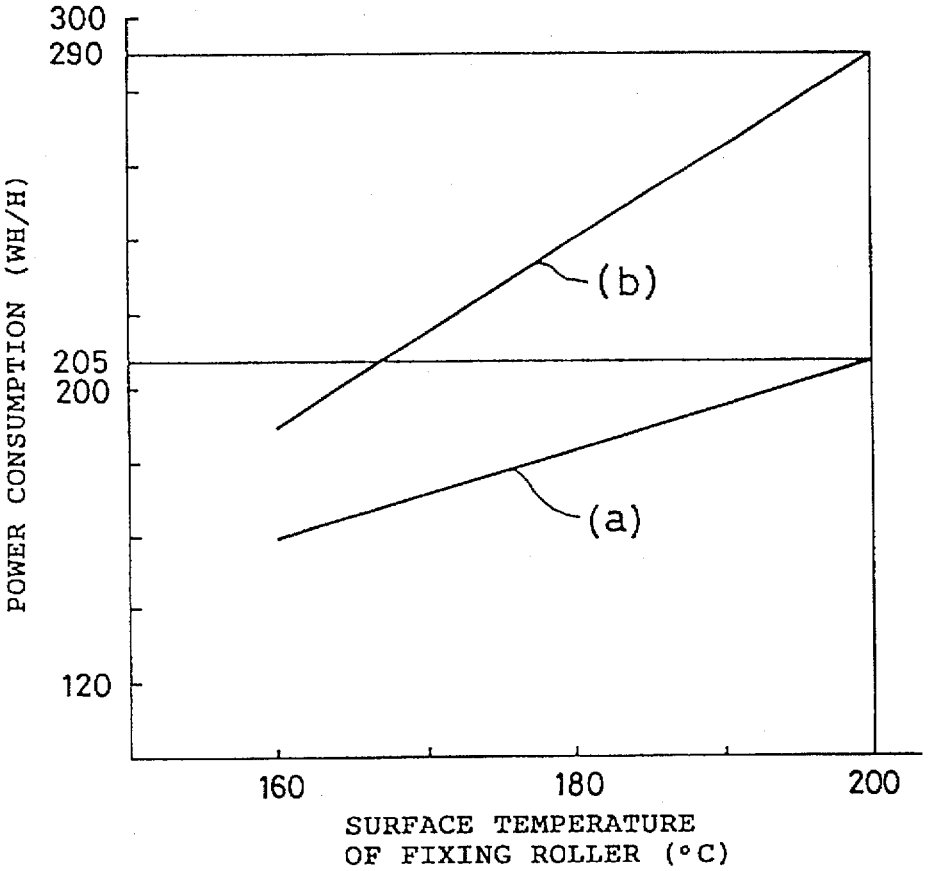
FIG. 42 is a view showing an experimental result on relation between the surface temperature of the fixing roller and the power consumption.

FIG. 42 is a view showing the measured result for the surface temperature and electric power consumed for a specified period of time in a combination of a fixing roller and a compression roller of the sixth embodiment; line (a) indicates the power consumption in the combination of the present invention; and line (b) indicates the power consumption in the conventional combination of fixing roller and compression roller.

When the surface temperature of the fixing roller is maintained at 200° C., as is apparent from the figure, the power consumption was 290 WH/H with the conventional fixing roller, but becomes 205 WH/H with a fixing roller of the sixth embodiment. Thus, it can be seen that the power consumption is greatly reduced by about 30%.

In this respect, it is considered that in a combination of rollers in the sixth embodiment, for the release layer of the compression roller, a material obtained by mixing nickel, which is a good thermal conductive substance, by 70% in volume ratio with fluorine resin such as PTFE and PFA is used, whereby the heat emissivity from the surface of the compression roller becomes lower than that from the conventional compression roller surface, and the heat emitted from the surface of the fixing roller is reflected by the compression roller surface to be returned to the fixing roller.

The power consumption required to maintain the surface temperature of the fixing roller at a predetermined temperature increases with a higher target temperature to be maintained, but there is seen a tendency to reduce the rate of increase in power consumption at the lower spectral emissivity on the surface of the compression roller. In other words, the higher the surface temperature of the fixing roller is, the power consumption of the compression roller (spectral emissivity 0.15) of the sixth embodiment has lower rate of increase than the conventional compression roller (spectral emissivity 0.9).

Figure 43:
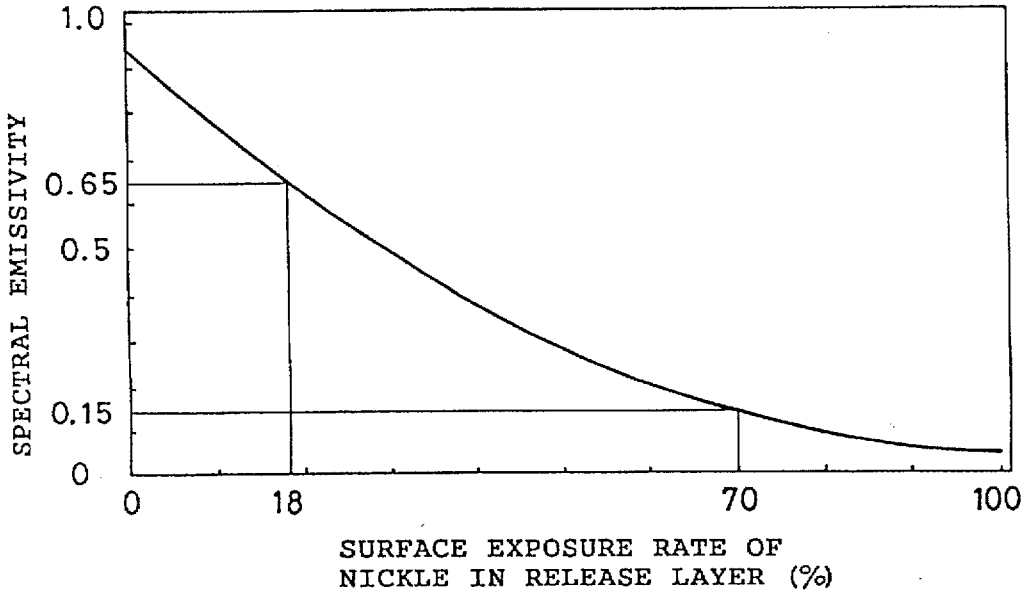
FIG. 43 is a view showing an experimental result on relation between a surface exposure ratio of the metal contained in release layers on the fixing roller and compression roller and the spectral emissivity.

FIG. 43 shows the experimental result on the relation between surface exposure rate of metal in the release layers for the fixing roller and compression roller, and spectral emissivity (spectral emissivity in a wave range of wavelength of 5 to 10 μm) concerning a combination of the fixing roller and the compression roller of the sixth embodiment.

As is apparent from the figure, in a composite material of PTFE (fluorine resin) and nickel which constitutes the release layers for the fixing and compression rollers, when the nickel content increases, that is, when the surface exposure rate of nickel in the release layer increases, the spectral emissivity lowers, and the composite material of spectral emissivity of 0.65 at a surface exposure rate of 18% has spectral emissivity of 0.15 at a surface exposure rate of 70%.

Figure 44:
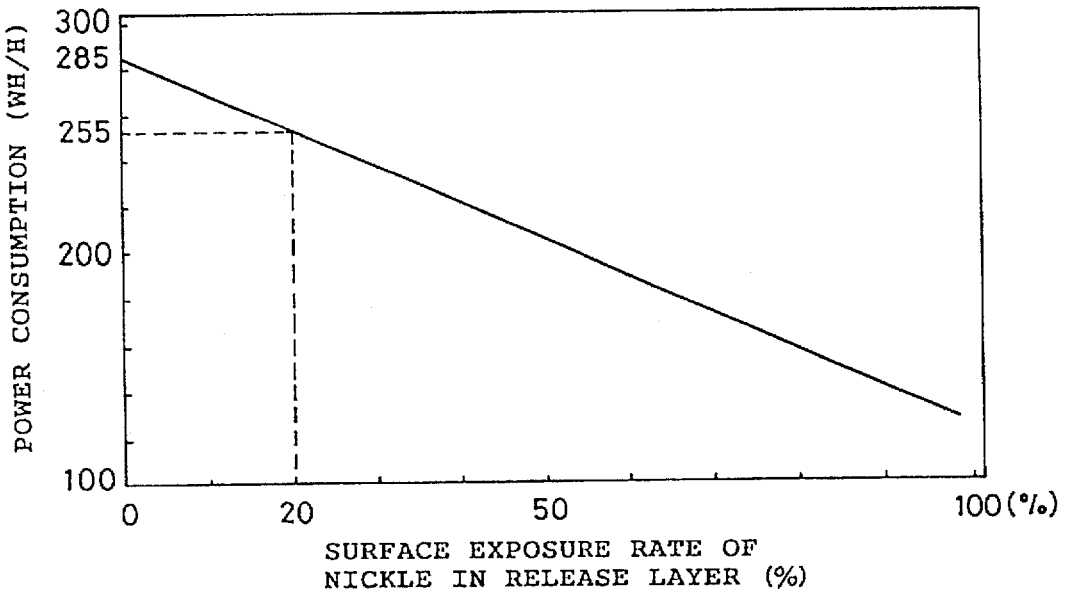
FIG. 44 is a view showing an experimental result on relation between a surface exposure ratio of the metal contained in a release layer on fixing roller and the spectral emissivity.

FIG. 44 shows the experimental result on the relation between surface exposure rate of nickel in the release layer of the fixing roller, and power consumption concerning the fixing roller of the sixth embodiment when the surface temperature of the heating conveying roller is maintained at 200° C. As is apparent from FIG. 44, in a composite material of PTFE (fluorine resin) and nickel which constitutes the release layer for the fixing roller, when the nickel content increases, that is, when the surface exposure rate of nickel in the release layer increases, the power consumption lowers, and at the surface exposure rate of nickel of 20%, the power consumption becomes 255 WH/H, which is 10% or more less than the power consumption of 285 WH/H, of the conventional fixing roller having a release layer containing no nickel.

<Experiment 30. Power Consumption of Fixing Roller, Part 2>

An experiment was conducted for a combination of a fixing roller and a compression roller of the sixth embodiment to study the influence of different materials of the release layer for the compression roller on the power consumption.

For the experimental method, a plurality of compression rollers whose release layers are formed of materials having different Nickel (low heat emissive material) contents of PTFE (fluorine resin), which is release material, are first prepared.

Concerning a plurality of compression rollers whose release layers are formed of materials having different nickel contents, a heating halogen heater arranged within the fixing roller is energized and heated through a temperature control circuit. The surface temperature is detected by a temperature detection sensor, and the heater energizing time is controlled to maintain a predetermined set temperature. Thus, the electric energy consumed for a specified period of time is measured by the use of a watt-hour meter. The experiments were conducted at three set temperatures: 120° C., 160° C. and 200° C.

Figure 45:
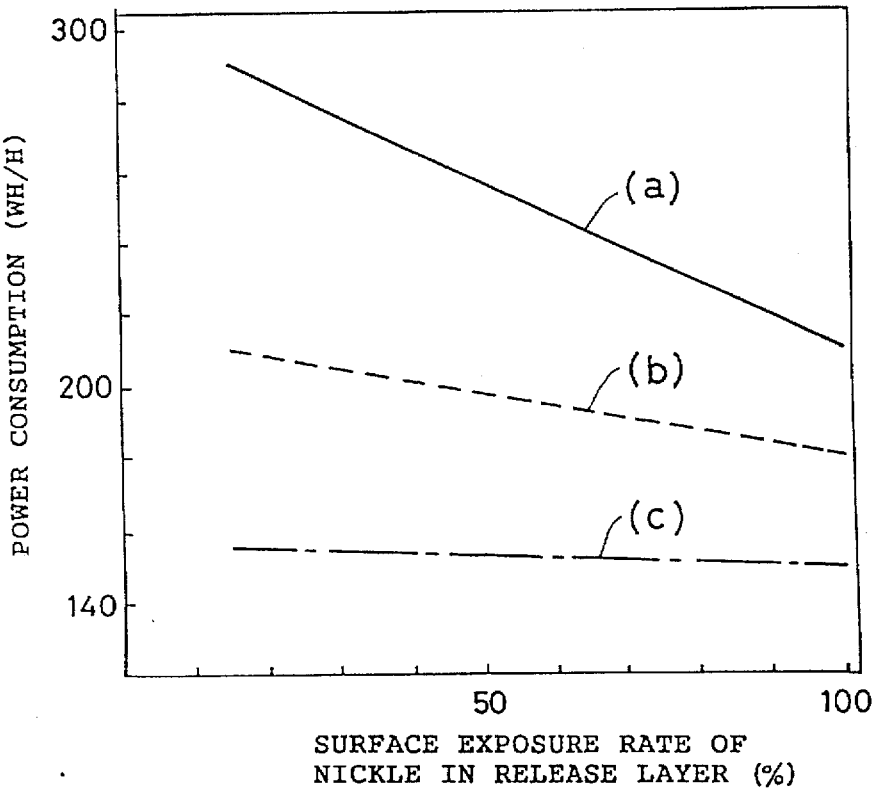
FIG. 45 is a view showing an experimental result on relation between the surface exposure ratio of the metal contained in the release layer on the compression roller and the power consumption.

FIG. 45 shows the experimental results on the relation between the nickel content of PTFE (fluorine resin) (release material) of the release layer of compression roller, i.e., nickel exposure rate of the release layer, and the power consumption of the fixing roller at respective surface temperatures of 120° C., 160° C. and 200° C. Line (a) indicates the power consumption at surface temperature of 200° C., line (b) indicates the power consumption at 160° C. and line (c) indicates the power consumption at 120° C., respectively.

As is apparent from FIG. 45, the nickel content of PTFE (fluorine resin) constituting the release layer of the compression roller and the power consumption are approximated to a linear expression, and the lower the nickel (low heat emissive material) content is, the more the power consumption increases. This is probably because the lower the nickel content is, the heat emitted from the surface of the fixing roller is less reflected by the compression roller, and the heat to be returned to the fixing roller becomes less.

Figure 46:
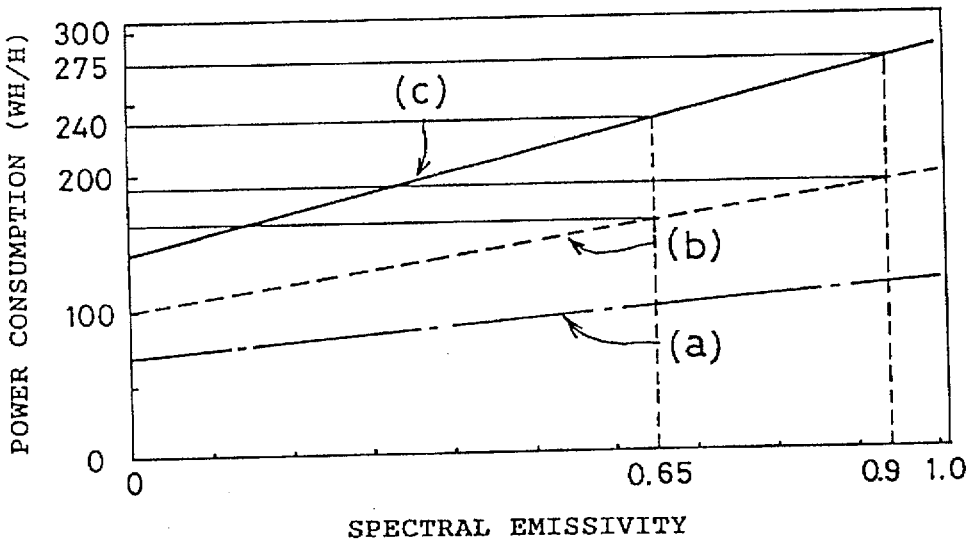
FIG. 46 is a view showing an experimental result on relation between the spectral emissivity of a release layer and the power consumption.

FIG. 46 shows, as an experiment relating to the aforesaid experiment, the experimental result between the power consumption of the fixing roller, and spectral emissivity of the release layer of compression roller in a wave range of wavelength of 5 to 10 μm at the respective surface temperatures of the fixing roller of 120° C. (line (a)), 160° C. (line (b)) and 200° C. (line (c)).

As is apparent from FIG. 46, with the conventional compression roller having spectral emissivity of the release layer of 0.9, the power consumption required to maintain the surface temperature of the fixing roller at 200° C. was 275 KW/H, but with the compression roller according to the present invention having spectral emissivity of the release layer of 0.65, the power consumption becomes about 240 KW/H, showing that the power consumption can be saved by 10% or more.

The higher the surface temperature of the fixing roller is, the greater the difference in power consumption between the conventional compression roller and the compression roller according to the present invention becomes. This means that the power consumption saving effect becomes further higher in a high-speed image forming apparatus in which the surface temperature of the fixing roller is set higher.

<Experiment 31. Combination of Fixing and Compression Rollers having Different Spectral Emissivity and Power Consumption>

Experiments were conducted to study the relation between power consumption and combinations of a plurality of fixing rollers and compression rollers having different spectral emissivity.

In these experiments, concerning a plurality of fixing rollers and compression rollers having different spectral emissivity of the release layer respectively, combinations shown in Table 1 were prepared, and the power consumption was measured for each of the combinations.

TABLE 1

| Combination | Fixing Roller Spectral Emissivity | Compression Roller Spectral Emissivity |
|---|---|---|
| (a) | 0.9 | 0.9 |
| (b) | 0.9 | 0.15 |
| (c) | 0.65 | 0.9 |
| (d) | 0.65 | 0.65 |
| (e) | 0.65 | 0.15 |

For the experimental method, fixing rollers and compression rollers of the above-described combinations are prepared, a heating halogen heater arranged within the fixing roller is energized and heated through a temperature control circuit. The surface temperature is detected by a temperature detection sensor, and the heater energizing time is controlled to maintain a predetermined set temperature. Thus, the electric energy consumed for a specified period of time is measured by the use of a watt-hour meter.

Figure 47:
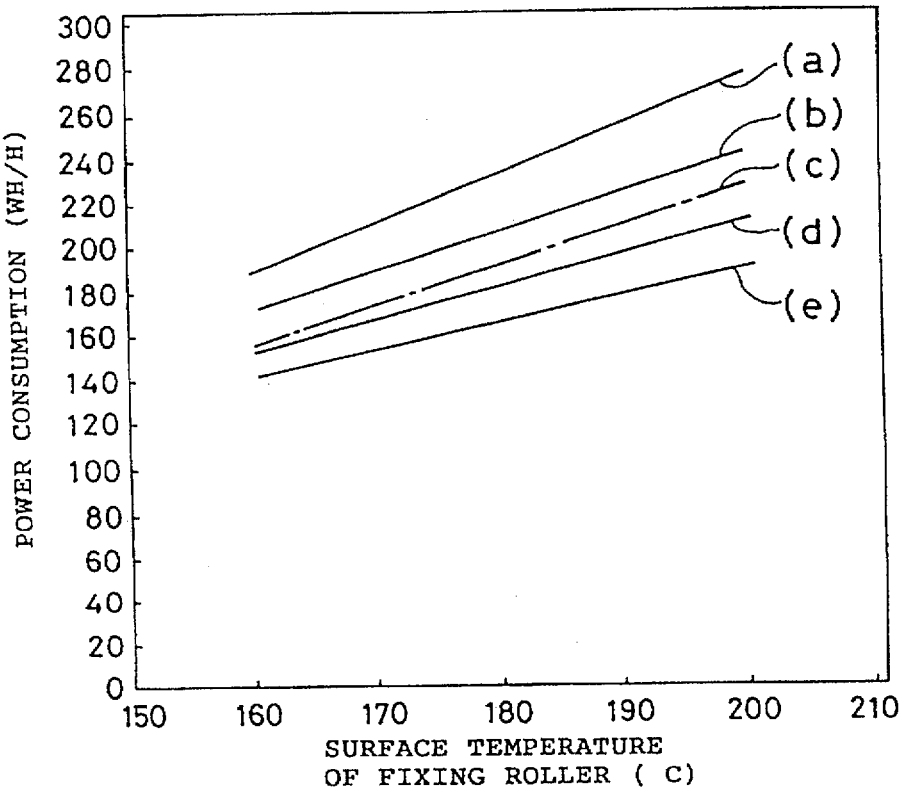
FIG. 47 is a view showing an experimental results on relation between the surface temperature of the fixing roller and the power consumption for various combinations of fixing and compression rollers having different spectral emissivity of the release layer.

FIG. 47 shows the experimental results; line (a) shows power consumption in a combination of a fixing roller and a compression roller both having spectral emissivity of release layer of 0.9; line (b) shows power consumption in a combination of a conventional fixing roller (spectral emissivity of release layer of 0.9) and a compression roller having spectral emissivity of release layer of 0.15. Line (c) shows power consumption in a combination of a fixing roller having spectral emissivity of release layer of 0.65 and a conventional compression roller (spectral emissivity of release layer of 0.9); line (d) shows power consumption in a combination of a fixing roller and a compression roller both having spectral emissivity of release layer of 0.65; and line (e) shows power consumption in a combination of a fixing roller having spectral emissivity of release layer of 0.65 and a compression roller having spectral emissivity of release layer of 0.15.

As is apparent from FIG. 47, if the spectral emissivity of the release layers of the fixing and compression rollers is made lower, the power consumption can be saved, and if the spectral emissivity of the release layer of the compression roller is made lower than that of the fixing roller, the power consumption can be further saved.

Although it is advantageous in the saving of power consumption to constitute the release layers for the fixing and compression rollers by a material having low spectral emissivity, when the low heat emissive material (for example, nickel) content of a release material (for example, PTFE (fluorine resin)) is increased to make the spectral emissivity lower, the mold release performance gradually lowers.

Since the fixing roller fuses and fixes on directly contacting a non-fixed toner image, the release layer must secure sufficient mold release characteristics. For this reason, the material for the release layer of the fixing roller has naturally a limit in the low heat emissive material content of the release material. On the other hand, since the compression roller does not fuse and fix on directly contacting the non-fixed image, the mold release characteristics required for the release layer is not so high as the mold release characteristics required for the release layer of the fixing roller. Therefore, in the material for the release layer of the compression roller, it is possible to increase the low heat emissive material content more than the material for the release layer of the fixing roller and to make the spectral emissivity lower.

The above-described experiment was conducted for the combination of a fixing roller and a compression roller of the sixth embodiment, but also for the combinations of fixing rollers (fixing belt) and compression rollers of the second to fifth embodiments, the substantially similar results could be obtained.

As described above, the fixing device for an image forming apparatus according to the present invention is the one obtained by constituting the release layer to be formed on the surface of a heating convey rotatable member as the fixing means, i.e., a fixing roller, a fixing elastic roller, a fixing elastic belt, a self-heat release type fixing roller and the like, by a material having spectral emissivity in a wave range of wavelength of 5 to 10 μm of 0.65 or less, for example, a composite material obtained by mixing a low heat emissive material such as nickel with a synthetic resin material such as PTFE. Therefore, it is possible to control the surface temperature of the heating convey rotatable member to be lower than that of a conventional heating convey rotatable member while maintaining the fixing strength of toner required, and to reduce the heat losses without taking any heat diffusion preventing means such as heat insulating material, thus saving the power consumption. Also, since it is possible to control the surface temperature of the heating convey rotatable member to be lower than that of the conventional heating convey rotatable member, the fixing device can exhibit excellent operational effects such as starting the fixing operation in an exceedingly short time even if a command to start the operation is given when the image forming apparatus is in a standby state or the like.

A heating convey rotatable member having a single or a plurality of elastic layers is provided with a release layer formed of the above-described composite material, whereby it becomes possible to fix so as to obtain a higher quality image than one provided with no elastic layer, thus exhibiting excellent operational effect such as improving the durability, which was a disadvantage of a heating convey rotatable member provided with an elastic layer.

If a separating member for separating a recording sheet from the heating convey rotatable member is provided with a release layer formed of the aforesaid composite material, the heat absorptivity of the separating member becomes lower, and the temperature rises less. Therefore, the separating member cannot only be formed of resin material with lower heat resistance, but also heat from the separating member is more reflected, and the heating convey rotatable member is secondarily heated by the reflective heat, resulting in saved power consumption during start or standby of the image forming apparatus. When the separating member is provided with a release layer formed of the aforesaid composite material, the thermal conductivity on the surface becomes higher than that of one formed of a conventional resin material, and therefore, image noise caused by refusing of a fixed toner image or the like will not occur unlike the conventional separating member, thus exhibiting excellent operational effect such as obtaining a high-quality image.

Further, if temperature detection means for detecting the surface temperature of the heating convey rotatable member is provided with a release layer formed of the aforesaid composite material, the surface emissivity of the temperature detection means becomes lower, and the heat is more reflected. Therefore, in the same manner as in the case of the aforesaid separating member, the heating convey rotatable member is secondarily heated by the reflective heat, resulting in saved power consumption during start or standby of the image forming apparatus. Also, since the surface thermal conductivity of the temperature detection means becomes higher than the conventional one, the follow-up property to change in temperature is improved, and a heating convey rotatable member having high response to change in temperature can be temperature controlled. In addition, the release layer has excellent mold release characteristics and abrasive resistance, thus exhibiting excellent operational effect such as providing highly reliable temperature control over a long period of time.

In case where a release layer each is provided on the respective surfaces of the fixing roller and the compression roller, when the release layer of the compression roller is formed of a material, whose spectral emissivity in a wave range of wavelength of 5 to 10 μm is lower than that of the release layer of the aforesaid fixing roller in the aforesaid wave range, it is possible to control the surface temperature of the fixing roller to be lower than that of a conventional roller while maintaining the fixing strength of toner required, and to reduce the heat losses without taking any heat diffusion preventing means such as heat insulating material, thus saving the power consumption.

Also, since it is possible to control the surface temperature of the fixing roller to be lower than that of the conventional roller, the fixing device can exhibit excellent operational effects such as starting the fixing operation in an exceedingly short time even if a command to start the operation is given when the image forming apparatus is in a standby state or the like.

It is further understood by those skilled in the art that the foregoing description is a preferred embodiment of the disclosed device and that various changes and modifications may be made in the invention without departing from the spirit and scope thereof.

What is claimed is:

1. A fixing device for an image forming apparatus having fixing means formed of a heating convey rotatable member for heating and fixing a toner image formed on a recording medium, said heating convey rotatable member having a release layer on the surface thereof, and said release layer being formed of a material whose spectral emissivity in a wave range of wavelength of 5 to 10 μm is 0.65 or less.

2. A fixing device for an image forming apparatus as claimed in claim 1, wherein said release layer is formed of a composite material of a release material and a low emissive material having lower spectral emissivity in a wave range of wavelength of 5 to 10 μm than the spectral emissivity of said release material.

3. A fixing device for an image forming apparatus as claimed in claim 2, wherein the low emissive layer material contained in said composite material constituting said release layer is metal.

4. A fixing device for an image forming apparatus as claimed in claim 3, wherein said low emissive material is nickel.

5. A fixing device for an image forming apparatus as claimed in claim 2, wherein the release material contained in said composite material constituting said release layer is a kind or a plurality of fluorine resin.

6. A fixing device for an image forming apparatus having fixing means formed of a heating convey rotatable member for heating and fixing a toner image formed on a recording medium, and separating means for separating said recording medium from said heating convey rotatable member, said separating means having a release layer on the surface thereof, and said release layer on the surface of said separating means having lower spectral emissivity in a wave range of wavelength of 5 to 10 μm than the spectral emissivity of a release layer of said heating convey rotatable member in said wave range, and the spectral emissivity of the material of said separating means in said wave range, and being formed of a material having high thermal conductivity.

7. A fixing device for an image forming apparatus as claimed in claim 6, wherein said release layer on the surface of said separating means is formed of a material whose spectral emissivity in a wave range of wavelength of 5 to 10 μm is 0.5 or less.

8. A fixing device for an image forming apparatus as claimed in claim 6, wherein said release layer on the surface of said separating means is formed of a composite material of a release material and a low heat emissive material having lower spectral emissivity in a wave range of wavelength of 5 to 10 μm than the spectral emissivity of said release material.

9. A fixing device for an image forming apparatus as claimed in claim 8, wherein the release material contained in a composite material constituting said release layer on the surface of said separating means is a kind or a plurality of fluorine resin.

10. A fixing device for an image forming apparatus as claimed in claim 8, wherein the low heat emissive material contained in a composite material constituting said release layer of said separating means is a material whose spectral emissivity in a wave range of wavelength of 5 to 10 μm is 0.2 or less.

11. A fixing device for an image forming apparatus as claimed in claim 8, wherein the low heat emissive material contained in a composite material constituting said release layer on the surface of said separating means is a kind or a plurality of metal or metallic alloy.

12. A fixing device for an image forming apparatus as claimed in claim 8, wherein the low heat emissive material contained in a composite material constituting said release layer on the surface of said separating means is a material whose thermal conductivity is 1 w/mk or more.

13. A fixing device for an image forming apparatus having fixing means formed of a heating convey rotatable member for heating and fixing a toner image formed on a recording medium, and temperature detection means for detecting the surface temperature of said heating convey rotatable member, said temperature detection means having a release layer on the surface thereof, and said release layer of said temperature detection means having lower spectral emissivity in a wave range of wavelength of 5 to 10 μm than the spectral emissivity of a release layer of said heating convey rotatable member in said wave range, and being formed of a material having high thermal conductivity.

14. A fixing device for an image forming apparatus as claimed in claim 13, wherein said release layer on the surface of said temperature detection means is formed of a material whose spectral emissivity in a wave range of wavelength of 5 to 10 μm is 0.5 or less.

15. A fixing device for an image forming apparatus as claimed in claim 13, wherein said release layer on the surface of said temperature detection means is formed of a composite material of a release material and a low heat emissive material having lower spectral emissivity in a wave range of wavelength of 5 to 10 μm than the spectral emissivity of said release material.

16. A fixing device for an image forming apparatus as claimed in claim 15, wherein the release material contained in a composite material constituting said release layer of said temperature detection means is a kind or a plurality of fluorine resin.

17. A fixing device for an image forming apparatus as claimed in claim 15, wherein the low heat emissive material contained in a composite material constituting said release layer of said temperature detection means is a material whose spectral emissivity in a wave range of radiation wavelength of 5 to 10 μm, is 0.2 or less.

18. A fixing device for an image forming apparatus as claimed in claim 15, wherein the low heat emissive material contained in a composite material constituting said release layer of said temperature detection means is a kind or a plurality of metal or metallic alloy.

19. A fixing device for an image forming apparatus as claimed in claim 15, wherein the low heat emissive material contained in a composite material constituting said release layer of said temperature detection means is a material whose thermal conductivity is 1 w/mk or more.

20. A fixing device for an image forming apparatus having fixing means consisting of a heating convey rotatable member for heating and fixing a toner image formed on a recording medium and a compression convey rotatable member, said heating convey rotatable member and said compression convey rotatable member having a release layer on the surface thereof respectively, and the release layer on the surface of said compression convey rotatable member being formed of a material whose spectral emissivity in a wave range of wavelength of 5 to 10 μm is lower than that in said wave range of the release layer on the surface of said heating convey rotatable member.

21. A fixing device for an image forming apparatus as claimed in claim 20, wherein the release layer of said compression convey rotatable member has spectral emissivity of 0.65 or less in a wave range of wavelength of 5 to 10 μm.

22. A fixing device for an image forming apparatus as claimed in claim 20, wherein of the release layers of said heating convey rotatable member and said compression convey rotatable member, at least the release layer of said compression convey rotatable member is formed of a composite material of a release material and a material whose spectral emissivity in a wave range of wavelength of 5 to 10 μm is lower than that of said release material.

23. A fixing device for an image forming apparatus having fixing means consisting of a heating convey rotatable member for heating and fixing a toner image formed on a recording medium and a compression convey rotatable member, said heating convey rotatable member and said compression convey rotatable member having a release layer formed of a composite material of a release material and a low emissive material respectively, and said low emissive material of the composite material constituting the release layers of said heating convey rotatable member and said compression convey rotatable member having spectral emissivity, of 0.65 or less, in a wave range of wavelength of 5 to 10 μm.

24. A fixing device for an image forming apparatus as claimed in claim 23, wherein the release material of a composite material constituting the release layers of said heating convey rotatable member and said compression convey rotatable member is a kind or a plurality of fluorine resin.

25. A fixing device for an image forming apparatus as claimed in claim 23, wherein the release material of a composite material constituting the release layers of said heating convey rotatable member and said compression convey rotatable member is silicone rubber.

26. A fixing device for an image forming apparatus as claimed in claim 23, wherein the low emissive material of a composite material constituting the release layers of said heating convey rotatable member and said compression convey rotatable member is a kind or a plurality of metal or metallic alloy.

27. A fixing device for an image forming apparatus having fixing means consisting of a heating convey rotatable member for heating and fixing a toner image formed on a recording medium and a compression convey rotatable member, said heating convey rotatable member and said compression convey rotatable member having a release layer formed of a composite material of a release material and a low emissive material respectively, and a surface exposure rate of a low emissive material contained in the release layer of said compression convey rotatable member being higher than that of a low heat emissive material contained in the release layer of said heating convey rotatable member.

* * * * *